US011313605B2

(12) United States Patent
Kieling et al.

(10) Patent No.: US 11,313,605 B2
(45) Date of Patent: Apr. 26, 2022

(54) INSULATED CARRIER FOR TEMPERATURE-CONTROLLED ITEMS

(71) Applicant: PackIt, LLC, Westlake Village, CA (US)

(72) Inventors: Melissa Kieling, Agoura Hills, CA (US); Roland Ecarma, Northridge, CA (US); Kenneth Arthur Gross, Porter Ranch, CA (US)

(73) Assignee: PACKIT, LLC, Westlake Village, CA (US)

( * ) Notice: Subject to any disclaimer, the term of this patent is extended or adjusted under 35 U.S.C. 154(b) by 95 days.

(21) Appl. No.: 16/593,542

(22) Filed: Oct. 4, 2019

(65) Prior Publication Data

US 2020/0109889 A1 Apr. 9, 2020

Related U.S. Application Data

(60) Provisional application No. 62/844,211, filed on May 7, 2019, provisional application No. 62/741,206, filed on Oct. 4, 2018.

(51) Int. Cl.
*F25D 3/08* (2006.01)
*B65D 81/38* (2006.01)
(Continued)

(52) U.S. Cl.
CPC ..... *F25D 3/08* (2013.01); *B65D 25/2882* (2013.01); *B65D 43/22* (2013.01); *B65D 81/38* (2013.01);
(Continued)

(58) Field of Classification Search
CPC ... A45C 11/20; F25D 3/08; F25D 3/06; F25D 3/02; B65D 81/3811; B65D 81/38;
(Continued)

(56) References Cited

U.S. PATENT DOCUMENTS 1,672,322 A 6/1928 Keiser et al.
2,831,624 A * 4/1958 Lever ..... B65D 5/4287 383/4
(Continued)

FOREIGN PATENT DOCUMENTS

AU 2004216674 B2 4/2005
AU 2010238657 A1 11/2011
(Continued)

OTHER PUBLICATIONS

International Search Report filed in PCT/US2019/054779, dated Jan. 23, 2020, 3 pages.
(Continued)

*Primary Examiner* — Robert J Hicks
(74) *Attorney, Agent, or Firm* — Vedder Price P.C.

(57) ABSTRACT

The present application generally relates to devices and methods for transporting, delivering, and storing items, and it more specifically relates to insulated carriers for use in transporting, delivering, and storing temperature controlled items such as perishable food and beverage items. Embodiments provide for insulated containers having an interior cavity surrounded by one or more panels having insulation wherein the containers are collapsible to allow for the efficient storage and transport of the containers while empty.

34 Claims, 63 Drawing Sheets

(51) Int. Cl.
*B65D 25/28* (2006.01)
*B65D 43/22* (2006.01)

(52) U.S. Cl.
CPC ..... *F25D 2303/082* (2013.01); *F25D 2303/0832* (2013.01); *F25D 2331/801* (2013.01)

(58) Field of Classification Search
CPC .... B65D 81/3888; B65D 43/22; B65D 43/16; B65D 25/2882; B65D 25/2885; B65D 25/2888
USPC ..... 220/592.26, 592.2, 592.09, 592.03, 220/592.22, 324, 315, 230, 754, 752; 62/457.4, 457.2, 457.7, 457.9
See application file for complete search history.

(56) References Cited

U.S. PATENT DOCUMENTS 3,207,830 A 9/1965 Aldington
3,262,283 A 7/1966 Taylor et al.
4,679,242 A 7/1987 Brockhaus
4,700,706 A 10/1987 Münch
4,831,842 A 5/1989 Kelley et al.
5,005,374 A 4/1991 Spitler
5,274,865 A 1/1994 Takehashi
5,361,603 A 11/1994 Merritt-Munson
5,490,396 A 2/1996 Morris
5,533,361 A 7/1996 Halpern
5,562,228 A 10/1996 Ericson
5,857,778 A 1/1999 Ells
5,904,230 A 5/1999 Peterson
5,906,290 A * 5/1999 Haberkorn ..... B65D 81/3886 220/505
6,048,099 A 4/2000 Muffett et al.
6,068,402 A 5/2000 Freese et al.
6,220,473 B1 4/2001 Lehman et al.
6,223,551 B1 5/2001 Mitchell
6,422,032 B1 7/2002 Green
6,427,475 B1 8/2002 Defelice et al.
6,474,095 B1 11/2002 Chan
6,666,044 B2 12/2003 Gagnon
6,925,834 B2 8/2005 Fuchs
7,065,983 B2 6/2006 Trinh et al.
7,162,890 B2 1/2007 Mogil et al.
7,299,652 B2 11/2007 Gagnon
7,302,810 B2 12/2007 McCrory
7,344,022 B2 3/2008 Madson
7,344,028 B2 3/2008 Hanson
7,597,478 B2 10/2009 Pruchnicki et al.
7,669,436 B2 3/2010 Mogil et al.
7,682,080 B2 3/2010 Mogil
7,757,878 B2 7/2010 Mogil et al.
D620,707 S 8/2010 Mogil
7,775,388 B2 8/2010 Murrer, III
7,784,301 B2 8/2010 Sasaki et al.
D627,199 S 11/2010 Pruchnicki
7,841,207 B2 11/2010 Mogil et al.
D635,828 S 4/2011 Pruchnicki
7,988,006 B2 8/2011 Mogil et al.
8,043,004 B2 10/2011 Mogil
8,061,159 B2 11/2011 Mogil et al.
8,096,442 B2 1/2012 Ramundi
D657,632 S 4/2012 Pruchnicki
8,191,747 B2 6/2012 Pruchnicki
8,209,995 B2 7/2012 Kieling et al.
8,348,510 B2 1/2013 Mogil
8,459,058 B2 6/2013 Mogil
8,640,937 B2 2/2014 Pruchnicki
8,646,970 B2 2/2014 Mogil
8,777,045 B2 7/2014 Mitchell et al.
8,857,654 B2 10/2014 Mogil et al.
8,899,071 B2 12/2014 Mogil et al.
9,408,445 B2 8/2016 Mogil et al.
9,422,099 B2 8/2016 Mitchell et al.
9,809,376 B2 11/2017 Mitchell et al.
9,868,583 B2 1/2018 Mitchell et al.
10,098,427 B2 10/2018 Mogil et al.
10,138,048 B2 11/2018 Mogil et al.
10,287,055 B2 5/2019 Barattin et al.
10,314,377 B2 6/2019 Stephens
2001/0006083 A1 7/2001 Haberkorn
2002/0095946 A1 7/2002 Green
2002/0189278 A1 12/2002 Defelice et al.
2003/0024932 A1 2/2003 McQueen
2003/0101743 A1 6/2003 Defelice et al.
2003/0136702 A1 7/2003 Redzisz et al.
2005/0056048 A1 3/2005 Fuchs
2006/0198562 A1 9/2006 Mogil
2007/0044502 A1 3/2007 Hase
2007/0157653 A1 7/2007 Sasaki et al.
2007/0237432 A1 10/2007 Mogil
2008/0264925 A1 10/2008 Lockhart et al.
2012/0279896 A1* 11/2012 Lantz ..... B65D 81/051 206/584
2014/0140641 A1* 5/2014 Tan ..... B65D 33/06 383/16
2014/0248003 A1 9/2014 Mogil et al.
2015/0008242 A1* 1/2015 Kpabar, Jr. ..... B67D 3/0061 222/183
2017/0280937 A1 10/2017 Mogil et al.
2017/0320653 A1 11/2017 Mogil et al.
2018/0192824 A1 7/2018 Mogil et al.
2018/0237208 A1 8/2018 Kieling et al.
2018/0263346 A1 9/2018 Stephens
2019/0092554 A1* 3/2019 Rogers ..... B65D 25/2826
2019/0170422 A1* 6/2019 Dexter ..... F25D 31/002
2019/0178565 A1* 6/2019 Horton ..... B65D 25/22
2019/0193918 A1* 6/2019 Mitchell ..... B65D 43/16

FOREIGN PATENT DOCUMENTS

AU 2012216548 B2 9/2012
AU 2015203857 B2 7/2015
AU 2017246252 A1 2/2017
AU 2016364860 A1 6/2017
CA 2433251 A1 12/2004
CA 2758565 A1 10/2010
CN 1390097 A 1/2003
CN 201207997 Y 3/2009
DE 29904488 U1 11/1999
EP 1035028 A1 9/2000
EP 1291300 A2 3/2002
EP 1384685 A1 1/2004
EP 2421772 A2 2/2012
EP 3095729 A1 11/2016
JP 1159739 A 3/1999
JP 2000203665 A 7/2000
JP 2002002828 A 1/2002
JP 2002205776 A 7/2002
JP 2006027625 A 2/2006
JP 2006124013 A 5/2006
JP 2008230677 A 10/2008
JP 2012-006614 A 1/2012
KR 200397940 10/2005
KR 200464545 A1 1/2013
KR 10-2018-0096550 8/2019
KR 10-2019-1980595 B1 8/2019
WO 1999032374 7/1999
WO 2001022839 A1 4/2001
WO 2017091899 6/2017
WO WO-2017127860 A1 * 8/2017 ..... F25D 3/08
WO 2017173527 10/2017

OTHER PUBLICATIONS

Third Office Action and Supplemental Search Report, dated Jun. 1, 2017 for related Chinese Patent Application No. 2014102230703, partial English translation, 19 pages.-

(56) References Cited

OTHER PUBLICATIONS

PCT Notification Concerning Transmittal of International Preliminary Report on Patentability and International Preliminary Report on Patentability dated Apr. 15, 2021; 13 pages.
International Search Report and Written Opinion dated Jan. 4, 2011 for PCT/US10/32249, 6 pages.
Communication pursuant to Article 94(3) EPC dated Dec. 8, 2017 for related European Patent Application No. 16173291.2, 4 pages.
Extended European Search Report for related European Patent No. 16173291.2 dated Sep. 30, 2017, 7 pages.
EP Search Report application No. EP03254617 dated Nov. 6, 2003, 2 pages.
Notice of Acceptance dated Jun. 11, 2014, with Description as Accepted and Claims as Accepted for related Australian Patent No. 2010238657, 20 pages.
Notice of Allowance dated Sep. 21, 2015, with allowed claims, for related Canadian Patent No. 2,758,565, 7 pages.
Extended European Search Report for related European Patent No. 10767842.7 dated Oct. 9, 2012, 6 pages.
Office Action dated Jul. 7, 2016 for related Korean Patent Application No. 10-2011-7027993, partial English translation, 15 pages.
Notice of Acceptance dated Oct. 28, 2016 for related Australian Patent No. 2014233619, 25 pages.

* cited by examiner

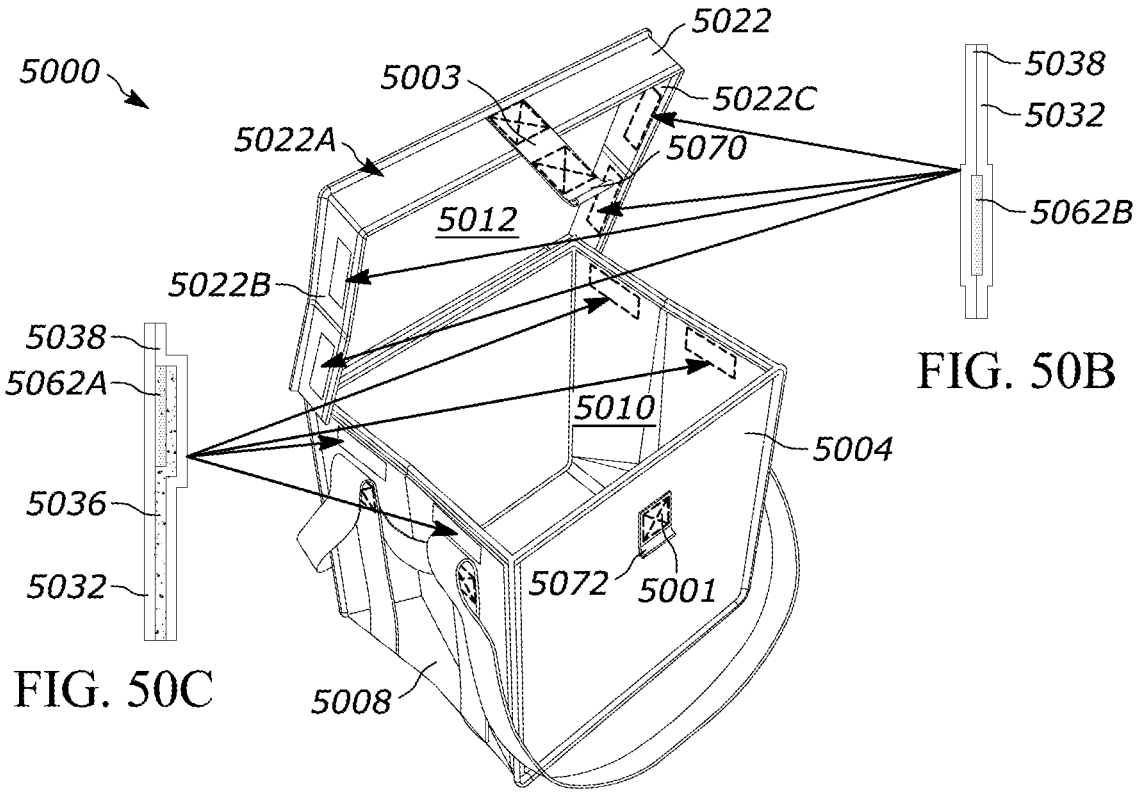
FIG. 50B
FIG. 50C
FIG. 50A
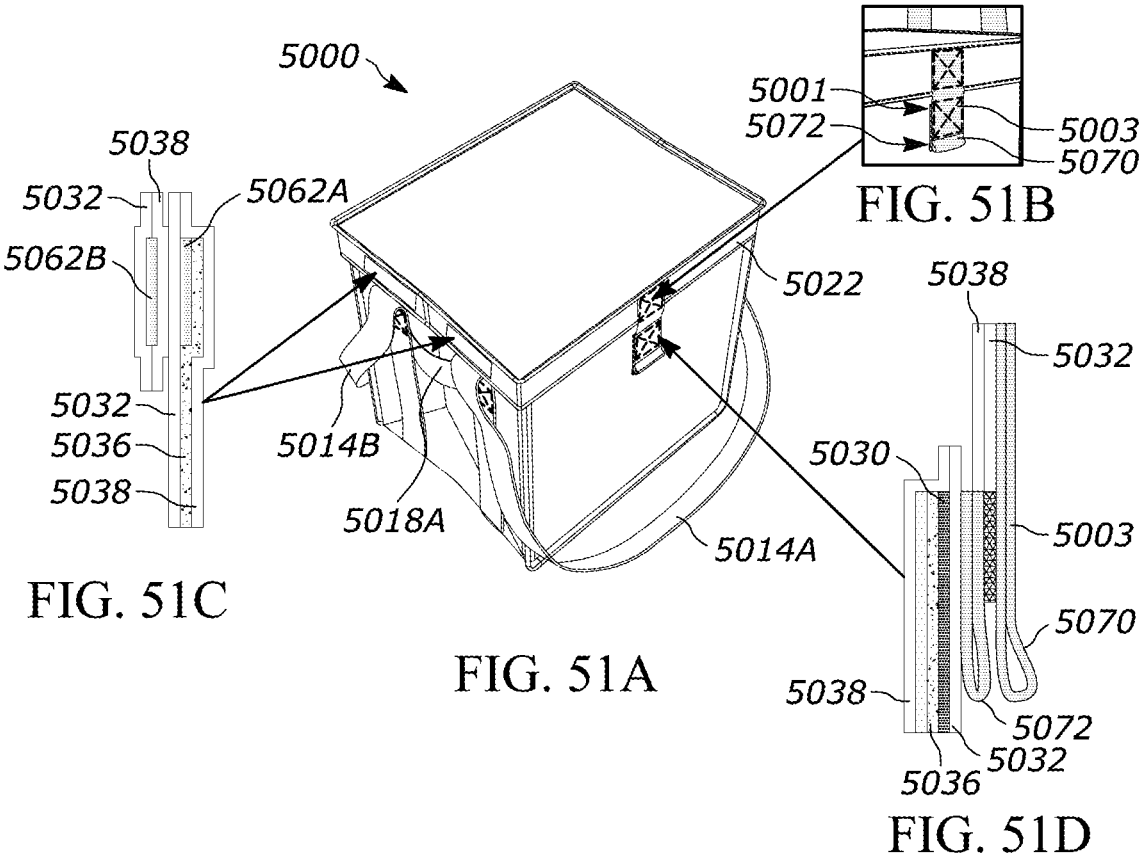
FIG. 51B
FIG. 51C
FIG. 51A
FIG. 51D 5032
5036
5038

5032
5036
5034
5038

5038
5032
5024A
5032
5036
5038
5032
5036
5034
5038

5038
5036
5032
5034
5030

5032
5038
5036

5036
5032
5036
5034
5038

5032
5038
5032
5036
5038
5036
5032
5036
5034
5038

5038
5036
5032
5034
5030

5040
5040
5040

5032
5038
5036

5036
5032
5030
5036
5038
5034

5032
5038
5024A
5032
5036
5038
5036
5032
5030
5036
5034
5038

5038
5036
5032
5034
5030

5040

5040
5040

5040

5040
5040

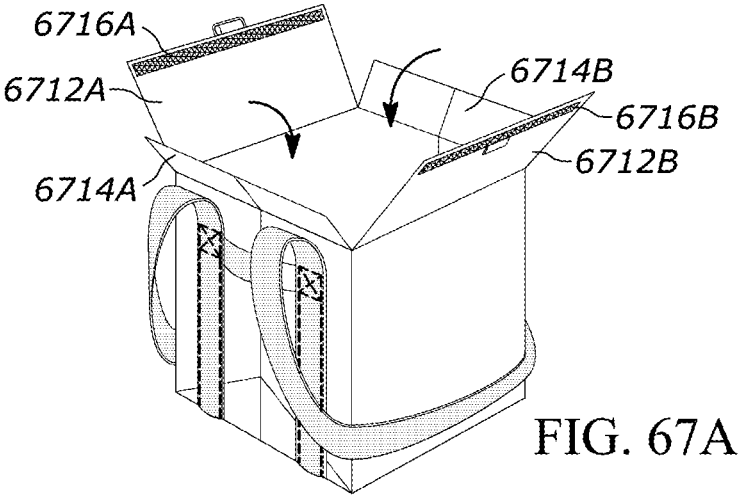
FIG. 67A
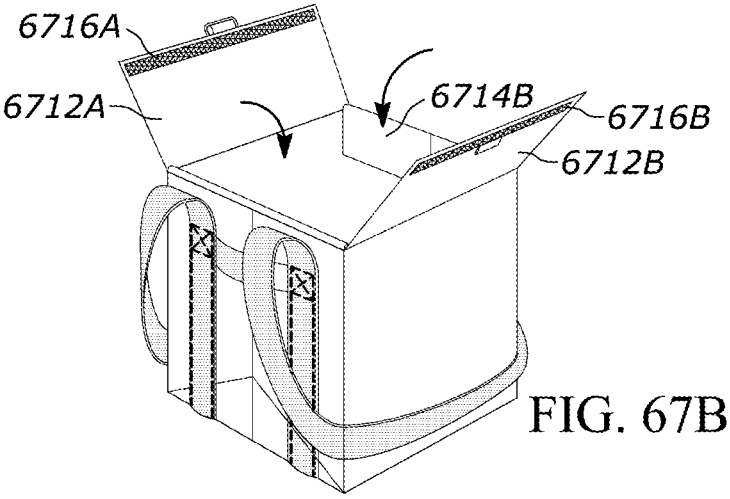
FIG. 67B
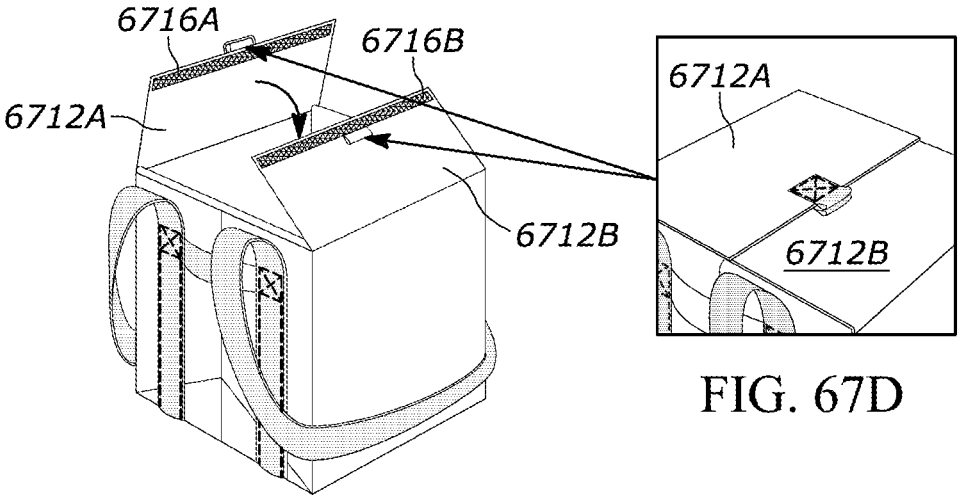
FIG. 67D
FIG. 67C

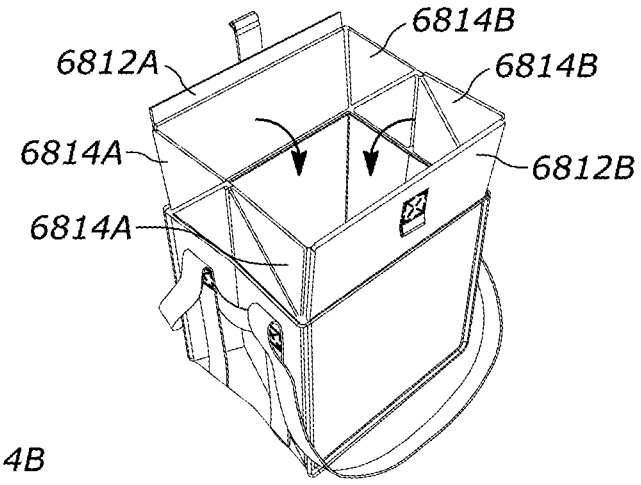
FIG. 68A
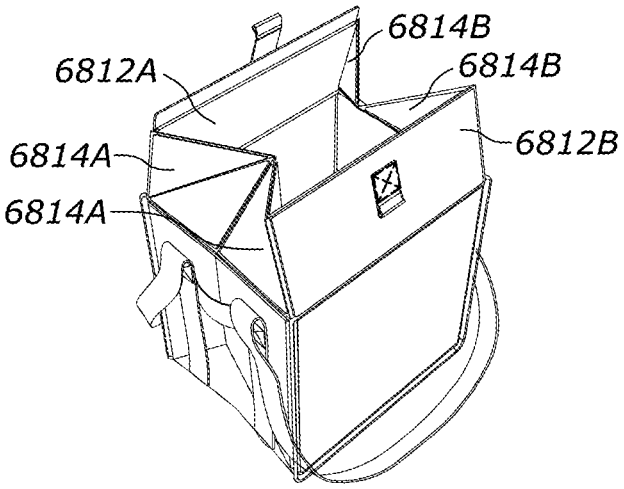
FIG. 68B
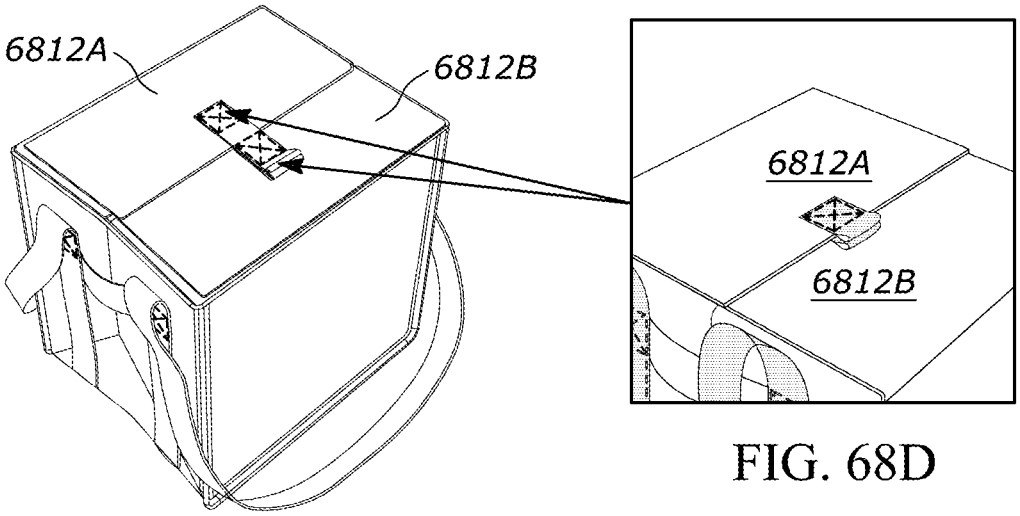
FIG. 68D
FIG. 68C

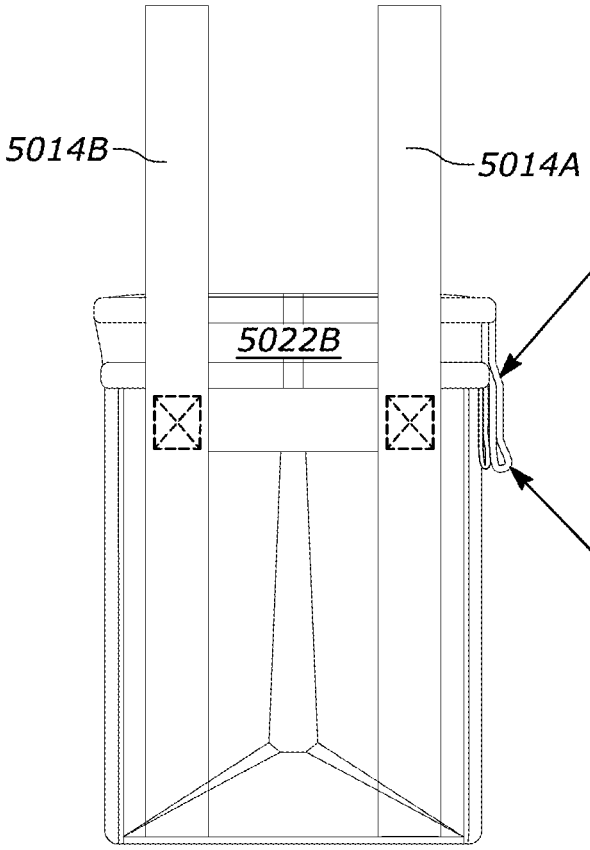
FIG. 69A
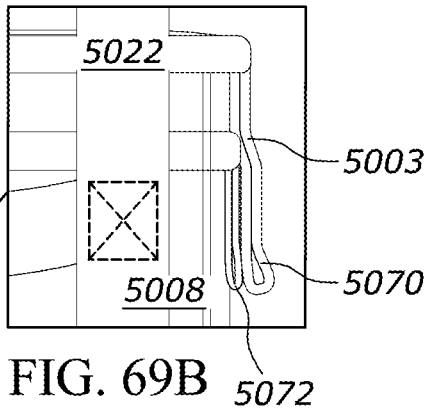
FIG. 69B
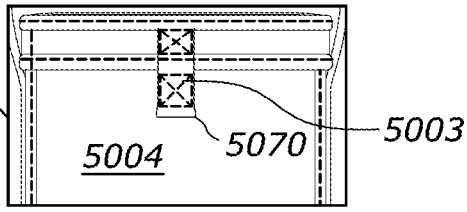
FIG. 69C
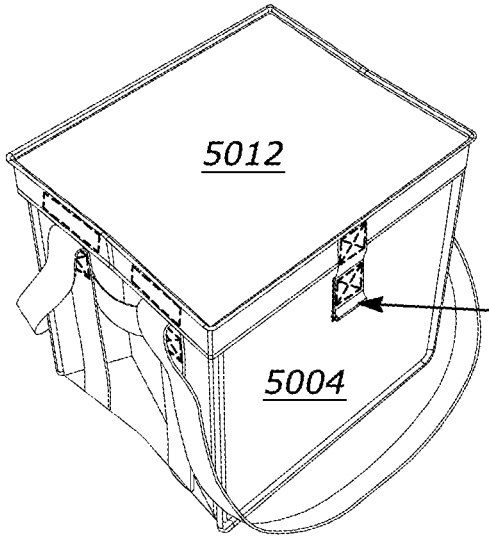
FIG. 70A
FIG. 70B
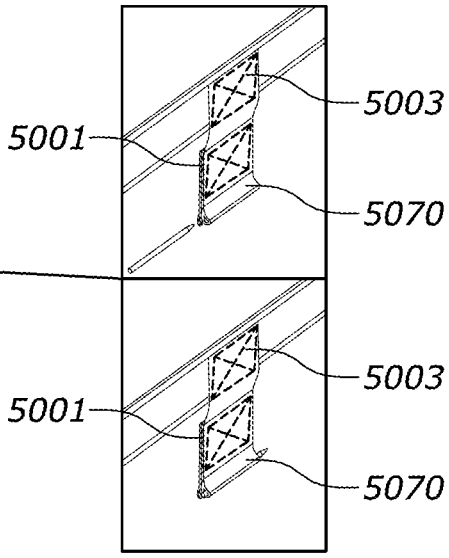
FIG. 70C

INSULATED CARRIER FOR TEMPERATURE-CONTROLLED ITEMS

CROSS-REFERENCE TO RELATED APPLICATIONS

This application claims the benefit of and priority from U.S. Provisional Application Ser. No. 62/741,206, filed on Oct. 4, 2018, and U.S. Provisional Application Ser. No. 62/844,211, filed on May 7, 2019.

FIELD OF THE INVENTION

The present invention generally relates to devices and methods for transporting items, and it more specifically relates to insulated carriers for use in delivering temperature-controlled items such as perishable food.

BACKGROUND

Multipurpose containers and coverings are commonly used for packing, storing, transporting, and insulating items, particularly those such as food, beverages, and other items that need to be kept warm or cool for a significant period of time during storage or transport. Existing products suffer from a number of drawbacks. First, such products generally are large and bulky, featuring rigid walls. These types of containers are difficult to store or transport while not in use, and they may be difficult to carry or move while loaded with items. Second, existing products often rely on cooling media that are not suitable for use for longer periods of time while transporting or storing items, particularly within the delivery context. By way of example, larger picnic-style coolers with rigid walls are generally filled with ice, which melts and can make the contents of coolers wet. This renders the coolers unsuitable for use with certain types of items, such as food. The ice is also bulky and takes up a significant amount of space in the cooler in order to provide adequate cooling. Alternatively, some containers place a cooling media (such as gel packs) in the lining of the container walls. However, such existing containers are typically bulky and take up a relatively large amount of space in a freezer when cooling. Other containers are known which contain gel material in the walls for cooling or heating purposes, but these are also bulky and difficult to fold into a compact condition, and they may be difficult to heat. The problems caused by these containers are compounded when the containers are scaled to a larger size. For example, in the context of delivery, where there is a need for containers of various sizes and an efficient means of storage and transport, containers that are large enough to accommodate larger loads are particularly bulky and difficult to store and transport.

SUMMARY

A need exists for improved containers for storing and transporting items, particularly those that must be maintained in a temperature-controlled environment. The devices and related methods described in the present disclosure address the drawbacks of existing designs.

Embodiments disclosed in the present application provide such improved containers that may be collapsed so as to allow for the efficient storage and transport of the container while empty. In particular, the disclosed embodiments provide containers that may be stored in a freezer or other temperature-controlled environment without taking up significant space.

In an embodiment, a collapsible container comprises: a base panel with one or more horizontal creases; a front wall extending from the base panel; a rear wall extending from the base panel opposite the front wall; a pair of opposing side walls extending from the base panel between the front wall and the rear wall, each of the pair of opposing side walls comprising a vertical crease that is orthogonal to the base panel; wherein the base panel, the front wall, the rear wall, and the pair of opposite side walls define a cavity therebetween; wherein the container is configured to fold into a collapsed configuration by folding the base panel and each of the side walls into the cavity along the one or more horizontal creases and the pair of vertical creases; and wherein the base panel, the front wall, the rear wall, and the pair of opposing side walls each comprise an interior layer proximate the cavity, an exterior layer, and a layer of insulation therebetween.

An embodiment provides a method of collapsing a container comprising a base panel with one or more horizontal creases and a peripheral wall comprising a pair of opposing side walls; each with one or more vertical creases, the peripheral wall extending from the base panel to form a cavity, the method comprising the steps of: folding the base panel into the cavity along the one or more horizontal creases; and folding the pair of opposing side walls into the cavity along the one or more vertical creases.

BRIEF DESCRIPTION OF THE DRAWINGS

Certain embodiments are shown in the drawings. However, it is understood that the present disclosure is not limited to the arrangements and instrumentality shown in the attached drawings.

FIG. 50*a* is a perspective view of an eighth embodiment of a delivery container.

FIG. 50*b* is a cross-sectional view of the flap shown in FIG. 50*a*.

FIG. 50*c* is a cross-sectional view of the side walls shown in FIG. 50*a*.

FIG. 51*a* is a perspective view of the container of FIG. 50*a* with the lid closed.

FIG. 51*b* is an enlarged view of the pair of loops of FIG. 51*a*.

FIG. 51*c* is a cross-sectional view of the side walls and flap of FIG. 51*a*.

FIG. 51*d* is a cross-sectional view of the front wall of FIG. 51*a*.

FIG. 65*a* is a perspective view of an alternative embodiment of the container of FIG. 50*a*.

FIG. 65*b* is a cross-sectional view of the lid of FIG. 65*a*.

FIG. 65*c* is a cross-sectional view of the flap of FIG. 65*a*.

FIG. 65*d* is a cross-sectional view of the rear wall of FIG. 65*a*.

FIG. 65*e* is a cross-sectional view of the side walls of FIG. 65*a*.

FIG. 65*f* is a cross-sectional view of the front wall of FIG. 65*a*.

FIG. 66*f* is a cross-sectional view of the front wall of FIG. 66*a*.

FIG. 67*a* is a perspective view of an alternative embodiment of the container of FIG. 50*a*.

FIG. 67*b* is a perspective view of the container of FIG. 67*a* with the side flaps completely folded.

FIG. 67*c* is a perspective view of the container of FIG. 67*a* with the lid partially closed.

FIG. 67*d* is a perspective view of the completely closed lid of the container of FIG. 67*a*.

FIG. 68*a* is a perspective view of an alternative embodiment of the container of FIG. 50*a*.

FIG. 68*b* is a perspective view of the container of FIG. 67*a* with the lid partially closed.

FIG. 68*c* is a perspective view of the container of FIG. 67*a* with the lid completely closed.

FIG. 68*d* is a perspective view of the completely closed lid of the container of FIG. 68*a*.

FIG. 69*a* is a side view of the container of FIG. 50*a*.

FIG. 69*b* is a side view of the secured clasp of the container of FIG. 69*a*.

FIG. 69*c* is a front view of the secured clasp of the container of FIG. 69*a*.

FIG. 70*a* is a perspective view of the container of FIG. 50*a*.

FIG. 70*b* is a perspective view of the unsecured clasp of the container of FIG. 70*a*.

FIG. 70*c* is a perspective view of the secured clasp of the container of FIG. 70*a*.

Figure 71:
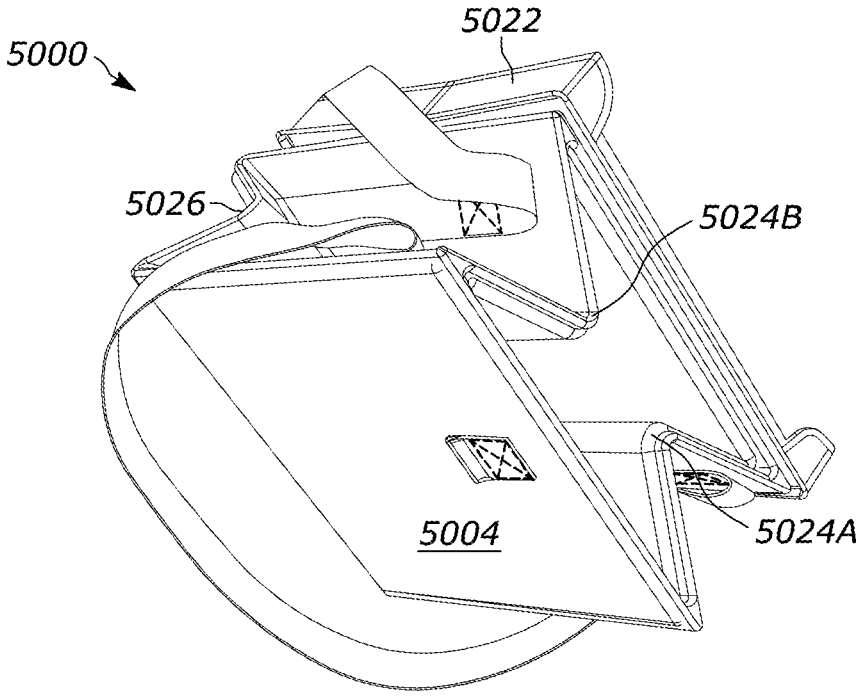

FIG. 71 is a perspective view of the container of FIG. 50*a* with the container partially folded.

Figure 72:
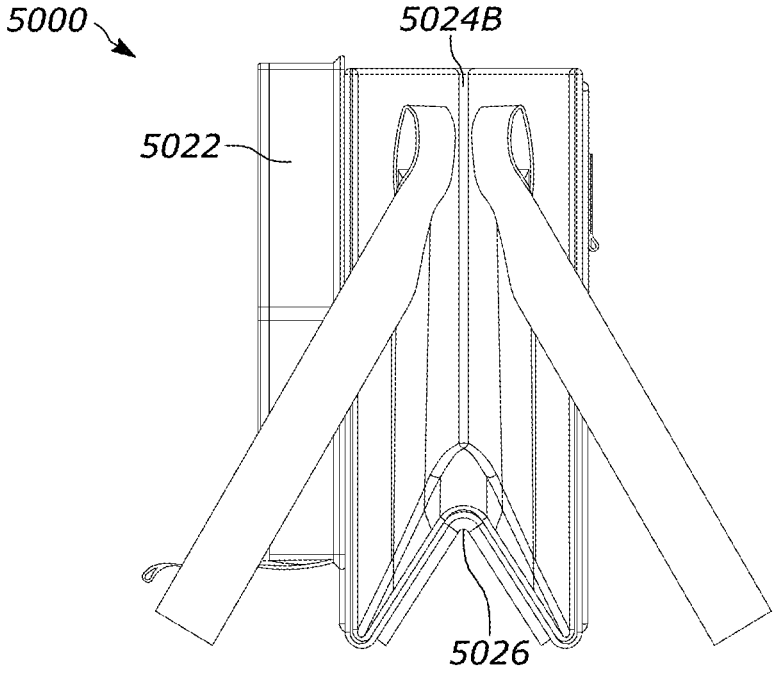

FIG. 72 is a side view of the container of FIG. 50*a* with the container partially folded.

DETAILED DESCRIPTION

For the purposes of promoting and understanding the principles disclosed herein, reference is now made to the preferred embodiments illustrated in the drawings, and specific language is used to describe the same. It is nevertheless understood that no limitation of the scope of the invention is hereby intended. Such alterations and further modifications in the illustrated devices and such further applications of the principles disclosed and illustrated herein are contemplated as would normally occur to one of skill in the art to which this disclosure relates.

Insulated Delivery Container

FIGS. 1 through 10 illustrate a first embodiment of an insulated delivery container 100. In the depicted embodiment, the container 100 generally comprises a rectangular structure having a base panel 102, a front wall 104, a rear wall 106, opposite side walls 108, 110, and a lid 112, which together define a cavity which receives items to be transported or stored in the container 100 (such as, but not limited to, articles of food, beverages, and the like). In other embodiments (not shown), the container 100 may take other shapes. By way of example and not of limitation, in other embodiments, the container 100 may have a greater or lesser number of walls (e.g., being cylindrical in shape and having only a single side wall, or being polyhedral and having additional walls).

As shown, the lid 112 is attached to the rear wall 106 such that the lid 112 may be folded away from the side walls 108, 110 and the front wall 104 to permit access to the cavity within the container. In alternative embodiments, the lid 112 may be attached to a different one of the walls 104, 106, 108, 110 or may be removably attached to multiple of the walls 104, 106, 108, 110.

Figure 48:
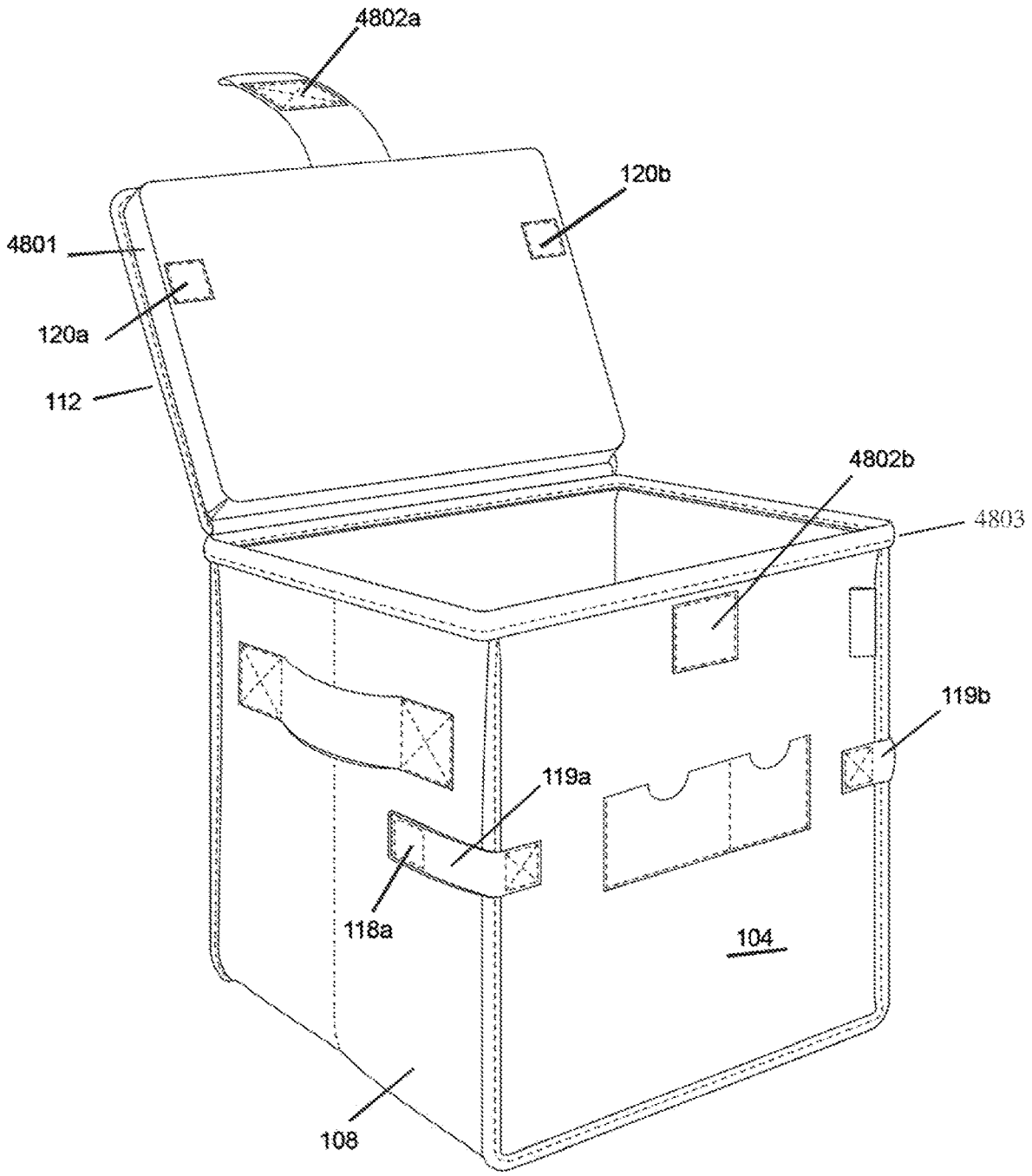
FIG. 48 is a perspective view of an alternative embodiment of the container of FIG. 1.
Figure 49:
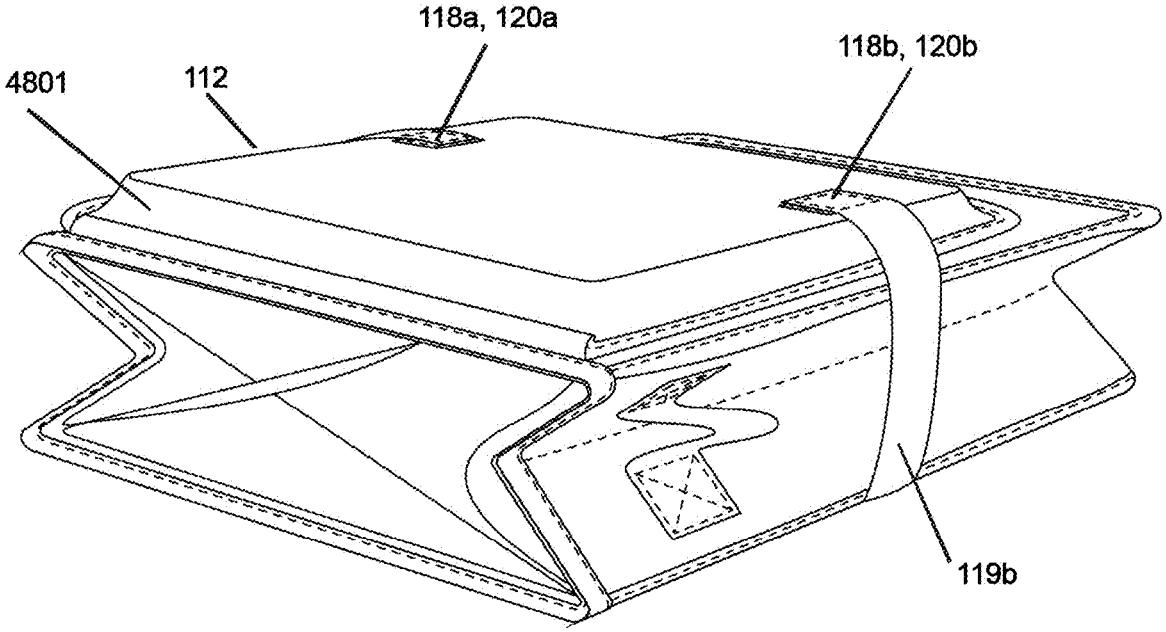
FIG. 49 is a perspective view of the interior of the container of FIG. 48 with the container completely folded.

As shown in FIGS. 48 and 49, in an alternative embodiment, the lid 112 comprises a thicker, inner portion 4801 that extends from the underside of the lid 112 and a thinner, outer portion 4803 such that the thicker, inner portion 4801 extends into the cavity of the container 100 when the lid 112 is in the closed position and the thinner, outer portion 4803 rests proximate to the walls 104, 106, 108, 110 such that the lid 112 does not fall into the cavity of the container 100.

Figure 37:
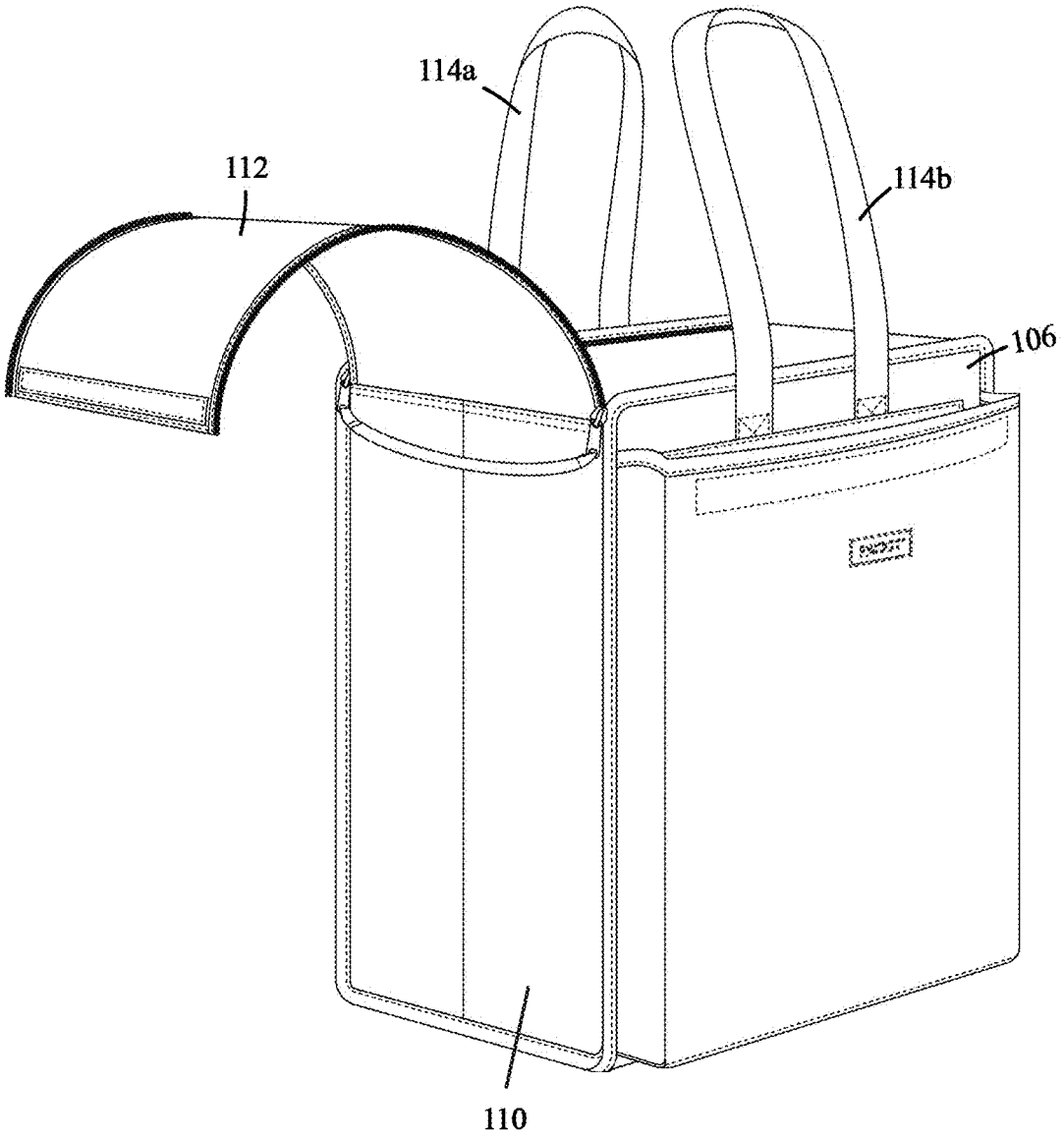
FIG. 37 is a perspective view of an alternative embodiment of the container of FIG. 1.

As shown in FIG. 37, in an alternative embodiment, the lid 112 is attached to one of the side walls 110, removably attached to the front wall 104 and the rear wall 106 by attachment mechanisms such as zippers or the like, and removably attached to the opposing side wall 108 by a fastener such as a hook-and-loop fastener or the like so as to allow the lid to be folded away from the opposing side wall 108, the front wall 104 and the rear wall 106 to permit access to the cavity within the container 100.

In an embodiment, a flap 122 extends from the lid 112 towards the base panel 102 such that the flap 122 overlaps the portion of the side walls 108, 110 and the front wall 104 proximate the lid 112. In an embodiment, as shown in FIG. 48, a fastener 4802*a*, 4802*b* such as a hook-and-loop fastener, a pair of clips, or the like may be used to removably attach the lid 112 to one or more of the walls 104, 108, 110 so as to prevent the lid 112 from being inadvertently lifted while the container 100 is in use (e.g., while the container 100 is being used to store or transport items).

As shown in FIGS. 6 through 9, in embodiments the container 100 is collapsible to permit the container 100 to be easily transported or stored while empty. As shown, vertical creases 124*a*, 124*b* extend along the side walls 108, 110 from proximate the base panel 102 to proximate the front wall 104 to facilitate folding of the side walls 108, 110 when the container 100 is collapsed. The base panel 102 also includes one or more creases 126 to facilitate folding the base panel 102. To collapse the container 100, the base panel 102 folds into the container 100 along the creases 126 while the side walls 108, 110 fold into the container 100 along creases 124*a*, 124*b* such that the front wall 104 moves towards the rear wall 106. The container 100 is secured in the collapsed configuration by using clips 120*a*, 120*b*, 118*a*, 118*b*. A pair of clips 120*a*, 120*b* are attached to the lid 112 via straps 121*a*, 121*b* over the side walls 108, 110, with complementary clips 118*a*, 118*b* connected to the front wall 104 by straps 119*a*, 119*b*. Once the container 100 is collapsed, clip 120*a* attaches to complementary clip 118*a*, and clip 120*b* attaches to complementary clip 118*b*. In an embodiment, the distance between the complementary clips 118*a*, 118*b* can be adjusted by sliding the clips 118*a*, 118*b* along the straps 119*a*, 119*b*, allowing for the container 100 to be secured in a collapsed state while varying the distance between the front wall 104 and the rear wall 106. Other attachment means are contemplated, such as hook-and-loop fasteners, or other such attachment means, as shown in FIGS. 48 and 49. In an embodiment, the lid 112 may be secured to the rear wall 106 by using an attachment means (not shown) such as a hook-and-loop fastener, a pair of corresponding clips, or other such attachment means connected to the lid 112 and the rear wall 106.

A pair of handles 114*a*, 114*b* are attached to the front wall 104 and the rear wall 106, respectively. In use, the handles 114*a*, 114*b* extend above the lid 112 of the container 100 and may be used to carry the container 100. In an alternative embodiment, hand grips are attached to the opposing side walls 108, 110 and may be used to carry the container 100. In alternative embodiments, a hand grip 116 is also attached to the front wall 104 of the container 100 for carrying the container 100 in a collapsed configuration.

Figure 10:
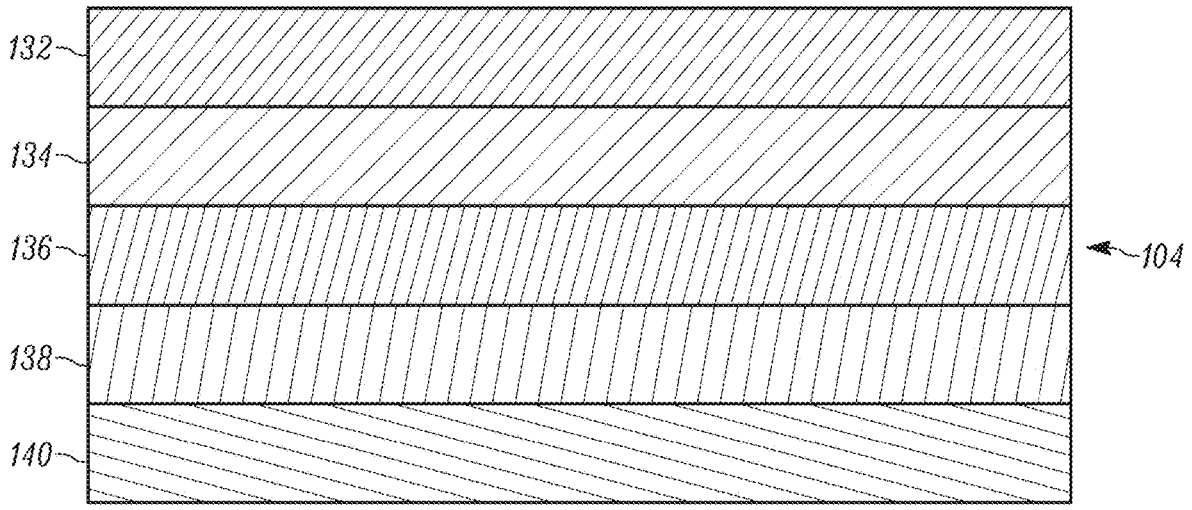
FIG. 10 is an expanded view showing the internal structure of the walls of the container of FIG. 1.
Figure 11:
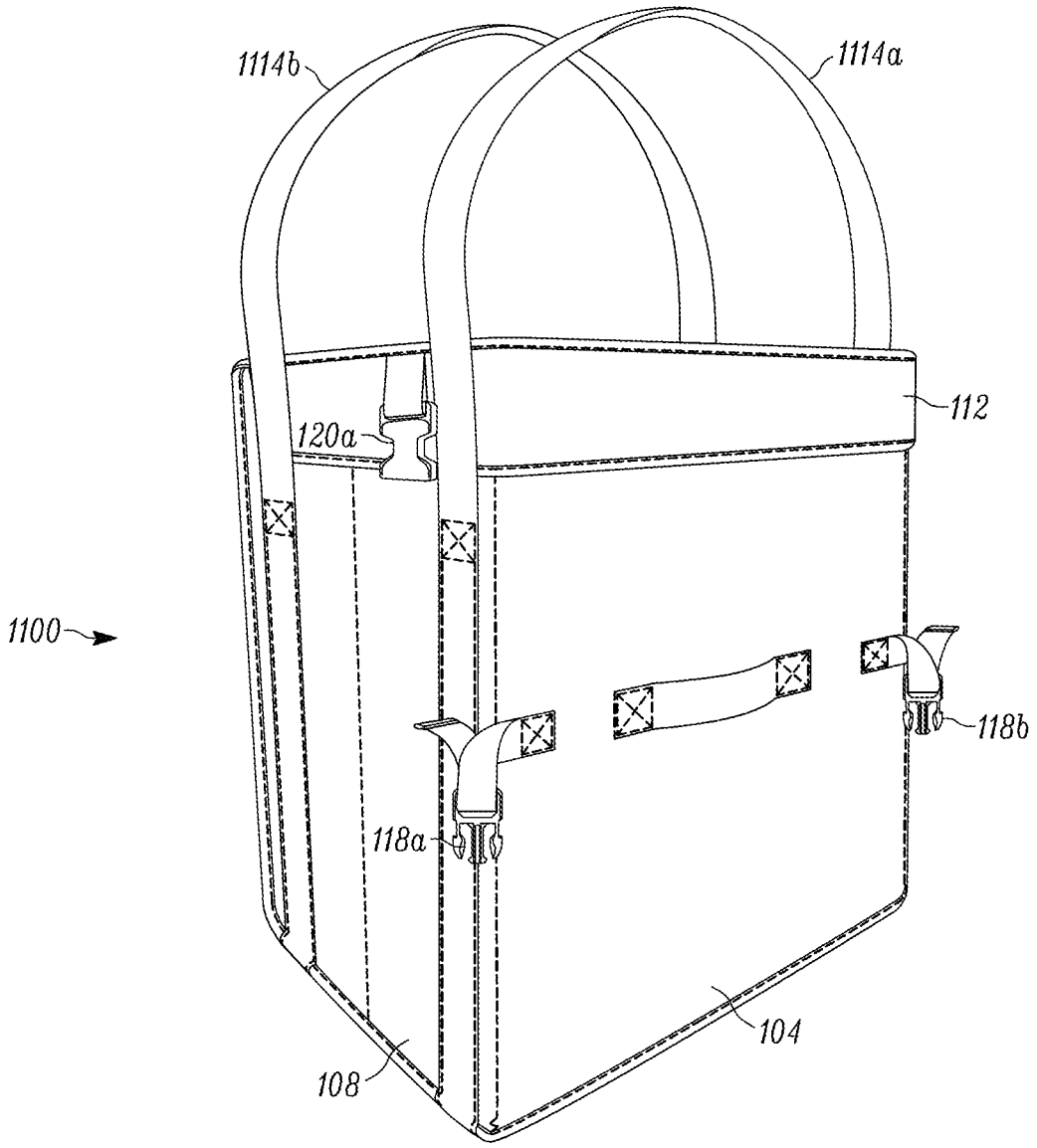
FIG. 11 is a perspective view of a second embodiment of a delivery container containing an insert.
Figure 12:
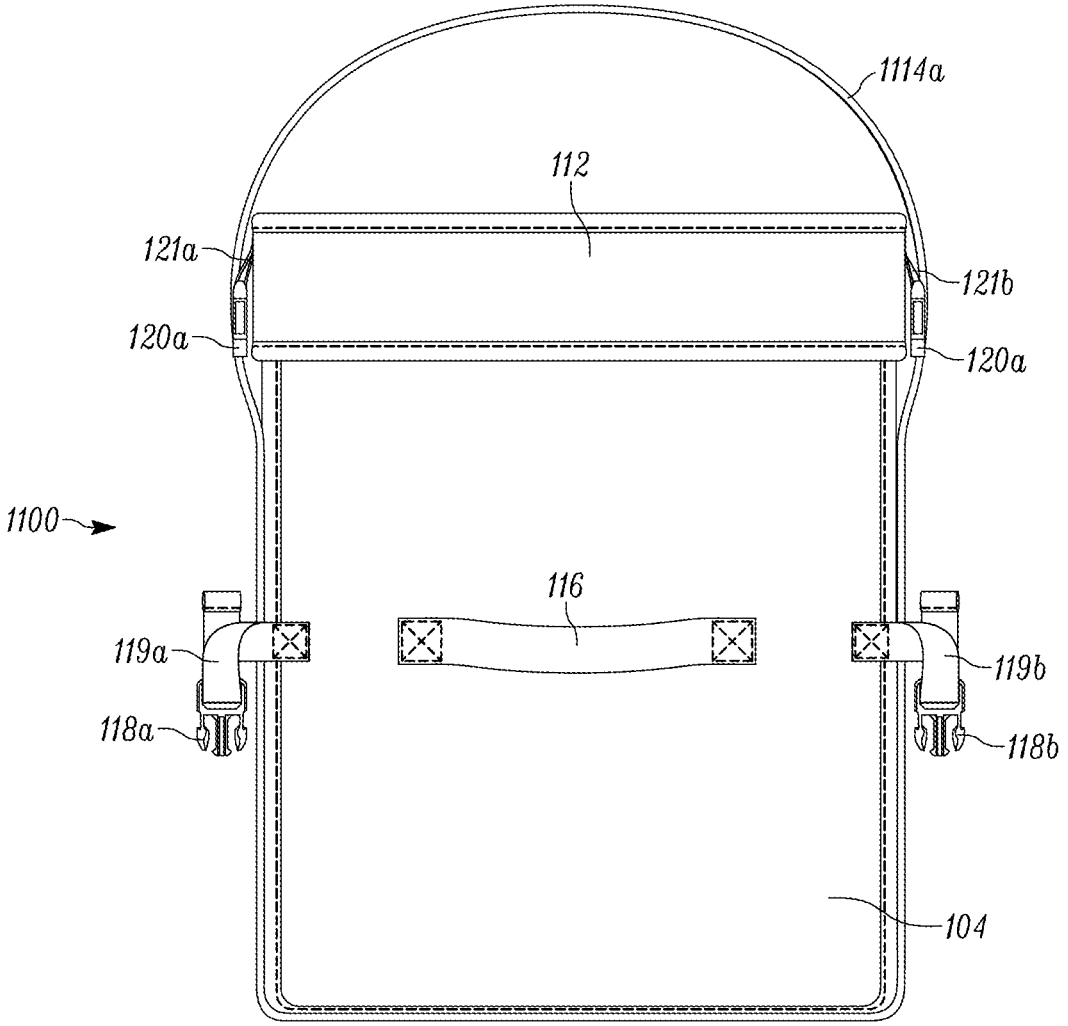
FIG. 12 is a front view of the container of FIG. 11.
Figure 13:
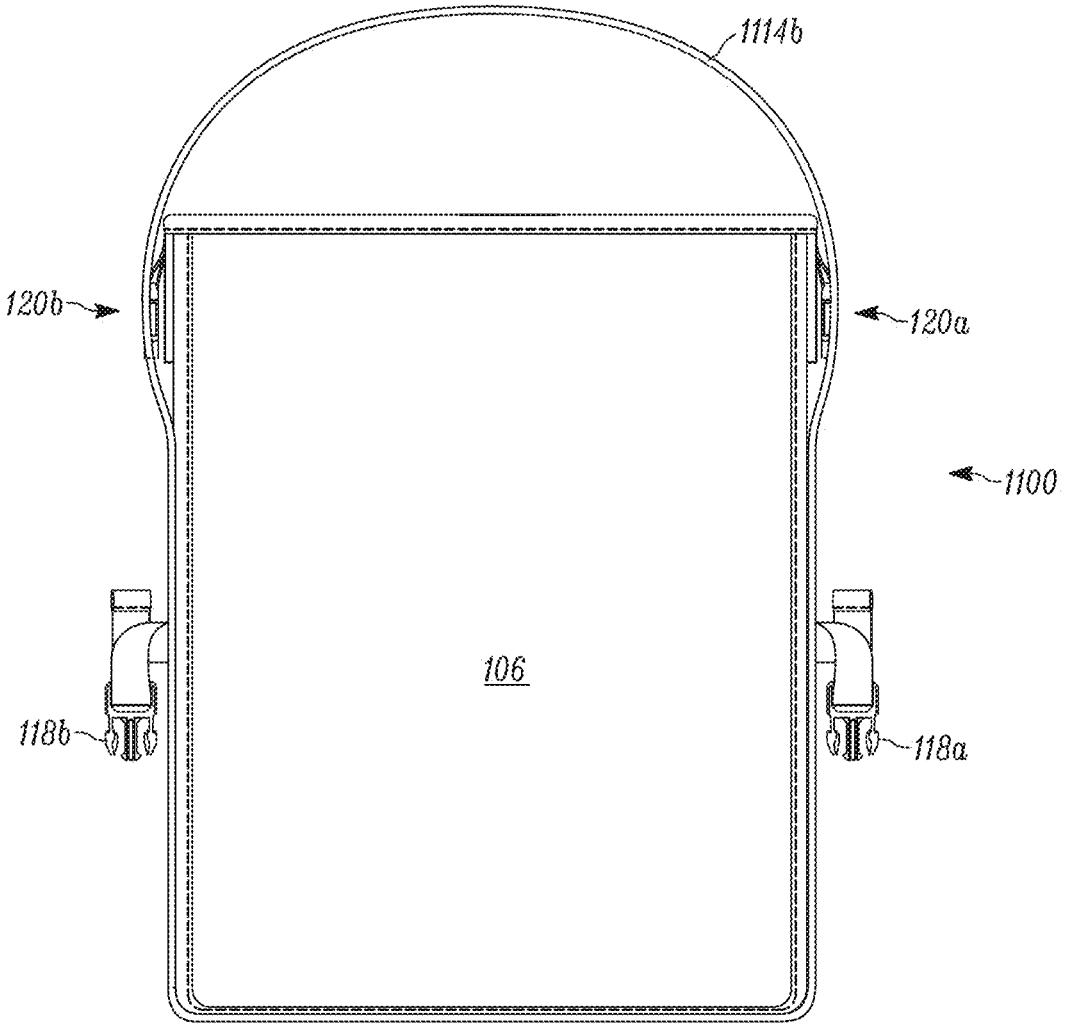
FIG. 13 is a rear view of the container of FIG. 11.
Figure 14:
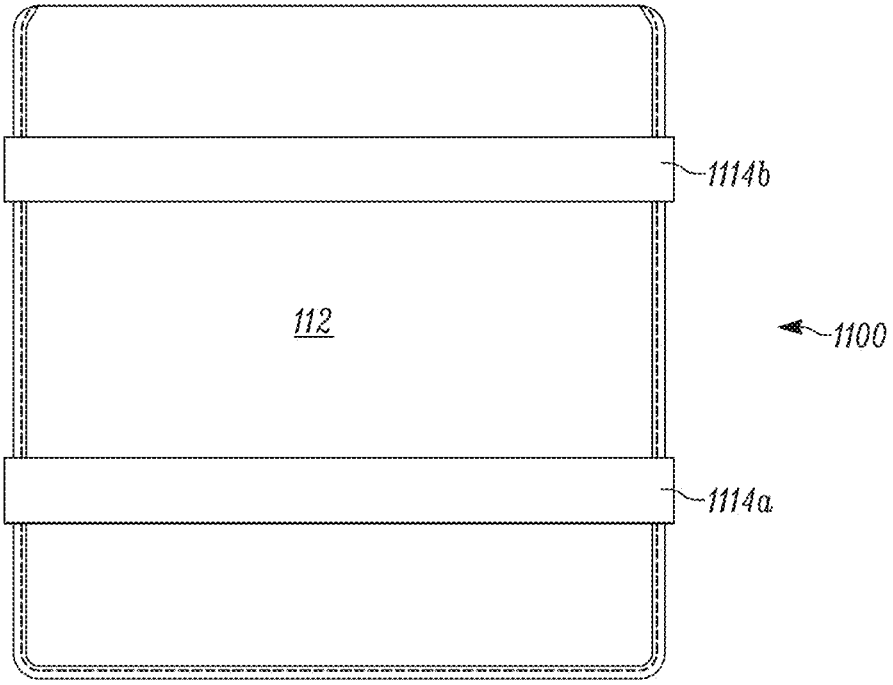
FIG. 14 is a top view of the container of FIG. 11 without the insert.
Figure 15:
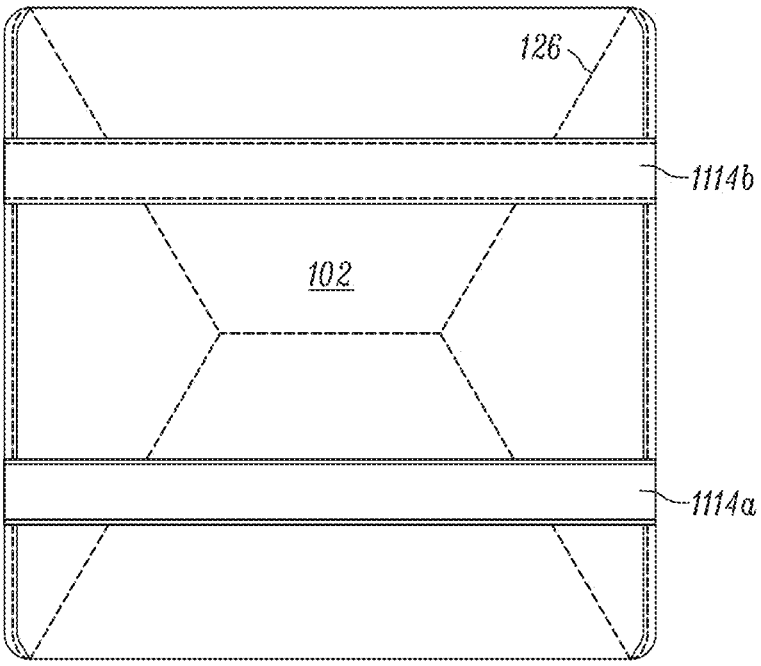
FIG. 15 is a bottom view of the container of FIG. 11.
Figure 16:
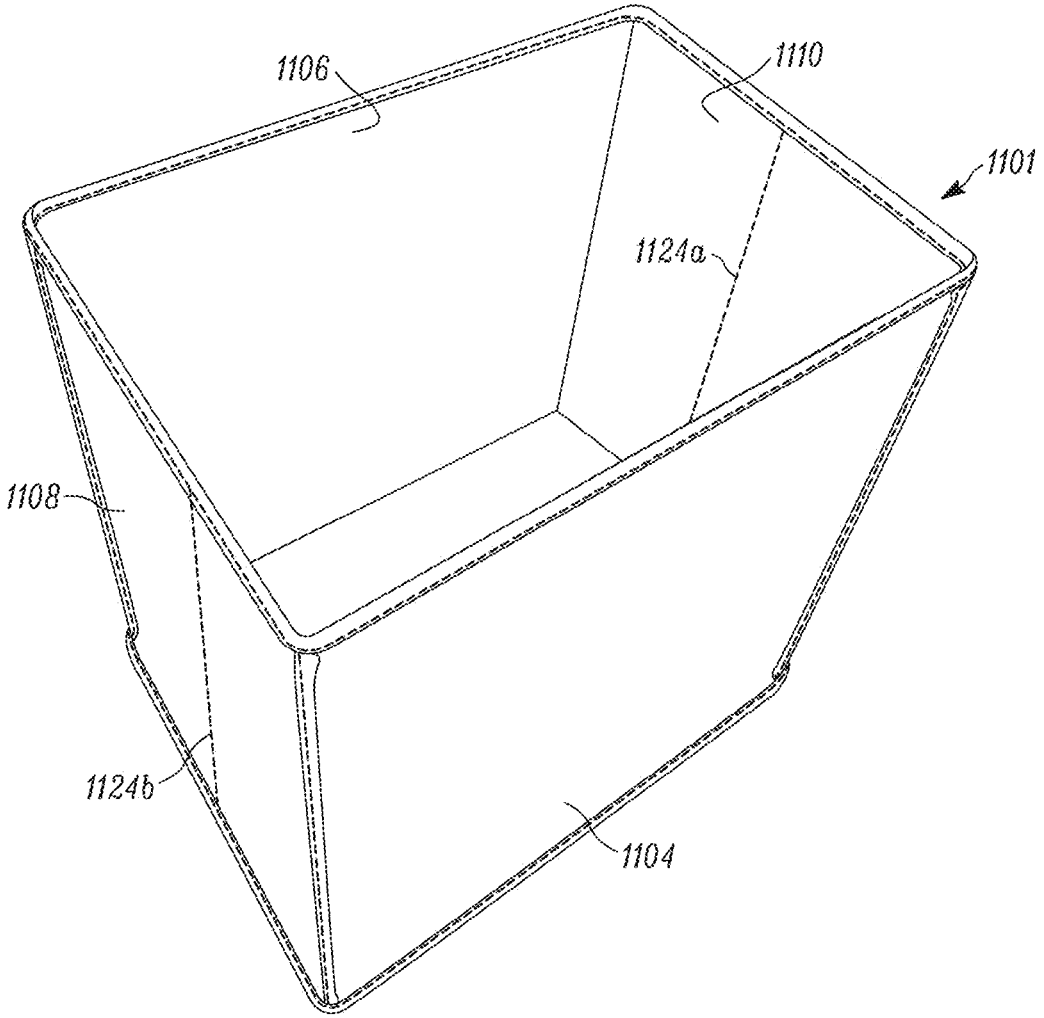
FIG. 16 is a top perspective view of the insert of FIG. 11 without the container.
Figure 17:
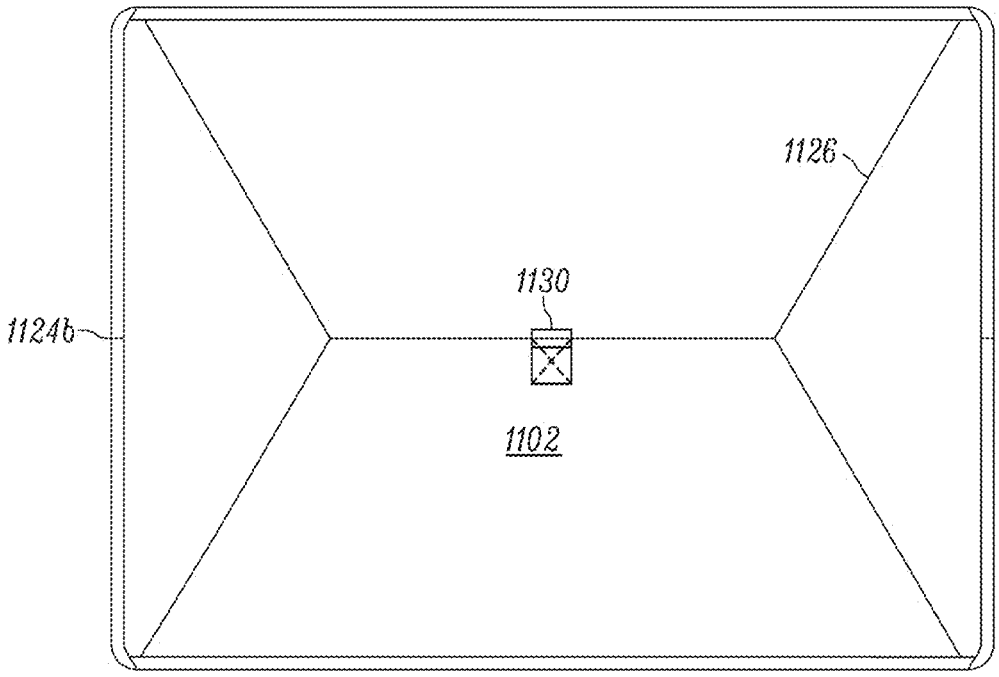
FIG. 17 is a top view of the insert of FIG. 16.
Figure 18:
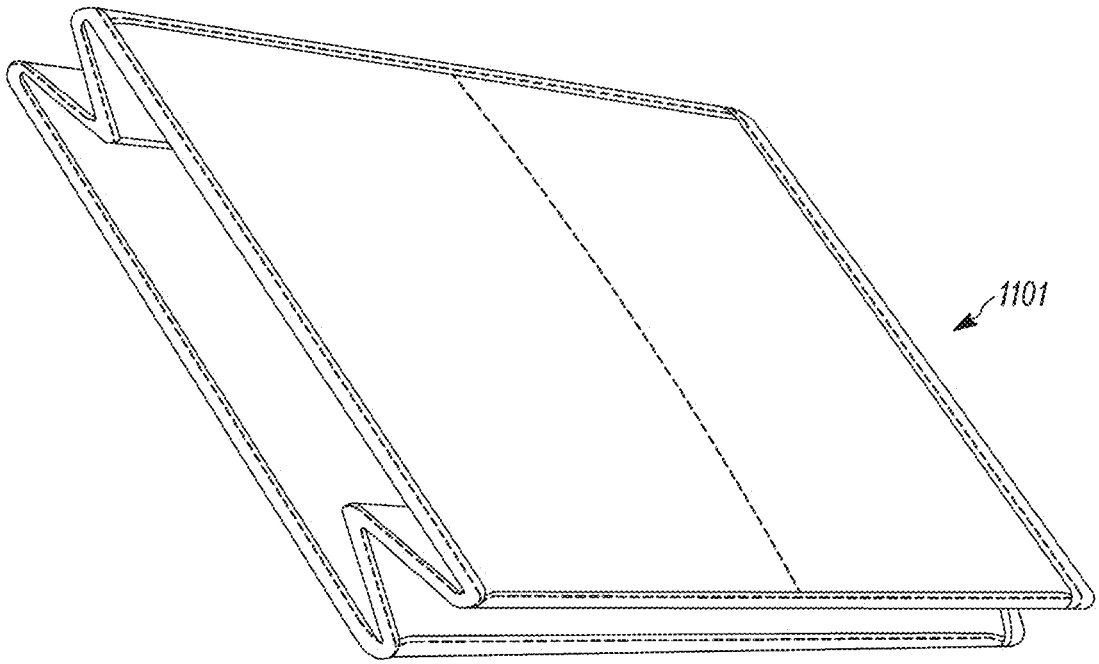
FIG. 18 is a perspective view of the insert of FIG. 16 with the insert folded.

In an embodiment, the container 100 is insulated so as to maintain the temperature of the items stored or transported within the container 100. FIG. 10 depicts a cross-sectional illustration of the front wall 104 (not shown to scale). In an embodiment, the same five layers comprise the front wall 104, the rear wall 106, and the side walls 108, 110. The exterior layer 132 comprises a protective, relatively strong and durable synthetic or natural material such as a fabric, canvas, nylon, coated polyester, or the like. In an embodiment, the exterior layer 132 includes an aluminizing material or coating to better reflect and disperse radiation (such as heat) away from the container 100. The inner middle layer 138 comprises a waterproof material, such as polyethylene vinyl acetate (PEVA), or a plastic foil material. The outer middle layer 134 comprises a rigid or semirigid material, such as polyethylene (PE) board or PE-coated paperboard, to provide support for the container 100. The middle layer 136 comprises insulation, such as cotton insulation, an insulating foam, or a high-density polyethylene (HDPE) foam. In an embodiment, the middle layer 136 of the walls 104, 106, 108, 110 comprises a layer of insulation that is 2 centimeters thick. The inner middle layer 138 comprises a material for maintaining the temperature of the cavity of the container 100 and any items located therein (e.g., by either cooling or heating). In an embodiment, the middle layer 136 comprises a gel pack comprising an outer wrapper or envelope of flexible or pliable material such as plastic film which is filled with and surrounds an insulating, nontoxic gel material, which may be any such material known to those of skill in the art, such as silica gel. The amount of fill of the gel material is such that the gel pack is substantially flattened in shape. As will be clear to one of skill in the art from the present disclosure, in alternative embodiments, the structure of the walls 104, 106, 108, 110 may be varied to either include additional layers (such as by including additional layers of insulation) or omit layers (such as by omitting the outer middle layer 134 to provide a soft-sided container).

As shown, the exterior layer 132, the outer middle layer 134, the inner middle layer 138, and the interior layer 140 of adjacent wall panels are connected together, for example by side seams or lines of stitching 142 at the intersections of the side walls 108, 110 with the front wall 104, the base panel 102, and the rear wall 106. In an embodiment, the front wall 104, the side walls 108, 110, and the rear wall 106 comprise a single continuous length of multiple layered wall panel material with one or more discrete gel packs forming the inner middle layer 138 in each wall. Multiple discrete gel packs may be used for the inner middle layer 138. A single gel pack is located in each of the front wall 104 and the rear wall 106, with each gel pack extending substantially between the side walls 108, 110. A pair of gel packs are located in each of the side walls 108, 110, such that one gel pack is located in each side wall 108, 110 in the area between the front wall 104 and the crease 124*a*, 124*b*, and a second gel pack is located in each side wall 108, 110 in the area between the rear wall 106 and the crease 124*a*, 124*b*. The crease 124*a*, 124*b* is formed by side seams or lines of stitching extending through the exterior layer 132, the outer middle layer 134, the inner middle layer 138, and the interior layer 140 such that the separation between the gel packs in the side walls 108, 110 is maintained. In alternative embodiments, other structures of gel packs may be used. By way of example, a plurality of discrete gel packs may be located in each wall 104, 106, 108, 110, such as by using a grid of spaced-apart gel packs. Alternatively, each layer may stretch continuously around the container 100 (i.e., inner middle layer 138 may be formed from a single continuous gel pack).

In an embodiment, the base panel 102 and the lid 112 have substantially the same layered structure as the other walls, and each includes at least one gel pack in the inner middle layer 138. In an embodiment, the base panel 102 contains a plurality of discrete gel packs separated by the crease 126. In an alternative embodiment, the base panel 102 and/or the lid 112 omit the inner middle layer 138 and do not contain any gel packs. In other alternative embodiments, the base panel 102 also omits the outer middle layer 134 to better allow the base panel 102 to fold inward when the container 100 is folded.

Figure 1:
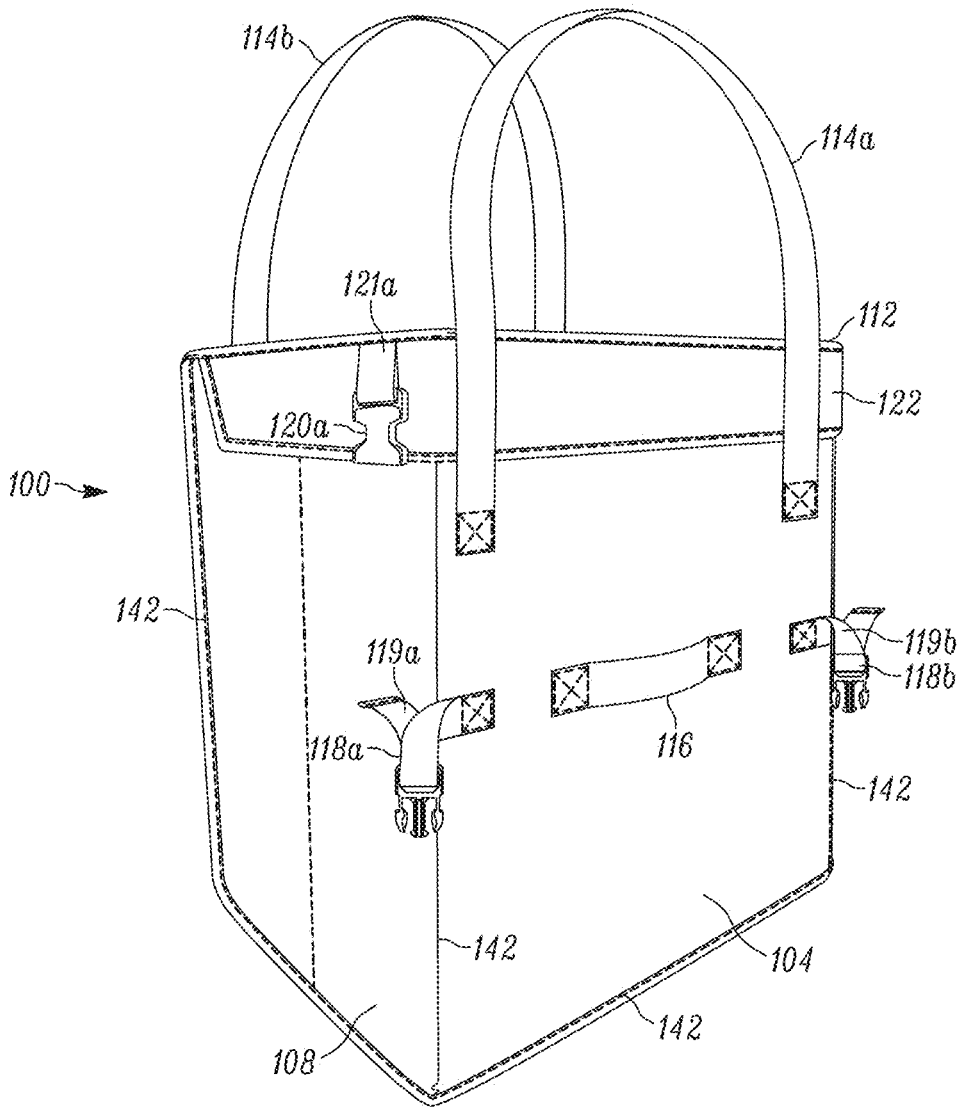
FIG. 1 is a perspective view of a first embodiment of a delivery container.
Figure 2:
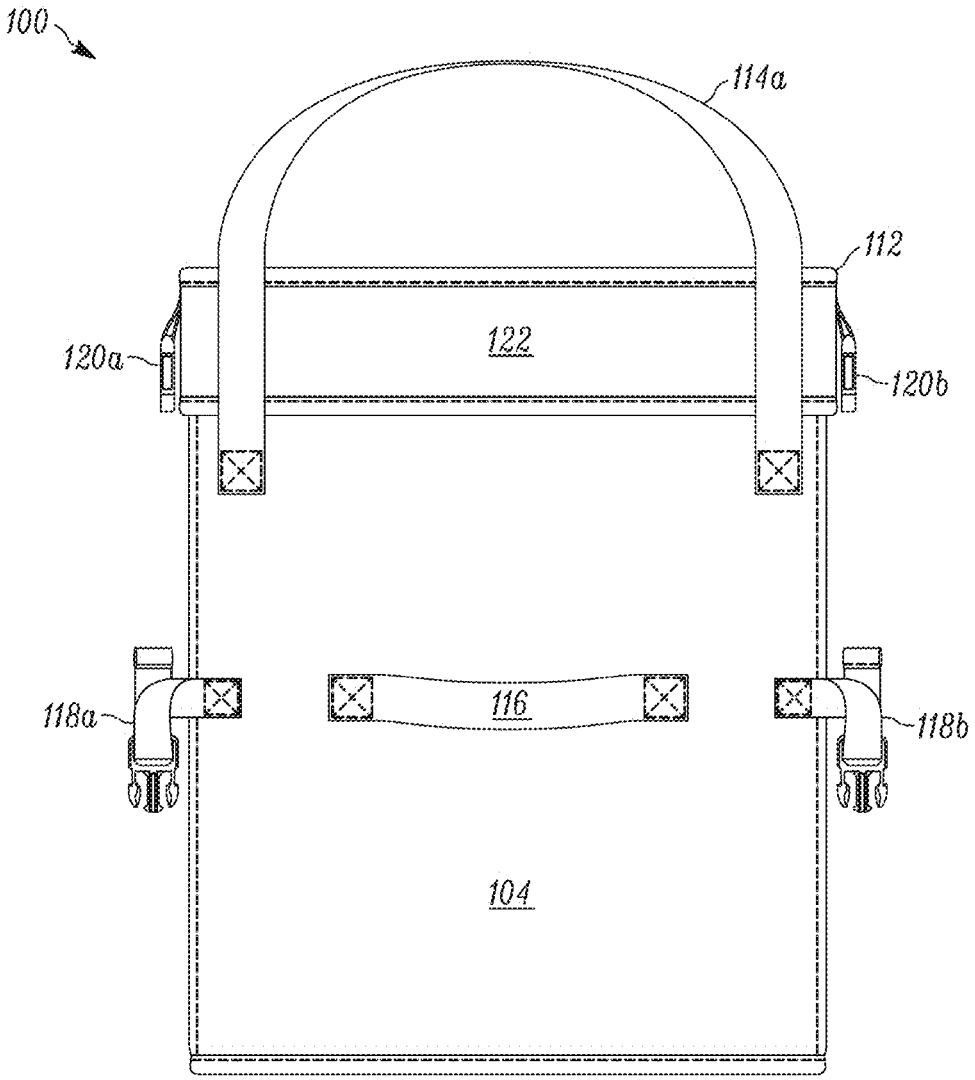
FIG. 2 is a front view of the container of FIG. 1.
Figure 3:
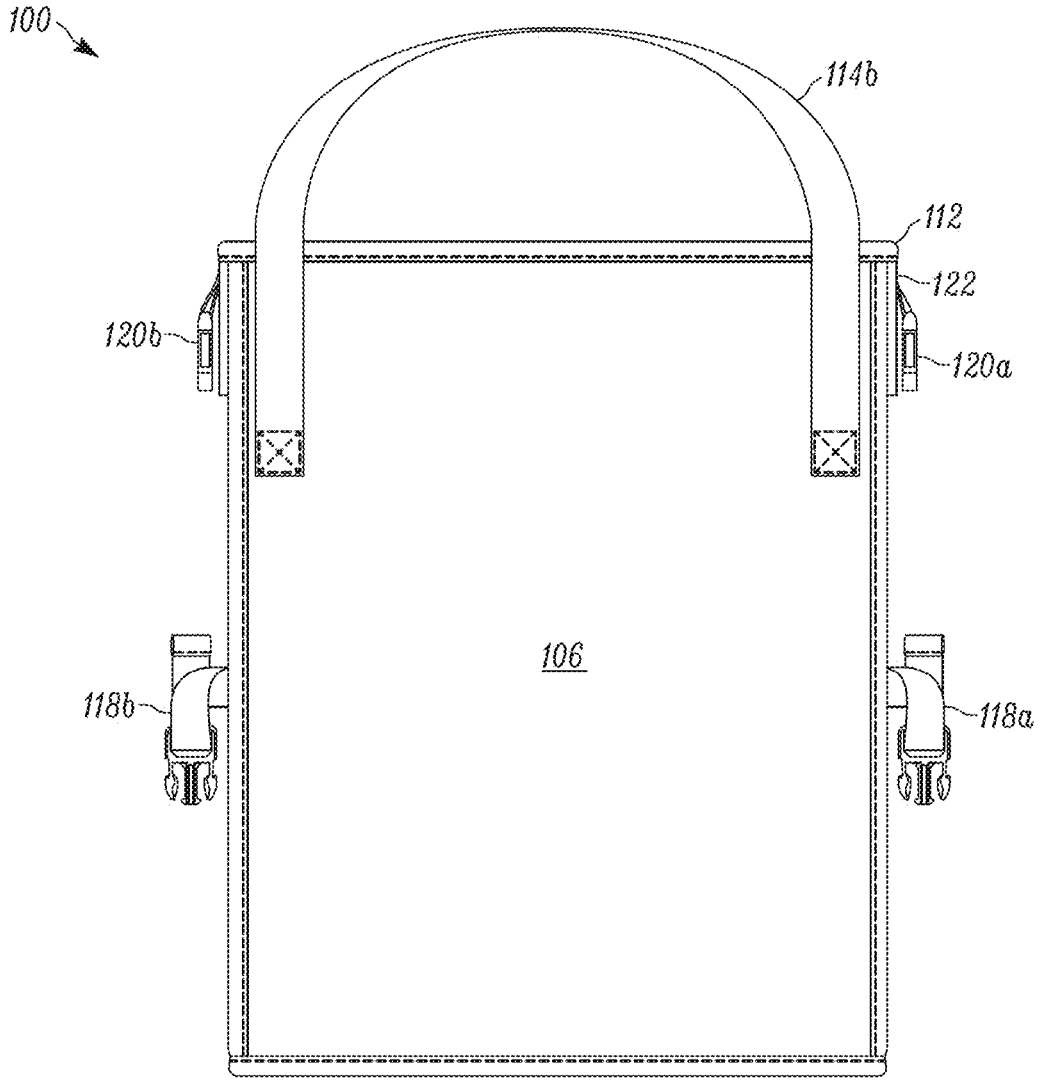
FIG. 3 is a rear view of the container of FIG. 1.
Figure 4:
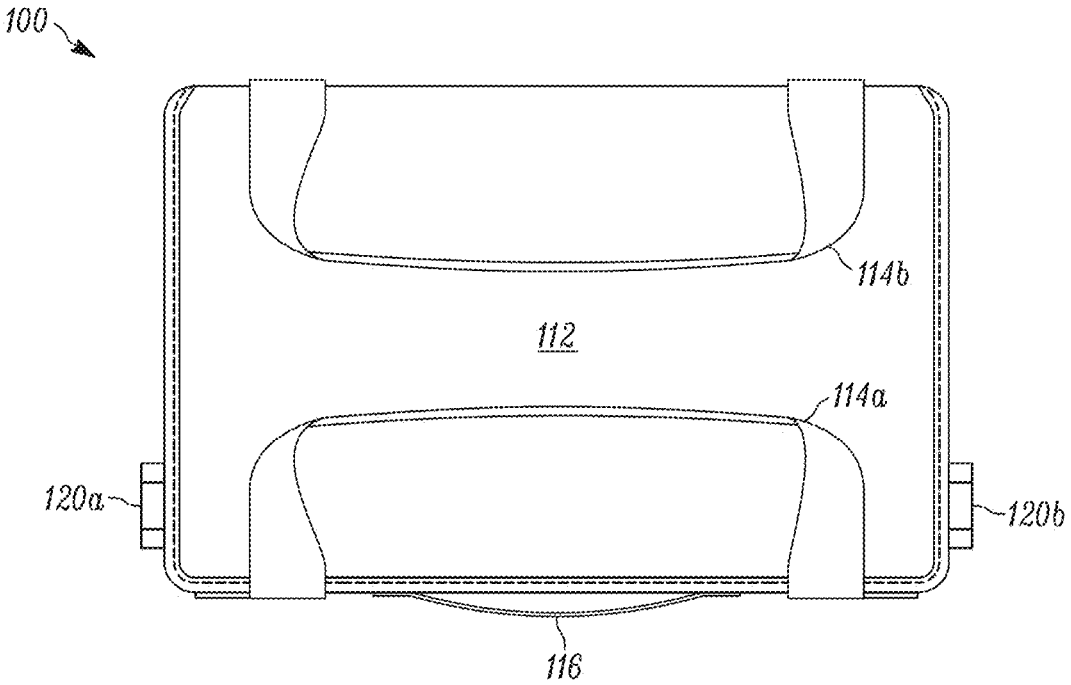
FIG. 4 is a top view of the container of FIG. 1.
Figure 5:
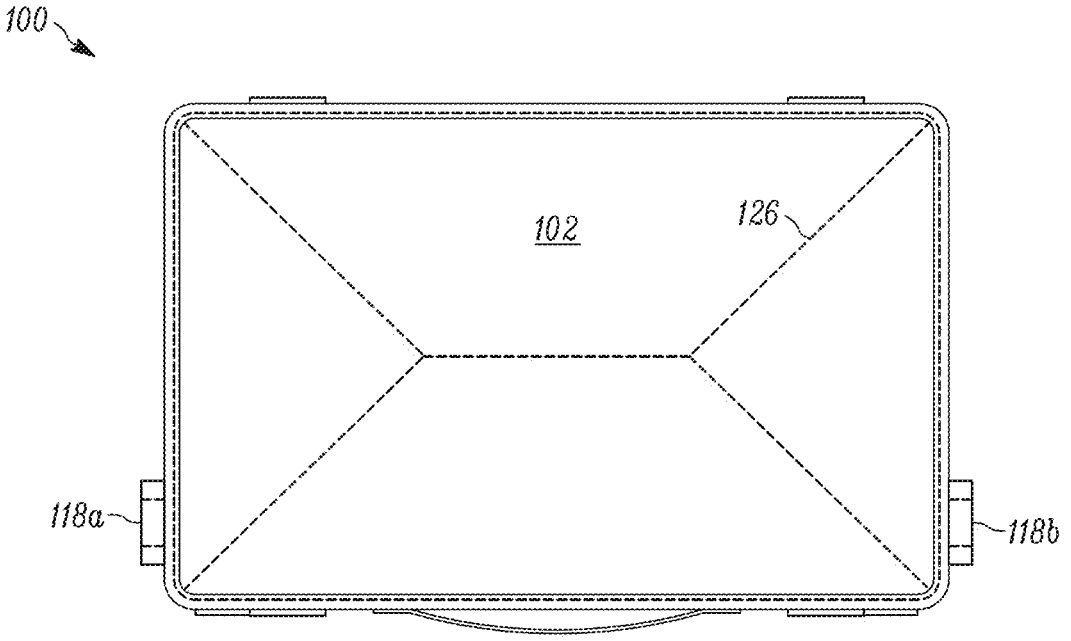
FIG. 5 is a bottom view of the container of FIG. 1.
Figure 6:
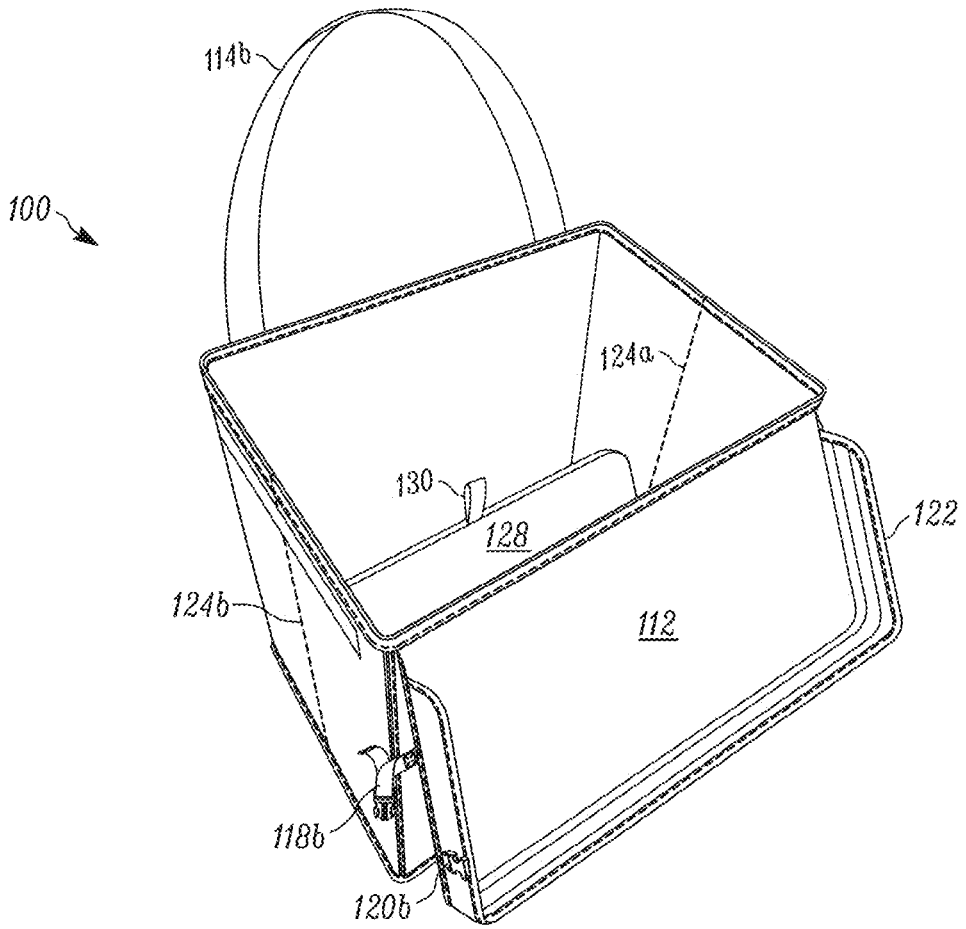
FIG. 6 is a top perspective view of the container of FIG. 1 with the interior flap partially raised.
Figure 7:
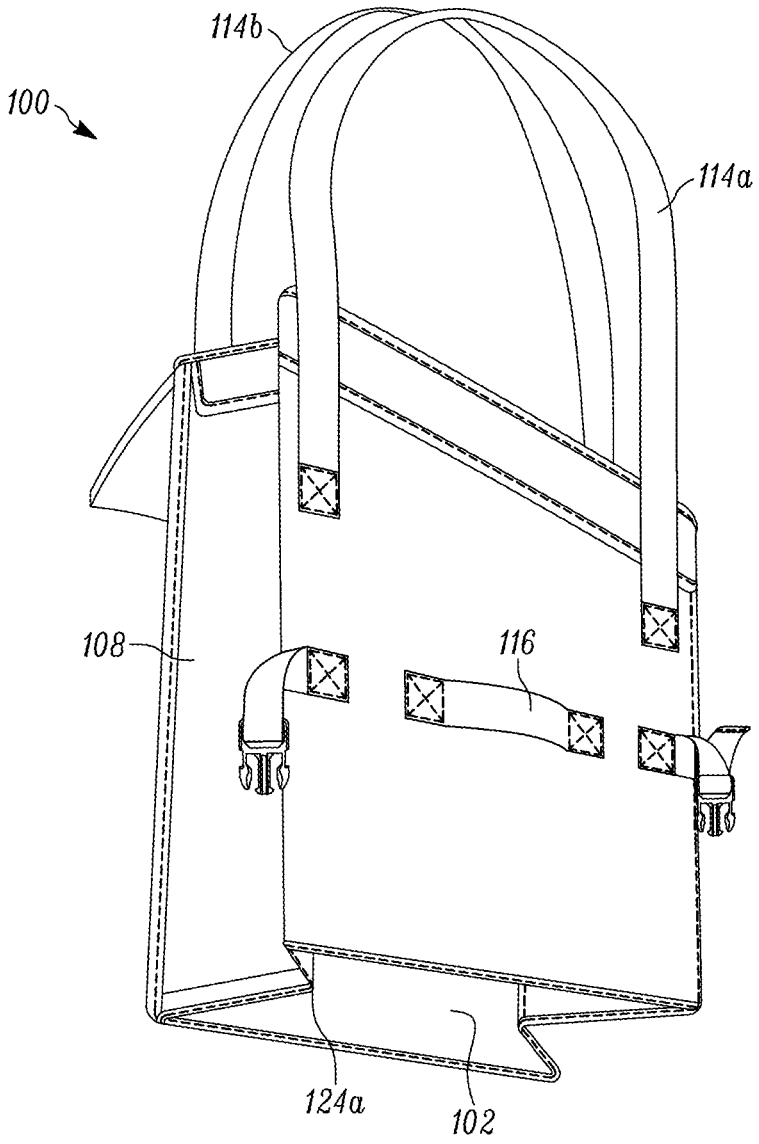
FIG. 7 is a bottom perspective view of the container of FIG. 1 with the container partially folded.
Figure 8:
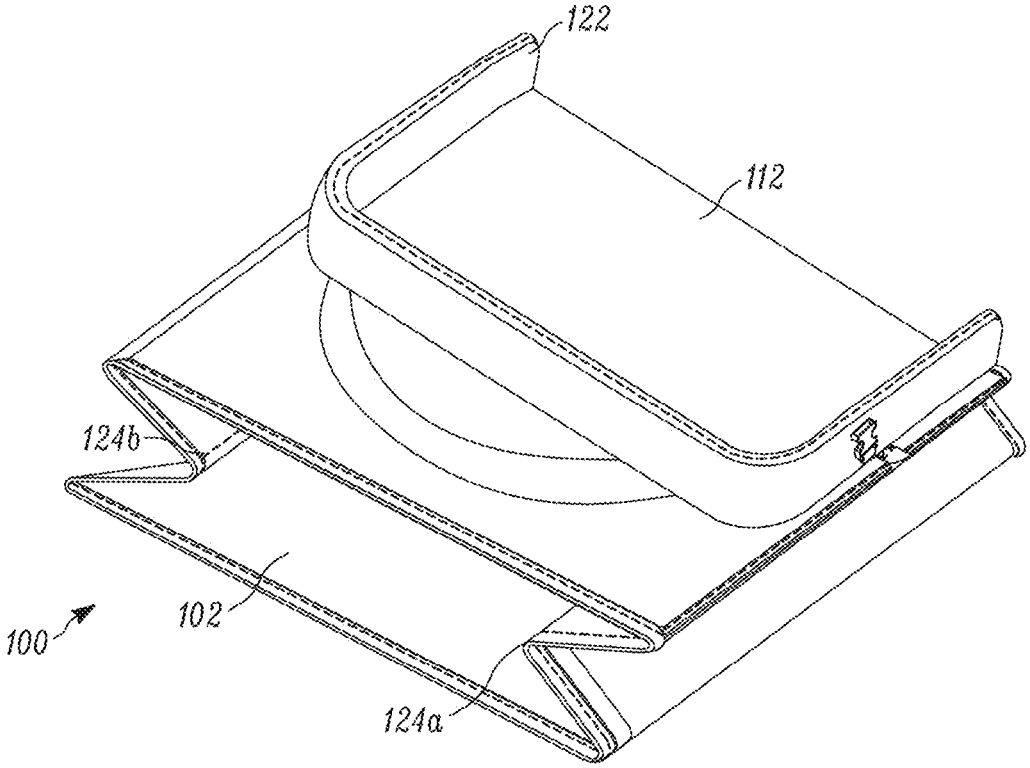
FIG. 8 is a perspective view of the interior of the container of FIG. 1 with the container completely folded.
Figure 9:
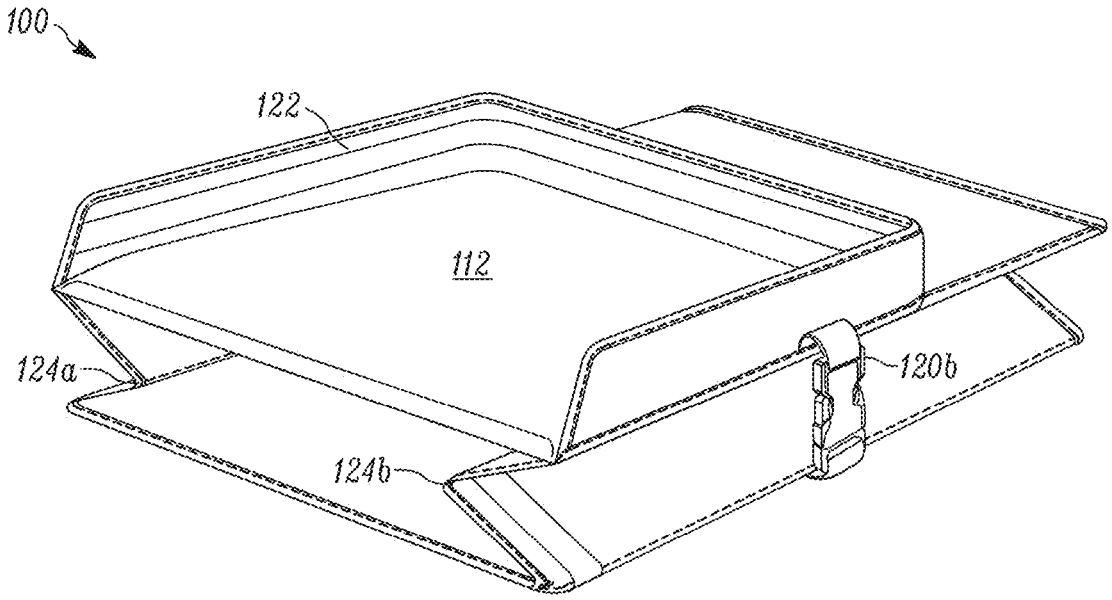
FIG. 9 is a perspective view of the exterior of the container of FIG. 1 with the container completely folded.

In an embodiment, the base panel 102 comprises only the exterior layer 132, the middle layer 136 comprising insulation, and the interior layer 140. As shown in FIG. 6, an interior flap 128, which includes a pull tab 130, sits adjacent to the base panel 102 and is affixed to the front wall 104 so as to allow the interior flap 128 to fold upward against the front wall 104 when the container 100 is collapsed. Like the view shown in FIG. 10, the interior flap 128 comprises a shell (or exterior layer) 132, formed of a waterproof material such as PEVA or a plastic foil material, surrounding a first inner layer (or an outer middle layer) 134 proximate the cavity of the container 100 comprising a gel pack such as that used in the middle layer 136 and a second inner layer (or an inner middle layer) 138 comprising a rigid or semirigid material, such as polyethylene (PE) board or PE-coated paperboard. The pull tab 130 is attached to the interior flap 128 to enable the interior flap 128 to be easily folded against the front wall 104. In alternative embodiments, the interior flap 128 is attached to one of the rear wall 106, the side wall 108, or the side wall 110, permitting the interior flap 128 to fold against the respective wall 106, 108, 110. In alternative embodiments, the interior flap 128 omits the second inner layer and/or the base panel 102 includes an additional layer comprising a rigid or semirigid material, such as polyethylene (PE) board or PE-coated paperboard.

Insulated Delivery Container with Removable Gel Pack Insert

FIGS. 11 through 23 illustrate a second embodiment of a delivery container 1100 that further comprises a removable insert 1101. As shown, delivery container 1100 also comprises a base panel 102, a front wall 104, a rear wall 106, opposite side walls 108, 110, and a lid 112 and is generally similar to delivery container 100. A removable insert 1101 is sized so as to fit within the cavity of the container 1100. A pair of handles 1114*a*, 1114*b* are attached to the side walls 108, 110 and the base panel 102. In use, the handles 1114*a*, 1114*b* extend above the lid 112 of the container 1100 and may be used to carry the container 1100.

As shown, the insert 1101 generally comprises a rectangular structure having a base panel 1102, a front wall 1104, a rear wall 1106, and opposite side walls 1108, 1110, which together define a cavity. The insert 1101 is shaped and sized so as to be placed in the cavity of the container 1100 such that the base panel 1102 of the insert is proximate the base panel 102 of the container 1100; items to be transported or stored in the container 1100 (such as, but not limited to, articles of food, beverages, and the like) are then placed within the cavity of the insert 1101. In other embodiments (not shown), the container 1100 and the insert 1101 may take other shapes, so long as the insert 1101 is sized and shaped so as to fit within the container 1100.

As shown, in embodiments the insert 1101 is collapsible to permit the container 1100 and the insert 1101 to be easily transported or stored while empty. As shown, vertical creases 1124*a*, 1124*b* extend along the side walls 1108, 1110 from proximate the base panel 1102 to proximate the open top of the insert 1101 to facilitate folding of the side walls 1108, 1110 when the insert 1101 is collapsed. The base panel 1102 also includes one or more creases 1126 to facilitate folding the base panel 1102. To collapse the insert 1101, the base panel 1102 folds into the insert 1101 along the creases 1126, while the side walls 1108, 1110 fold into the insert 1101 along creases 1124*a*, 1124*b* such that the front wall 1104 moves towards the rear wall 1106. The base panel 1102 further includes a pull tab 1130 to permit the base panel 1102 to be easily folded into the insert 1101. In an embodiment, the front wall 1104 and the rear wall 1106 contain horizontal creases, and the insert 1101 may be folded about the horizonal creases such that the base panel 1102 is proximate the open end of the insert 1101.

Once the insert 1101 is collapsed, it may be placed within the cavity of the container 1100. Optionally, the container 1100 may also be collapsed as discussed above. Alternatively, the container 1100 may be used without the insert 1101, such as when the contents of the container 1100 do not need to be temperature-controlled.

Figure 23:
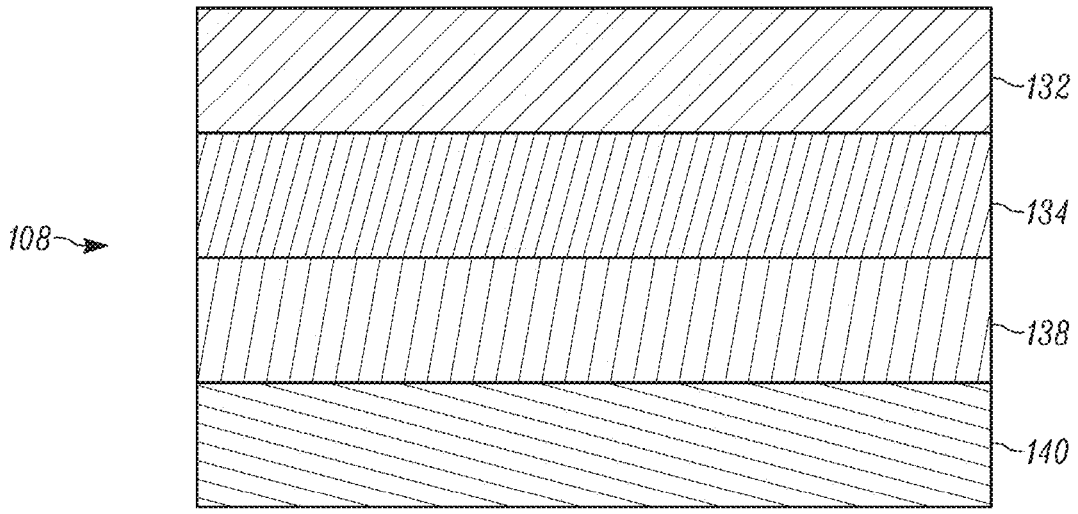
FIG. 23 is an exploded view of the interior of the container of FIG. 11.
Figure 24:
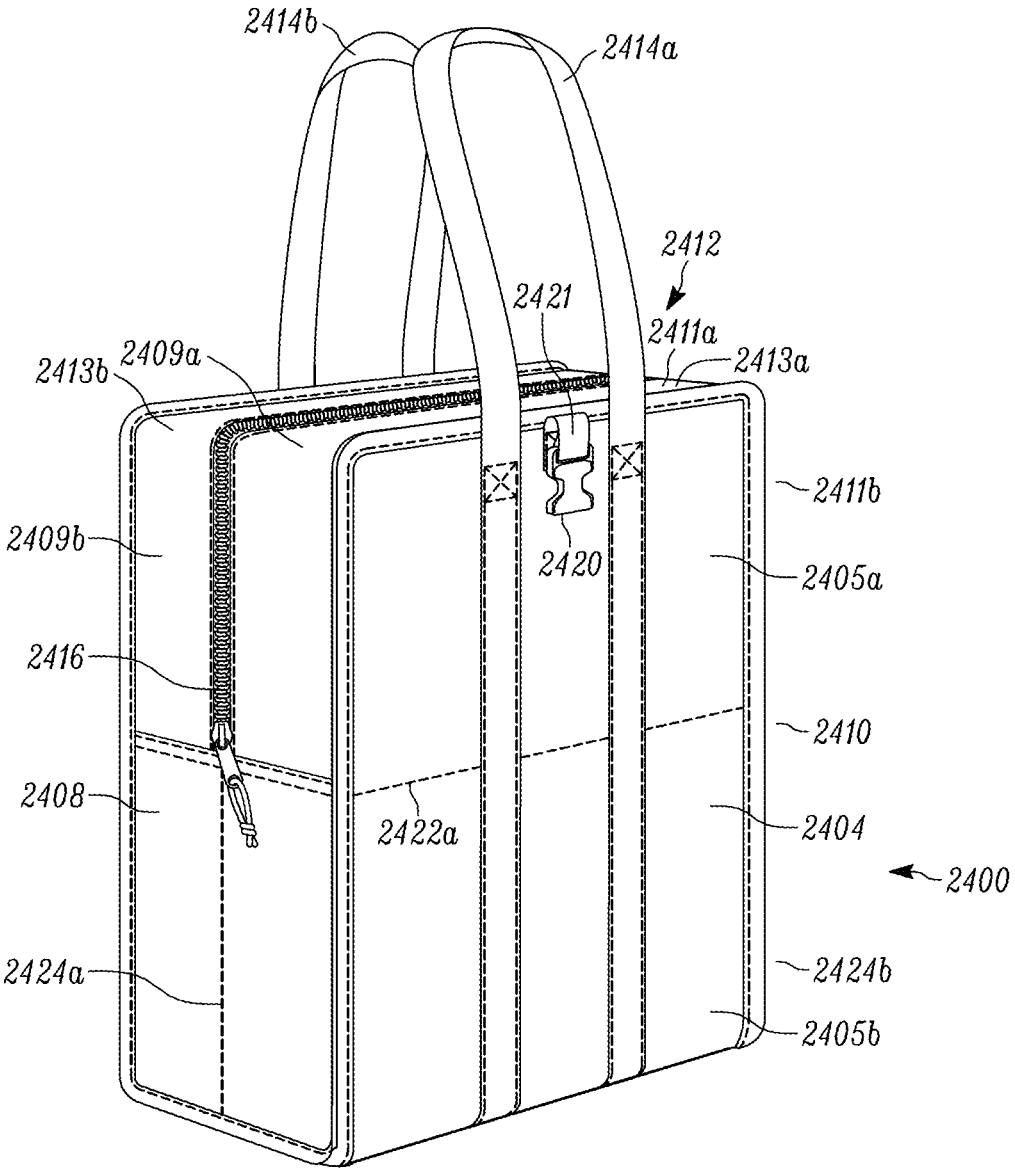
FIG. 24 is a perspective view of a third embodiment of a delivery container.
Figure 25:
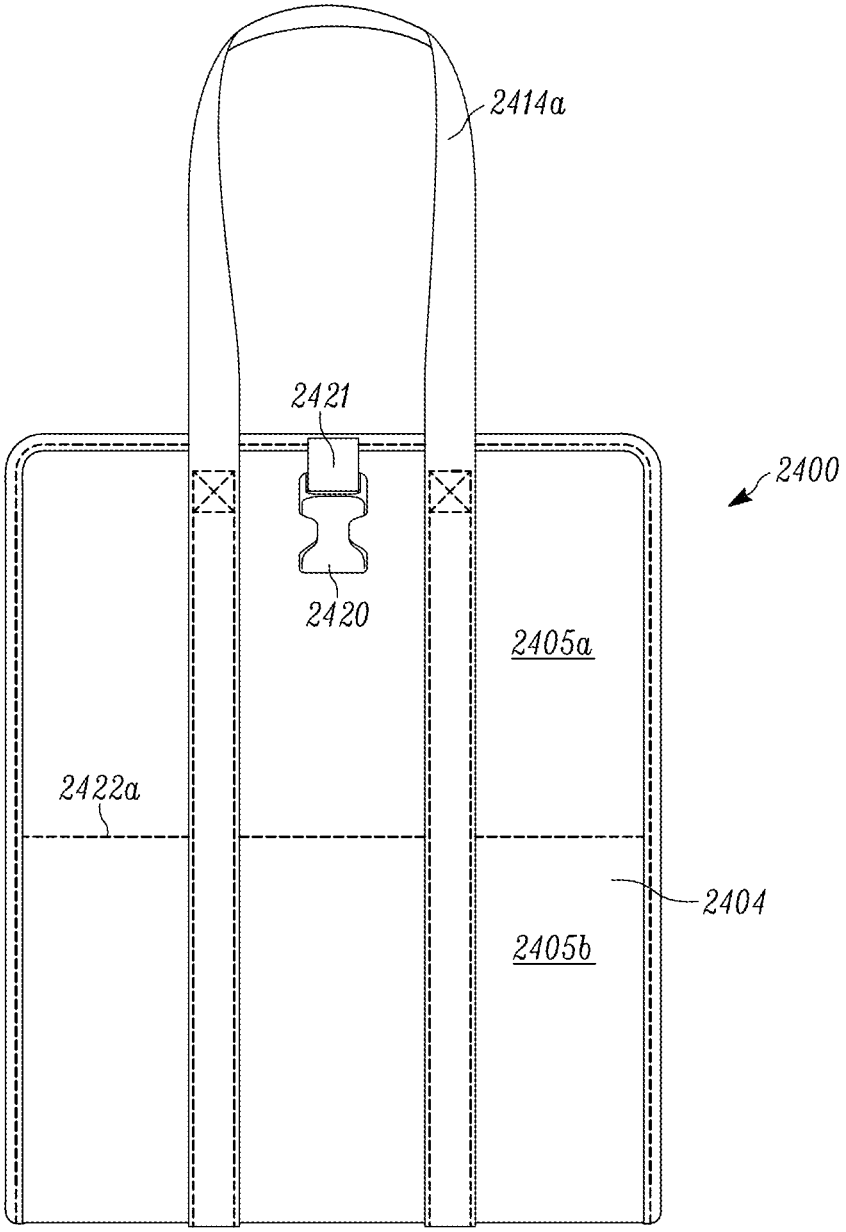
FIG. 25 is a front view of the container of FIG. 24.
Figure 26:
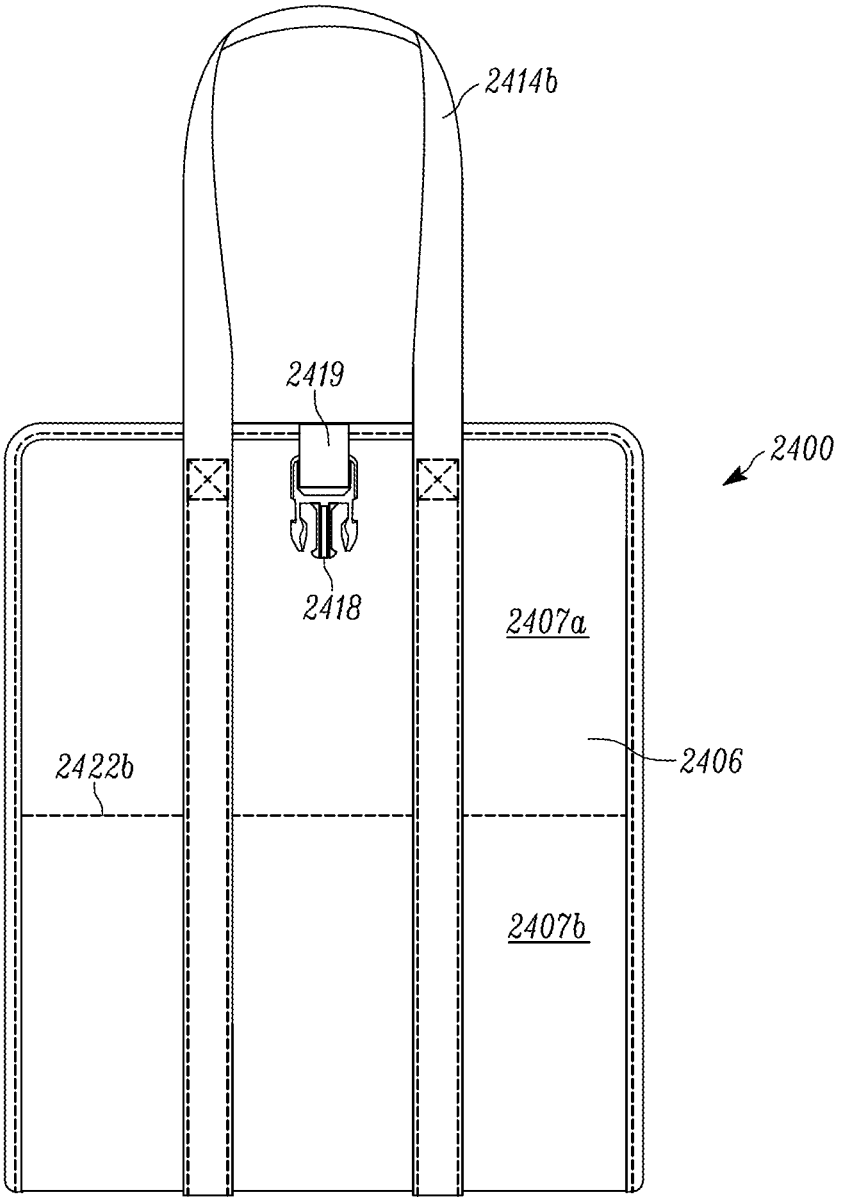
FIG. 26 is a rear view of the container of FIG. 24.
Figure 27:
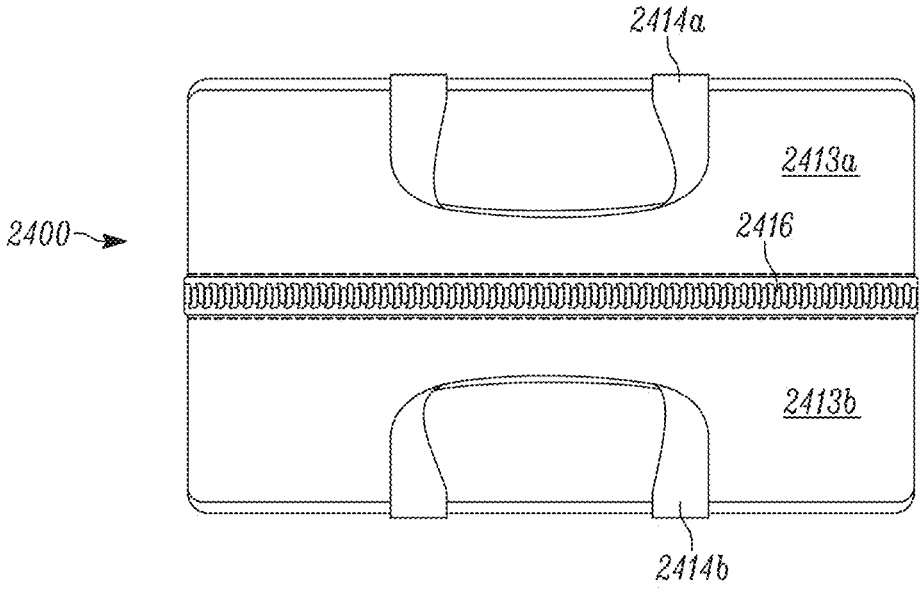
FIG. 27 is a top view of the container of FIG. 24.
Figure 28:
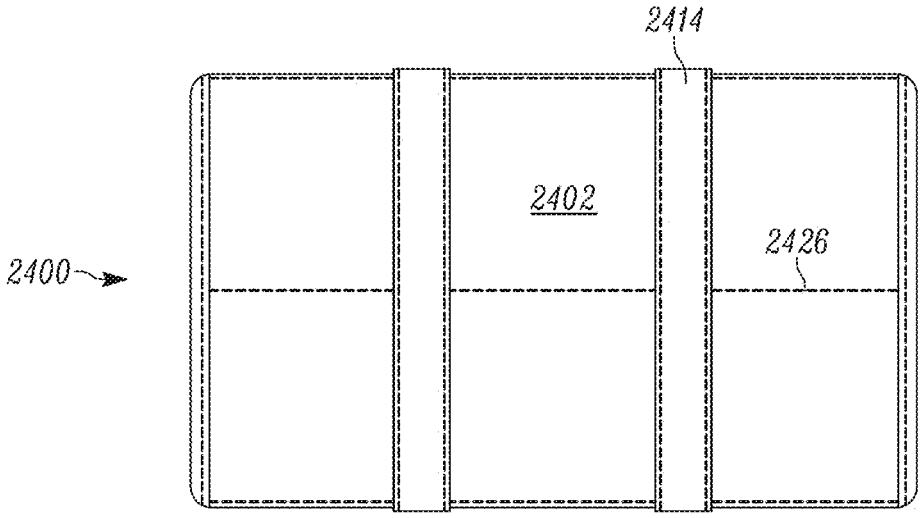
FIG. 28 is a bottom view of the container of FIG. 24.
Figure 29:
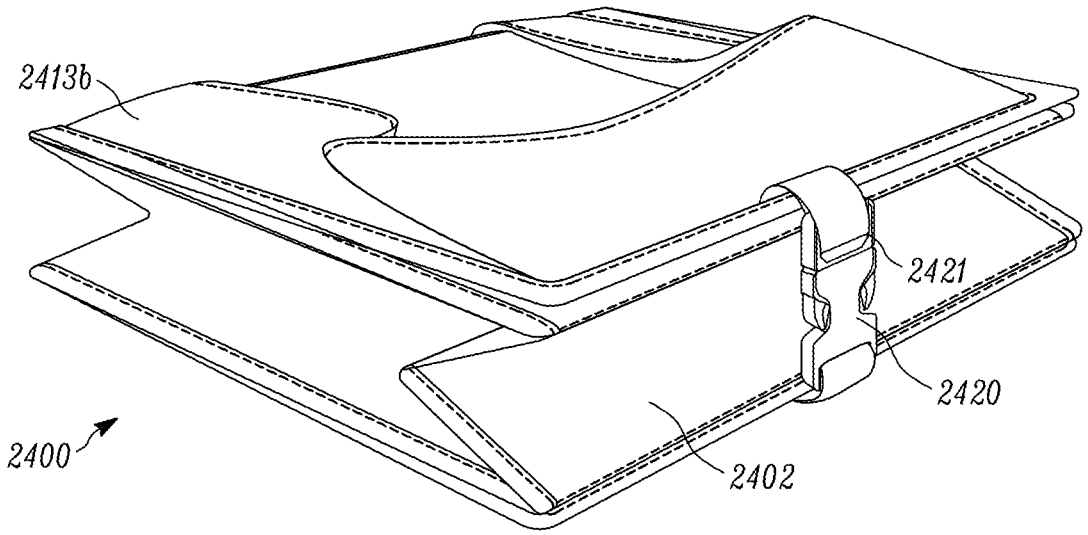
FIG. 29 is a bottom perspective view of the container of FIG. 24 with the container folded.

In an embodiment, the container 1100 is insulated so as to maintain the temperature of the items stored or transported within the container 1100, and the insert 1101 comprises a material for maintaining the temperature of the cavity of the insert 1101. As shown in FIG. 23, the base panel 102, front wall 104, rear wall 106, side walls 108, 110, and lid 112 each comprise four distinct layers. The exterior layer 132 comprises a protective, relatively strong and durable synthetic or natural material such as a fabric, canvas, nylon, coated polyester, or the like. In an embodiment, the exterior layer 132 includes an aluminizing material or coating to better reflect and disperse radiation (such as heat) away from the container 1100. The inner middle layer 138 comprises a waterproof material, such as polyethylene vinyl acetate (PEVA) or a plastic foil material. The outer middle layer 134 comprises a rigid or semirigid material, such as polyethylene (PE) board or PE-coated paperboard, to provided support for the container 1100. The middle layer 136 comprises insulation, such as cotton insulation, an insulating foam, or a high-density polyethylene (HDPE) foam. In an embodiment, the middle layer 136 of the walls 1104, 1106, 1108, 1110 comprises a layer of insulation that is 2 centimeters thick.

The insert 1101 comprises a material for maintaining the temperature of the cavity of the insert 1101 and any items located therein (e.g., by either cooling or heating). In an embodiment, the walls 1104, 1106, 1108, 1110 each comprise one or more gel packs comprising an outer wrapper or envelope of flexible or pliable material that is waterproof, such as plastic foil or PEVA which is filled with and surrounds an insulating, nontoxic gel material, which may be any such material known to those of skill in the art, such as silica gel. The amount of fill of the gel material is such that the walls 1104, 1106, 1108, 1110 are substantially flattened in shape. In an embodiment, the front wall 1104 and the rear wall 1106 each contain two gel packs, and the side walls 1108, 1110 and the base panel 1102 do not contain gel packs to facilitate easy folding of the insert 1101.

While not in use, the insert 1101 may be placed within a temperature-controlled environment (such as a freezer or an oven) so as to allow the gel to reach a desired temperature. The container 1100 may be stored separately from the insert 1101, reducing the amount of space required in the temperature-controlled environment.

Figure 19:
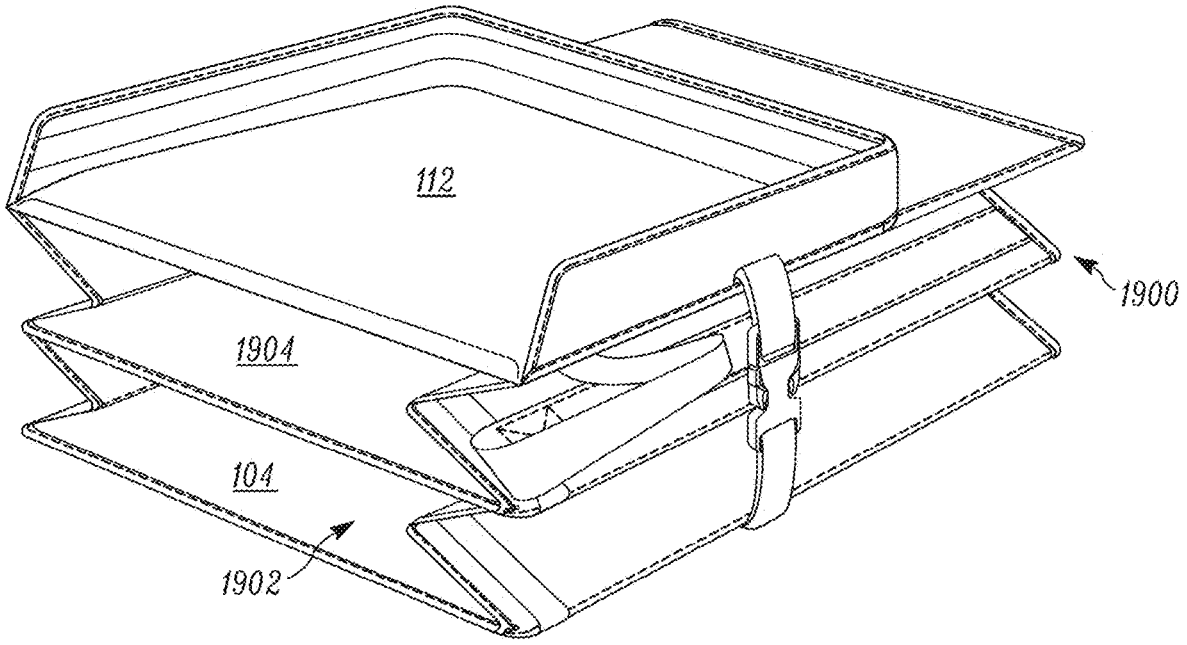
FIG. 19 is a perspective view of the container of FIG. 11 without the insert and with the container folded.
Figure 20:
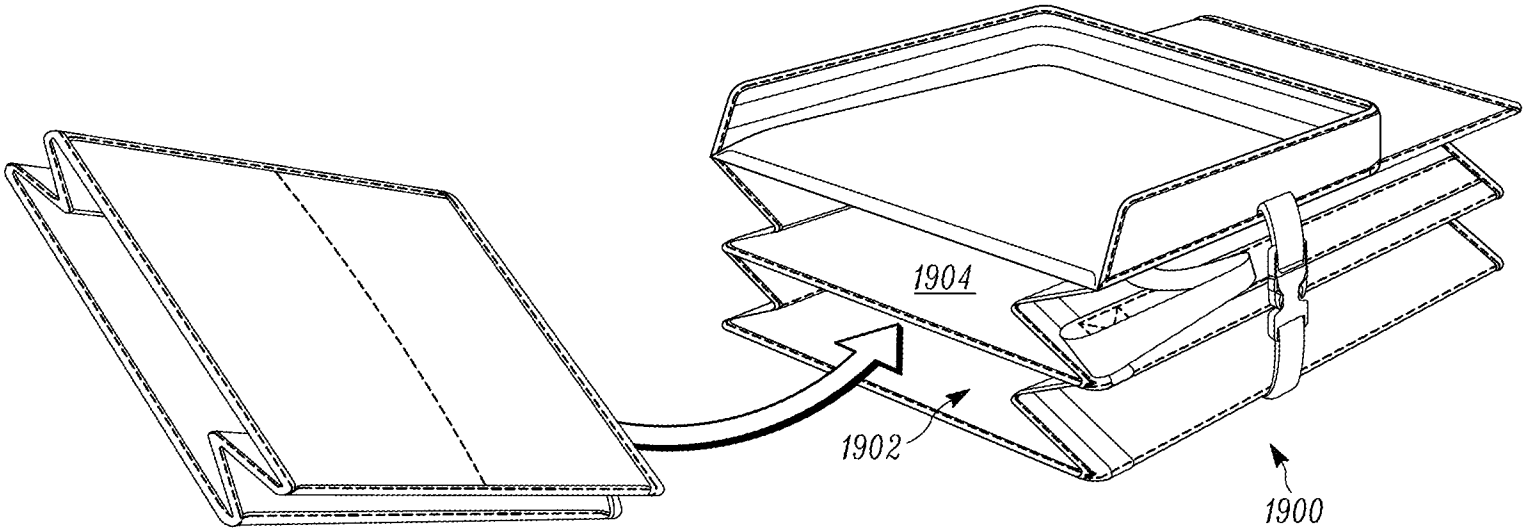
FIG. 20 is a perspective view of the container and insert of FIG. 11 with the container and insert completely folded, showing the insertion of the insert into the front flap of the container.

As shown in FIGS. 19 and 20, in an alternative embodiment, a container 1900 comprises a front pocket 1902 separated from the cavity by a pocket wall 1904 that stretches between the side walls 108, 110 of the container 1900. As shown in FIGS. 19 and 20, the side walls 108, 110 each comprise multiple creases 124*a*, 124*b*, with the pocket wall 1904 located between the creases 124*a*, 124*b*.

Figure 21:
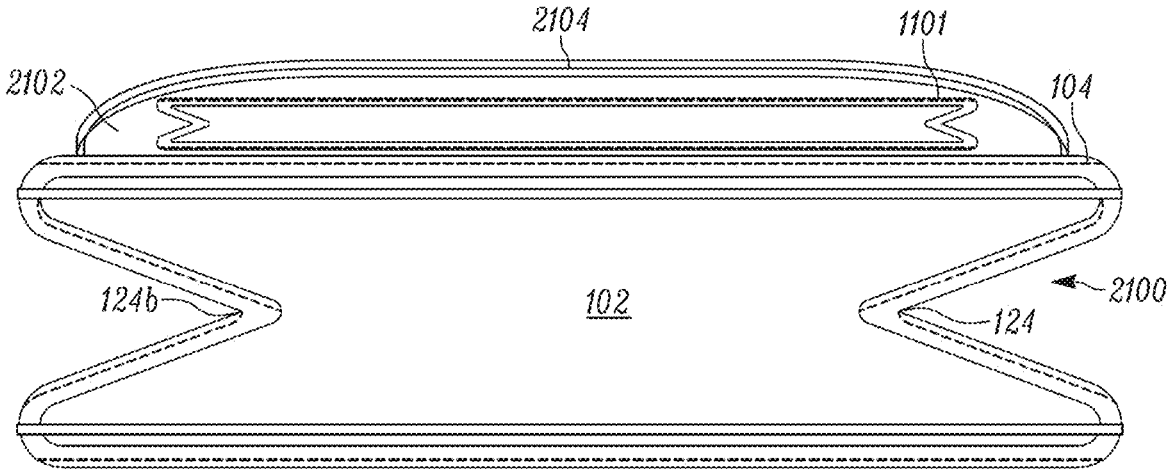
FIG. 21 is a top view of the container and insert of FIG. 11 with the container and insert completely folded and the insert within the front pocket of the container.
Figure 22:
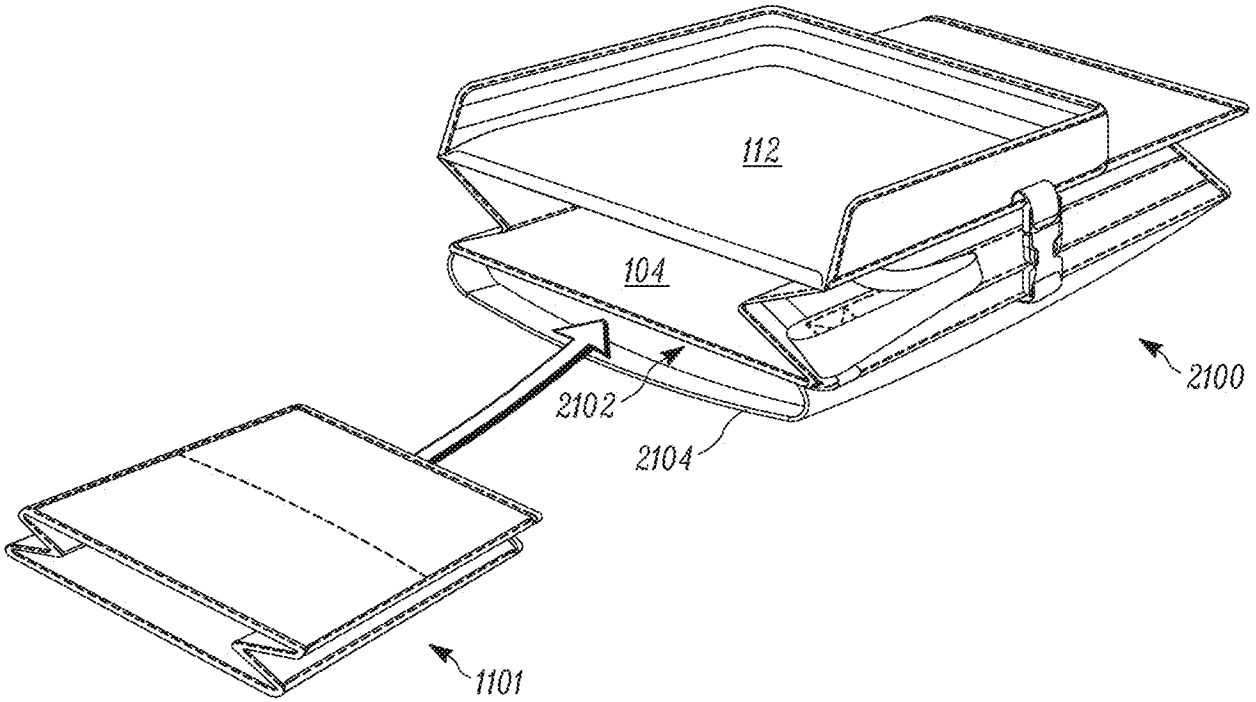
FIG. 22 is a perspective view of an alternative embodiment of the container and insert of FIG. 11.

As shown in FIGS. 21 and 22, in an alternative embodiment, a container 2100 contains a front pocket 2102 formed by a pocket wall 2104 and separated from the cavity by the front wall 104. As shown, the side walls 108, 110 each comprise a single crease 124*a*, 124*b*. Other configurations of pockets are also contemplated, including pockets located proximate the front wall within the cavity, pockets located in the lid, and pockets located proximate the rear wall or the side walls of the container.

Insulated Grocery Container

FIGS. 24 through 30 illustrate a third embodiment of a delivery container 2400 that is generally similar in structure to delivery container 100 but with several notable distinctions. As shown, the container 2400 generally comprises a rectangular structure having a base panel 2402, a front wall 2404, a rear wall 2406, opposite side walls 2408, 2410, and a lid 2412, which together define a cavity which receives items to be transported or stored in the container 2400. The upper front portion 2409*a* of the left side wall 2408 is separated from the upper rear portion 2409*b* of the left side wall 2408, just as the upper front portion 2411*a* of the right side wall 2410 is separated from the upper rear portion 2411*b* of the right side wall 2410. Similarly, the lid 2412 comprises a front portion 2413*a* and a rear portion 2413*b*, which are separated from one another. An attachment mechanism such as a zipper 2416 detachably connects the front portions 2409*a*, 2411*a*, 2413*a* and the rear portions 2409*b*, 2411*b*, 2413*b* together so as to seal the cavity of the container 2400 (thereby restraining any items placed therein within the container 2400).

As shown, in embodiments the container 2400 is collapsible to permit the container 2400 to be easily transported or stored while empty. As shown, vertical creases 2424*a*, 2424*b* extend along the side walls 2408, 2410 from proximate the base panel 2402 to the junction between the front portions 2409*a*, 2411*a* and the rear portions 2409*b*, 2411*b* of the side walls 2408, 2410. Horizontal seams 2422*a*, 2422*b* extend the width of the front wall 2404 and the rear wall 2406, respectively. The base panel 2402 also includes one or more creases 2426 to facilitate folding the base panel 2402. To collapse the container 2400, the front portions 2409*a*, 2411*a*, 2413*a* are separated from the rear portions 2409*b*, 2411*b*, 2413*b* (e.g., by undoing the zipper 2416), and the upper portions 2405*a*, 2407*a* of the front wall 2404 and the rear wall 2406, respectively, are folded along horizontal creases 2422*a*, 2422*b* against the corresponding lower portions 2405*b*, 2407*b* of the front wall 2404 and the rear wall 2406, respectively. The front portions 2409*a*, 2411*a* of the side walls 2408, 2410 are folded against the interior surface of the upper portion 2405*a* of the front wall 2404, and the rear portions 2409*b*, 2411*b* of the side walls 2408, 2410 are folded against the interior surface of the upper portion 2407*a* of the rear wall 2406. The base panel 2402 then folds into the container 2400 along the creases 2426, while the side walls 2408, 2410 fold into the container 2400 along the creases 2424*a*, 2424*b* such that the front wall 2404 moves towards the rear wall 2406.

The container 2400 is secured in the collapsed configuration using clips 2418, 2420, which are attached to the front wall 2404 and the rear wall 2406, respectively, by straps 2419, 2421.

A pair of handles 2414*a*, 2414*b* formed from a strap 2414 are attached to the front wall 2404, the rear wall 2406, and the base panel 2402. In use, the handles 2414*a*, 2414*b* extend above the lid 2412 of the container 2400 and may be used to carry the container 2400.

Figure 30:
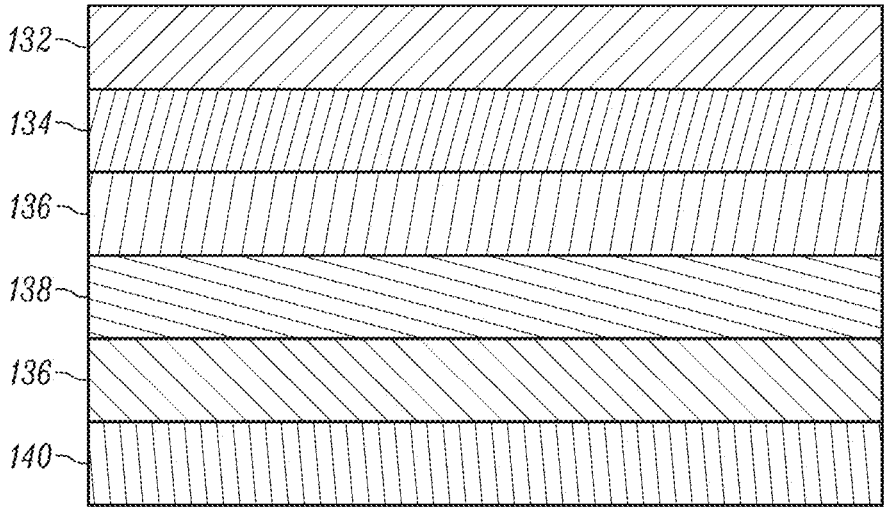
FIG. 30 is an exploded view of the interior of the container of FIG. 24.
Figure 31:
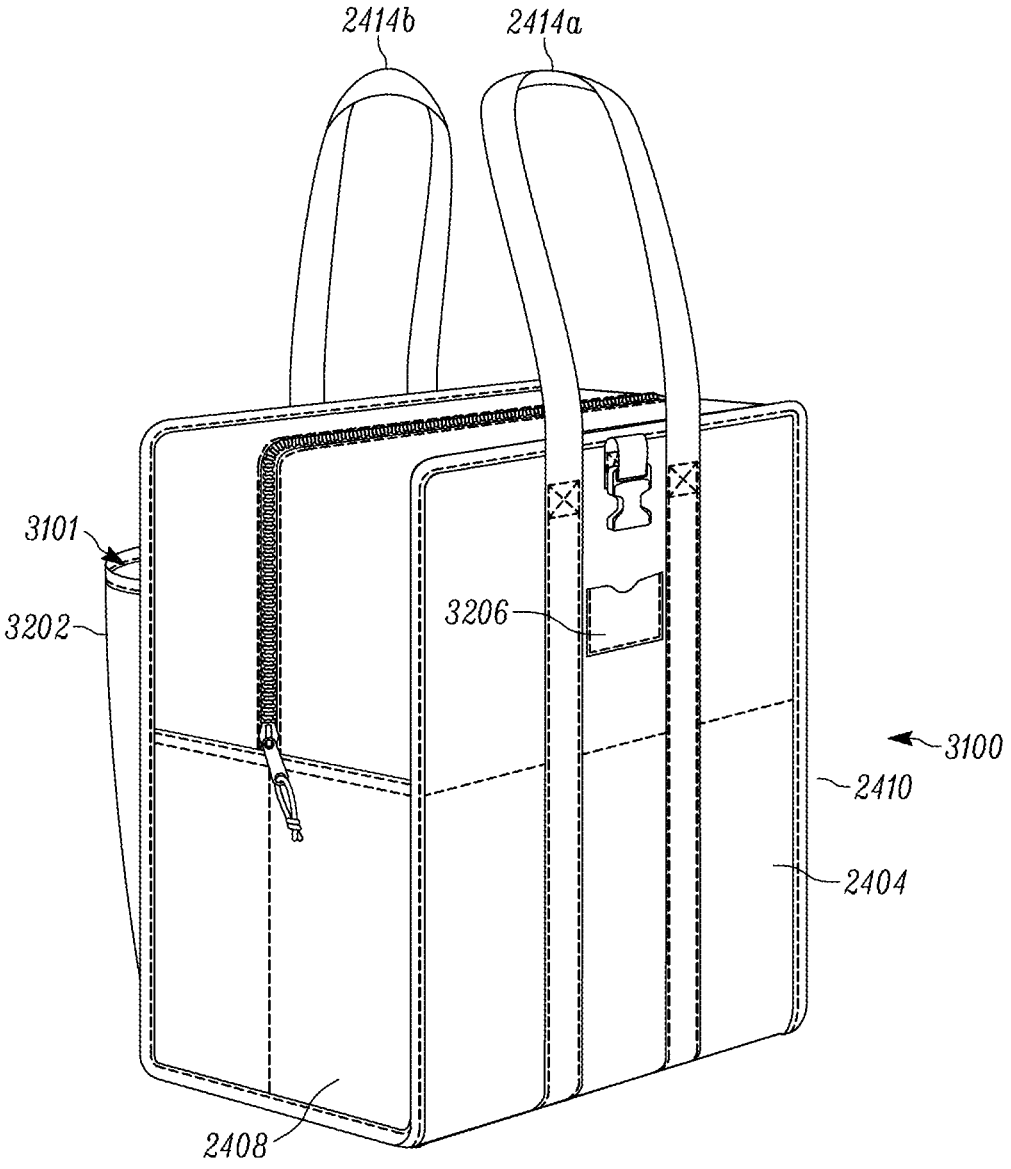
FIG. 31 is a perspective view of a fourth embodiment of a delivery container containing an insert.
Figure 32:
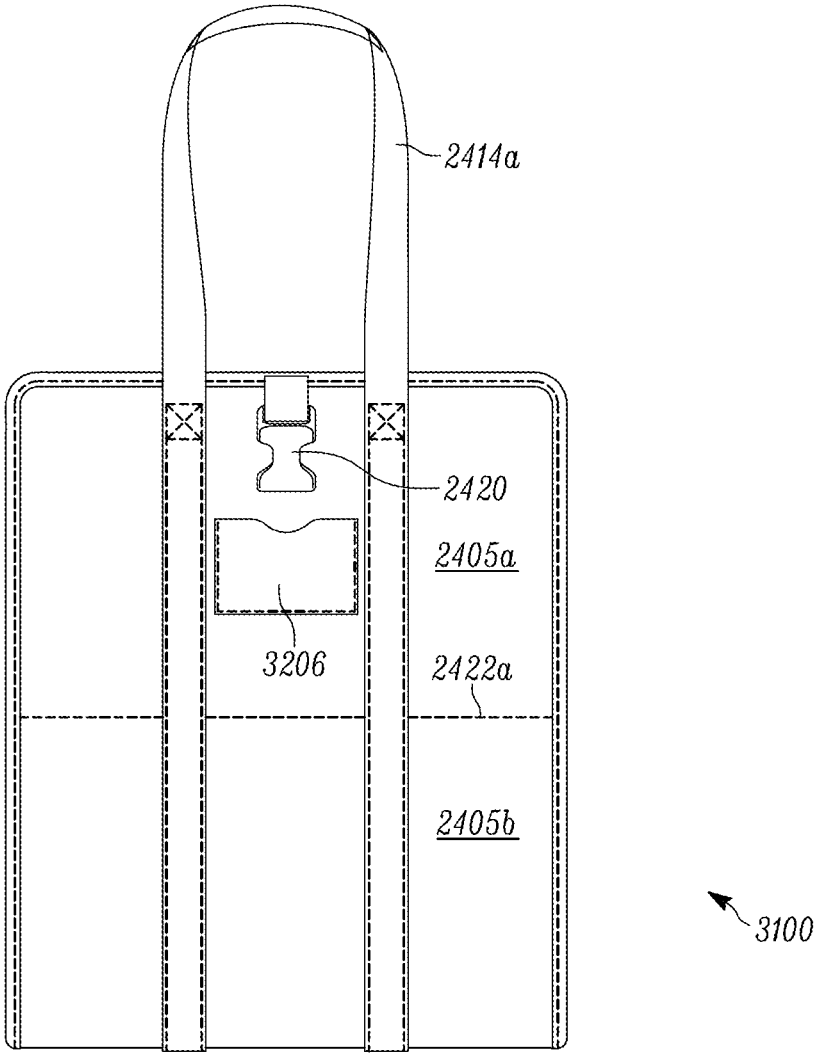
FIG. 32 is a front view of the container of FIG. 31.
Figure 33:
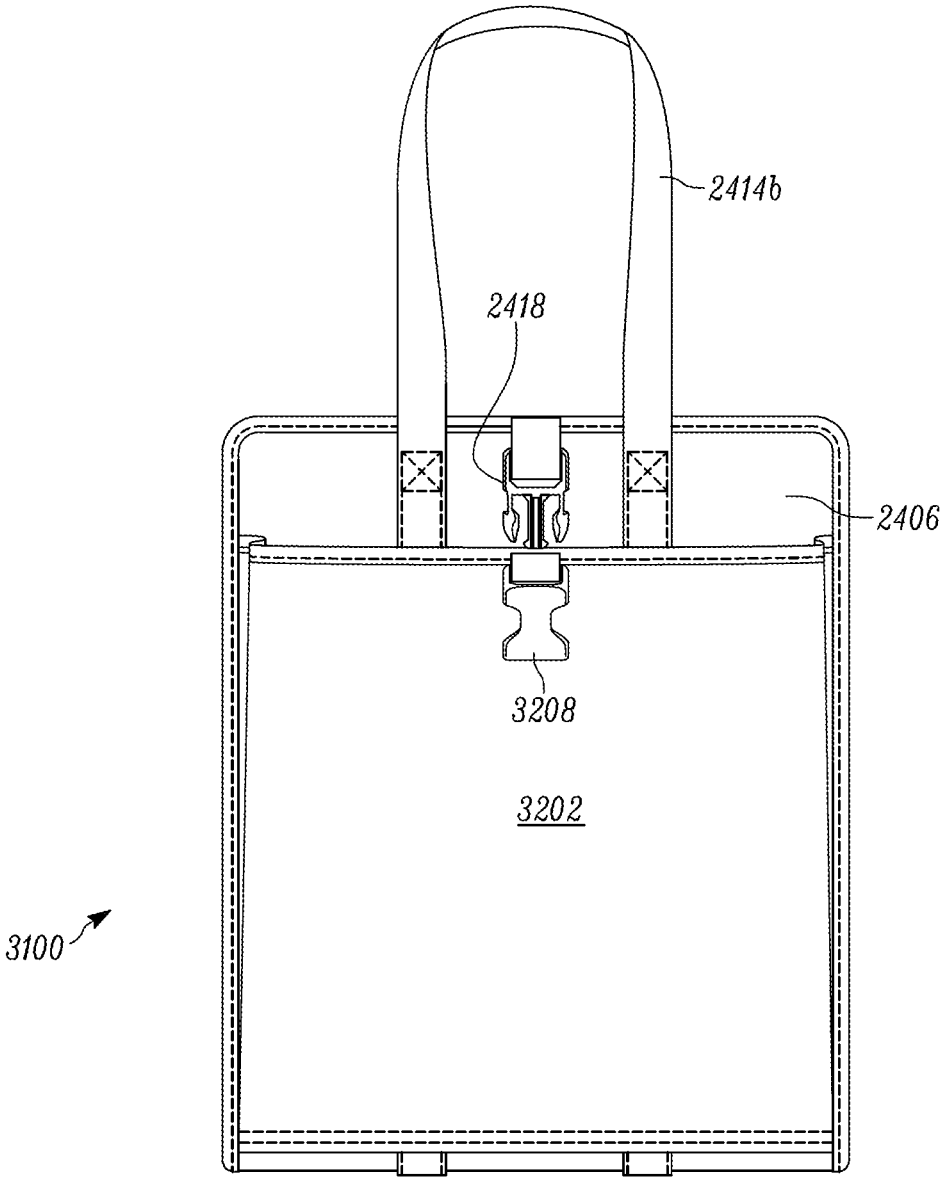
FIG. 33 is a rear view of the container of FIG. 31.
Figure 34:
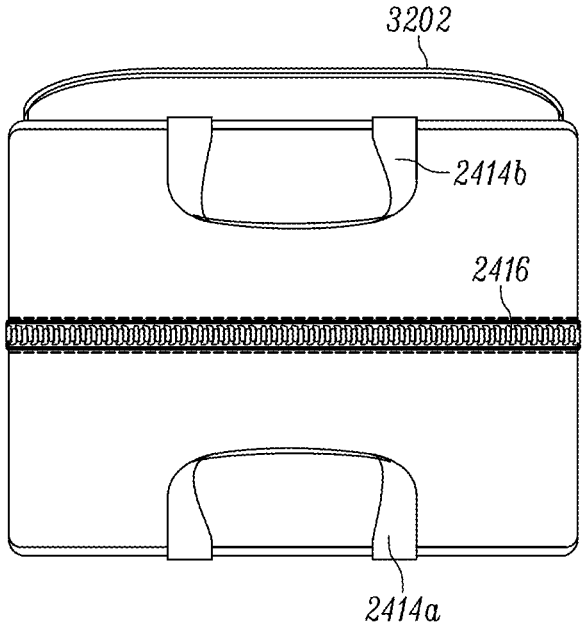
FIG. 34 is a top view of the container of FIG. 31 without the insert.
Figure 35:
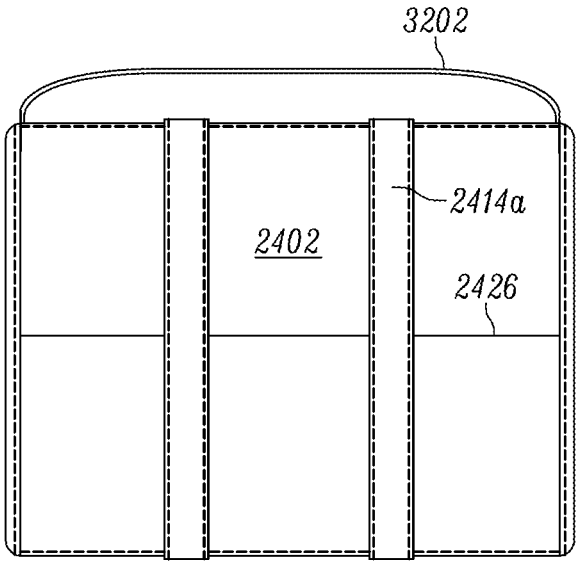
FIG. 35 is a bottom view of the container of FIG. 31.
Figure 36:
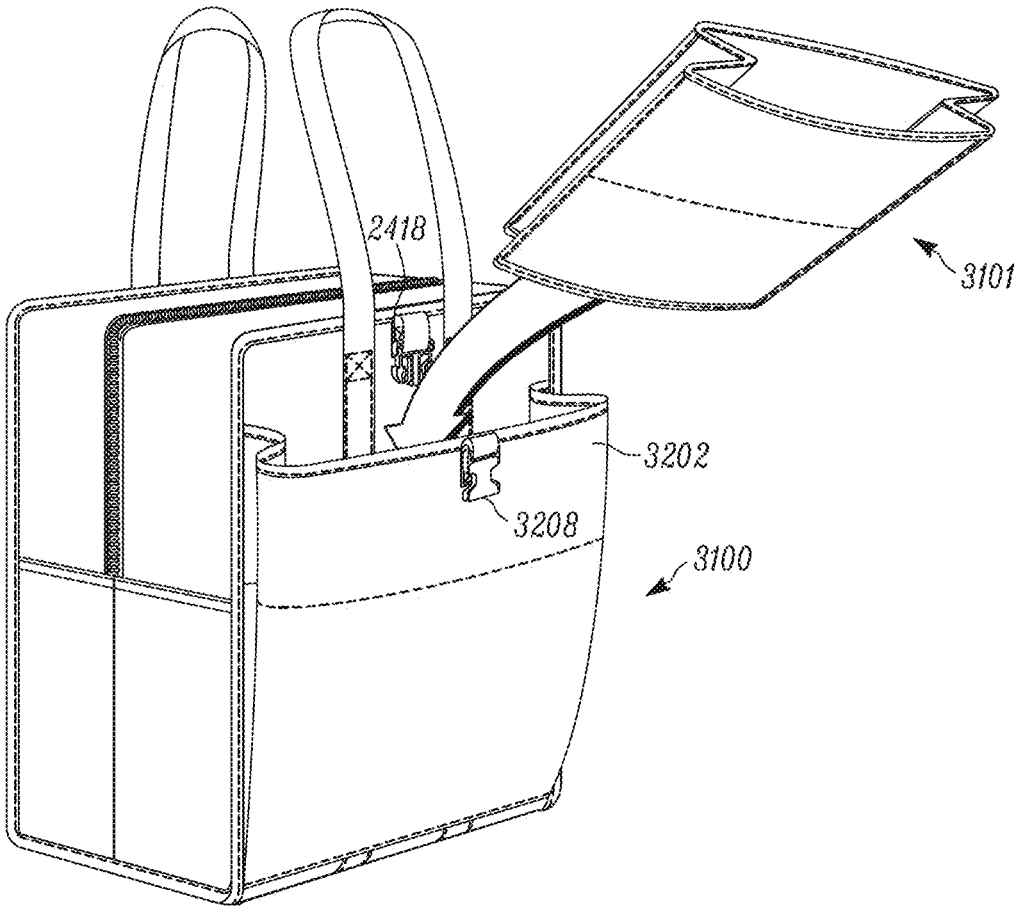
FIG. 36 is a perspective view of the container of FIG. 31 showing the storage of the insert within the front pocket of the container.

In an embodiment, the container 2400 is insulated so as to maintain the temperature of the items stored or transported within the container 2400. FIG. 30 depicts a cross-sectional illustration of the front wall (not shown to scale). In an embodiment, the same six layers comprise the front wall 104, the rear wall 106, and the side walls 108, 110. The exterior layer 132 comprises a protective, relatively strong and durable synthetic or natural material such as a fabric, canvas, nylon, coated polyester, or the like. In an embodiment, the exterior layer 132 includes an aluminizing material or coating to better reflect and disperse radiation (such as heat) away from the container 100. The inner middle layer 138 comprises a waterproof material, such as polyethylene vinyl acetate (PEVA), or a plastic foil material. The outer middle layer 134 comprises a rigid or semirigid material, such as polyethylene (PE) board or PE-coated paperboard, to provide support for the container 100. The two layers of insulation make up the middle layer 136 and middle layer 136, which comprises an insulating material, such as cotton insulation, an insulating foam, or a high-density polyethylene (HDPE) foam. In an embodiment, the middle layer 136 of the walls 104, 106, 108, 110 comprises a layer of insulation that is 2 centimeters thick. The inner middle layer 138 comprises a material for maintaining the temperature of the cavity of the container 100 and any items located therein (e.g., by either cooling or heating). In an embodiment, the middle layer 136 comprises a gel pack comprising an outer wrapper or envelope of flexible or pliable material such as plastic film which is filled with and surrounds an insulating, nontoxic gel material, which may be any such material known to those of skill in the art, such as silica gel. The amount of fill of the gel material is such that the gel pack is substantially flattened in shape. As will be clear to one of skill in the art from the present disclosure, in alternative embodiments, the structure of the walls 104, 106, 108, 110 may be varied to either include additional layers (such as by including additional layers of insulation) or omit layers (such as by omitting the outer middle layer 134 to provide a soft-sided container).

Insulated Grocery Container with Removable Gel Pack Insert

FIGS. 31 through 36 illustrate a fourth embodiment of a delivery container 3100 that further comprises a removable insert 3101. As shown, delivery container 3100 is generally similar to delivery container 2400 but has several notable differences. As shown, the insert 3101 generally comprises a rectangular structure having a base panel 2402, a front wall 2404, a rear wall 2406, and opposite side walls, 3110, which together define a cavity. The insert 3101 is shaped and sized so as to be placed in the cavity of the container 3100 such that the base panel 3102 of the insert is proximate the base panel 3102 of the container 3100; items to be transported or stored in the container 3100 (such as, but not limited to, articles of food, beverages, and the like) are then placed within the cavity of the insert 3101.

As shown, in embodiments the insert 3101 is generally similar to insert 1101, other than being sized so as to fit within the container 3100. In particular, the insert 3101 is collapsible to permit the container 3100 and the insert 3101 to be easily transported or stored while empty.

As shown, in an embodiment, the container 3100 comprises a front pocket 3002 located proximate the front wall 3104 and sized so as to hold the insert 3101 in a folded configuration. The container 3100 may be secured in the collapsed configuration using clips 2418, 2420, which are attached to the front wall 2404 and the rear wall 2406, respectively, by straps 2419, 2421. Additionally, the insert 3101 may be secured in the front pocket 3202 using clips 2418, 3208. Alternatively, other items may be secured in the front pocket 3202 in a similar manner. An ID card holder 3206 is optionally located on the container 3100, for example to allow for identification of the owner of the container 3100 or the contents of the container 3100. The ID card holder 3206 may comprise a clear material, such as a clear plastic, to permit writing on an object placed in the ID card holder 3206 to be clearly visible.

Once the insert 3101 is collapsed, it may be placed within the front pocket 3202 of the container 3100. Optionally, the container 3100 may also be collapsed as discussed above. Alternatively, the container 3100 may be used without the insert 3101, such as when the contents of the container 3100 do not need to be temperature-controlled.

As with container 1100 (discussed above), in an embodiment, the container 3100 is insulated so as to maintain the temperature of the items stored or transported within the container 3100, and the insert 3101 comprises a material for maintaining the temperature of the cavity of the insert 3101. Similarly, in an embodiment, the insert 3101 comprises a material for maintaining the temperature of the cavity of the insert 3101 and any items located therein (e.g., by either cooling or heating), as with insert 1101.

Insulated Transport Container

FIGS. 38 through 42 illustrate a fifth embodiment of a delivery container 3800 that is generally similar in structure to delivery container 100 but with several notable distinctions. As shown, the container 3800 generally comprises a rectangular structure having a base panel 3802, a front wall 3804, a rear wall 3806, opposite side walls 3808, 3810, and a lid 3812, which together define a cavity which receives items to be transported or stored in the container 3800. As shown in this embodiment, the lid 3812 is attached to the rear wall 3806. An attachment mechanism such as a zipper 3816 detachably connects the lid 3812 to the side walls 3808, 3810 and the front wall 3804 so as to seal the cavity of the container 3800 (thereby restraining any items placed therein within the container 3800).

As shown, in embodiments the container 3800 is secured in the collapsed configuration by using a fastener such as a hook-and-loop fastener. A pair of fasteners 3820*a*, 3820*b* are attached to the lid 3812, with complementary fasteners 3818*a*, 3818*b* connected to the front wall 3804 by straps 3819*a*, 3819*b*. Once the container 3800 is collapsed, fastener 3820*a* attaches to complementary fastener 3818*a*, and fastener 3820*b* attaches to complementary fastener 3818*b*. In an embodiment, clip fasteners or the like are used, and the distance between the complementary clips can be adjusted by sliding the clips along the straps 3819*a*, 3819*b*, allowing for the container 3800 to be secured in a collapsed state while varying the distance between the front wall 3804 and the rear wall 3806.

A handle 3814 is attached to the side walls 3808, 3810 of the container 3800. In use, the handle 3814 extends above the lid 3812 of the container 3800 and may be used to carry the container 3800. As shown, the length of the handle 3814 may be adjustable. A hand grip 3830 is also attached to the lid 3812 of the container 3800 for carrying the container 3800. In alternative embodiments, the hand grip may be located in other positions, such as at the top of the rear wall 3806, as shown in FIGS. 37 and 38.

Figure 38:
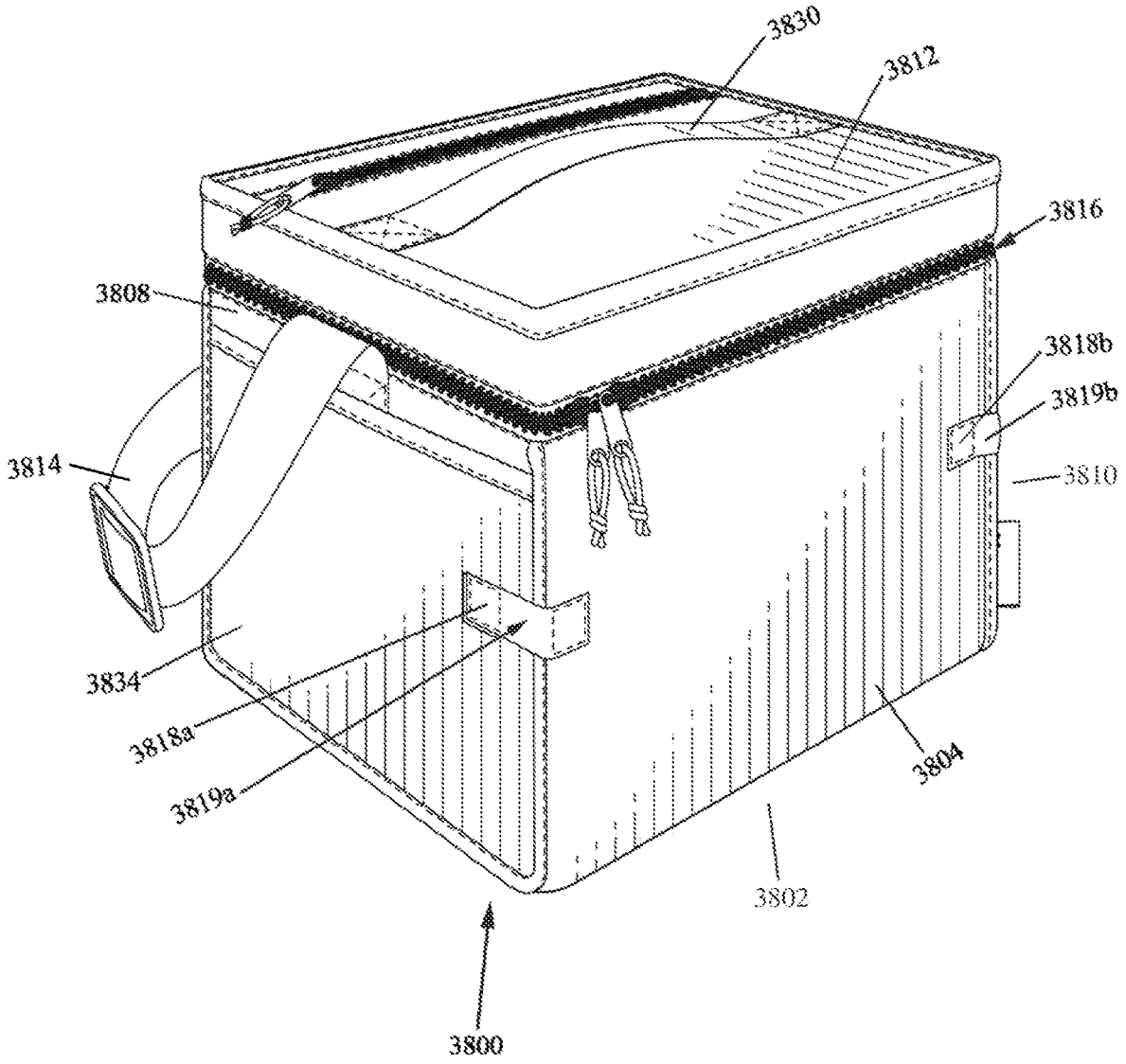
FIG. 38 is a perspective view of a fifth embodiment of a delivery container.
Figure 39:
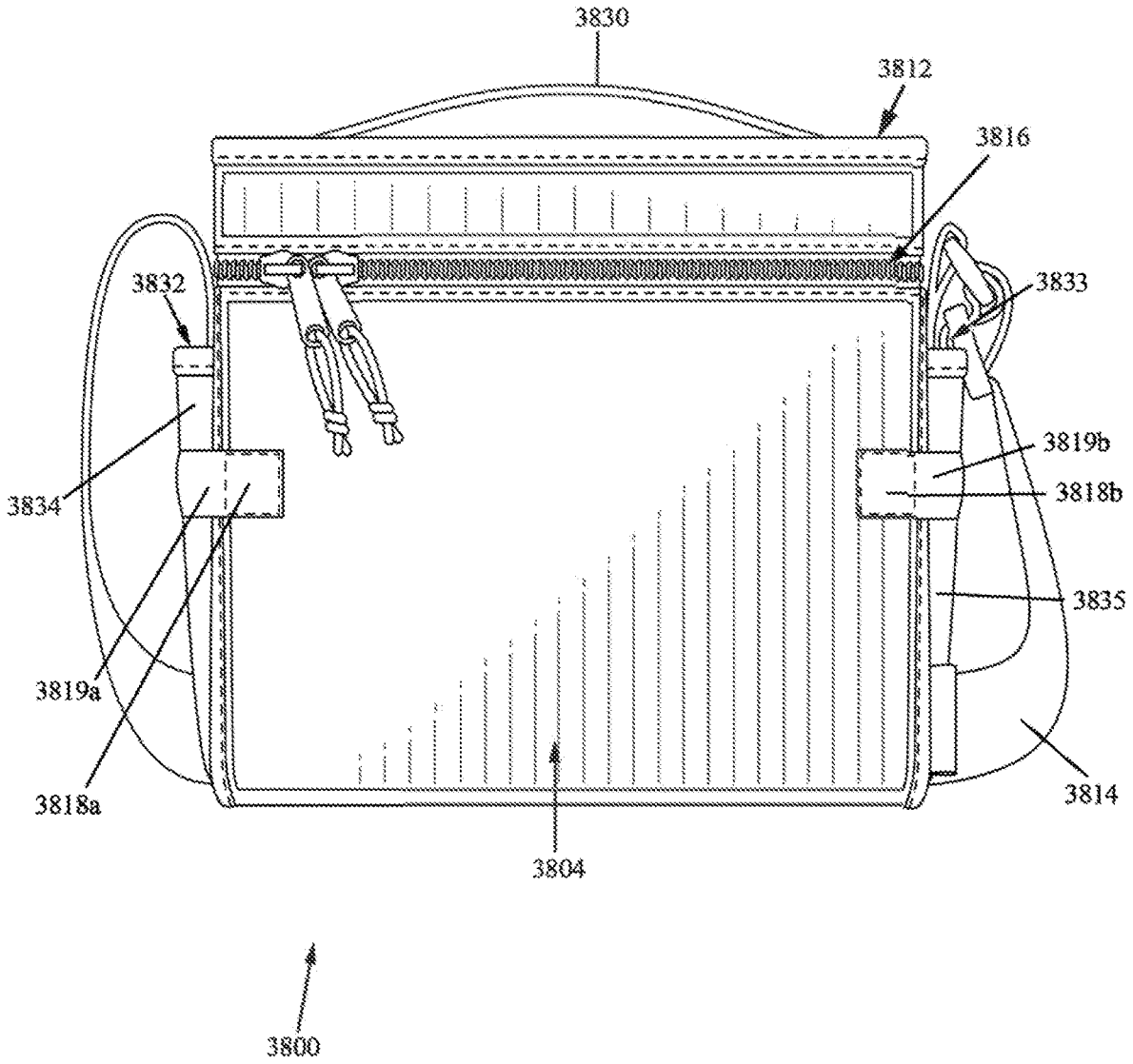
FIG. 39 is a front view of the container of FIG. 38.
Figure 40:
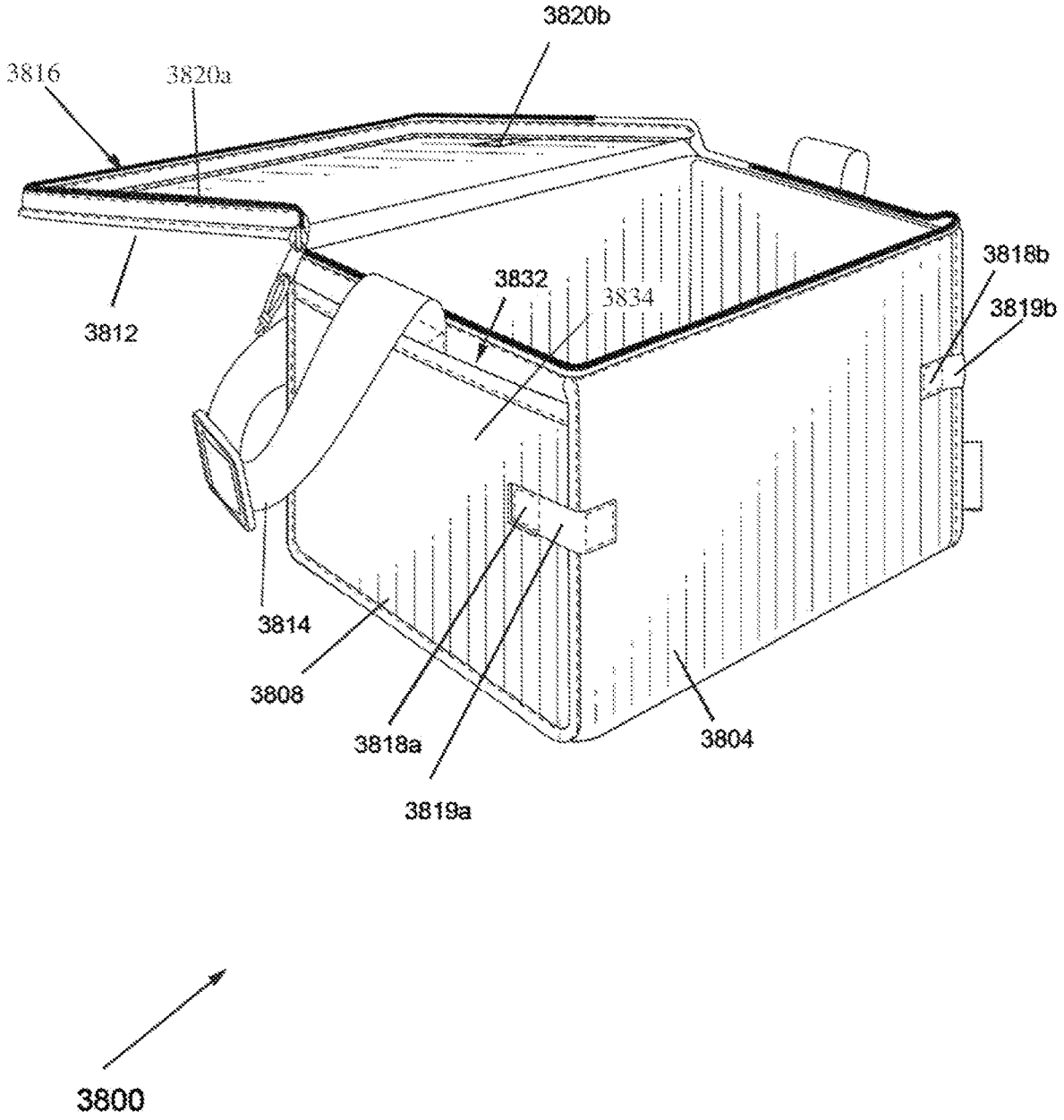
FIG. 40 is a top perspective view of the container of FIG. 38 with the lid raised.

As shown in FIGS. 38 through 40, in an embodiment, a container 3800 contains side pockets 3832, 3833 formed by pocket walls 3834, 3835 and separated from the cavity by the side walls 3808, 3810. Other configurations of pockets are also contemplated, including pockets located proximate the front wall 3804, as shown in FIGS. 41 and 42, within the cavity, pockets located in the lid 3812, as shown in FIGS. 38 through 40, and pockets located proximate the rear wall 3806 of the container 3800.

Figure 41:
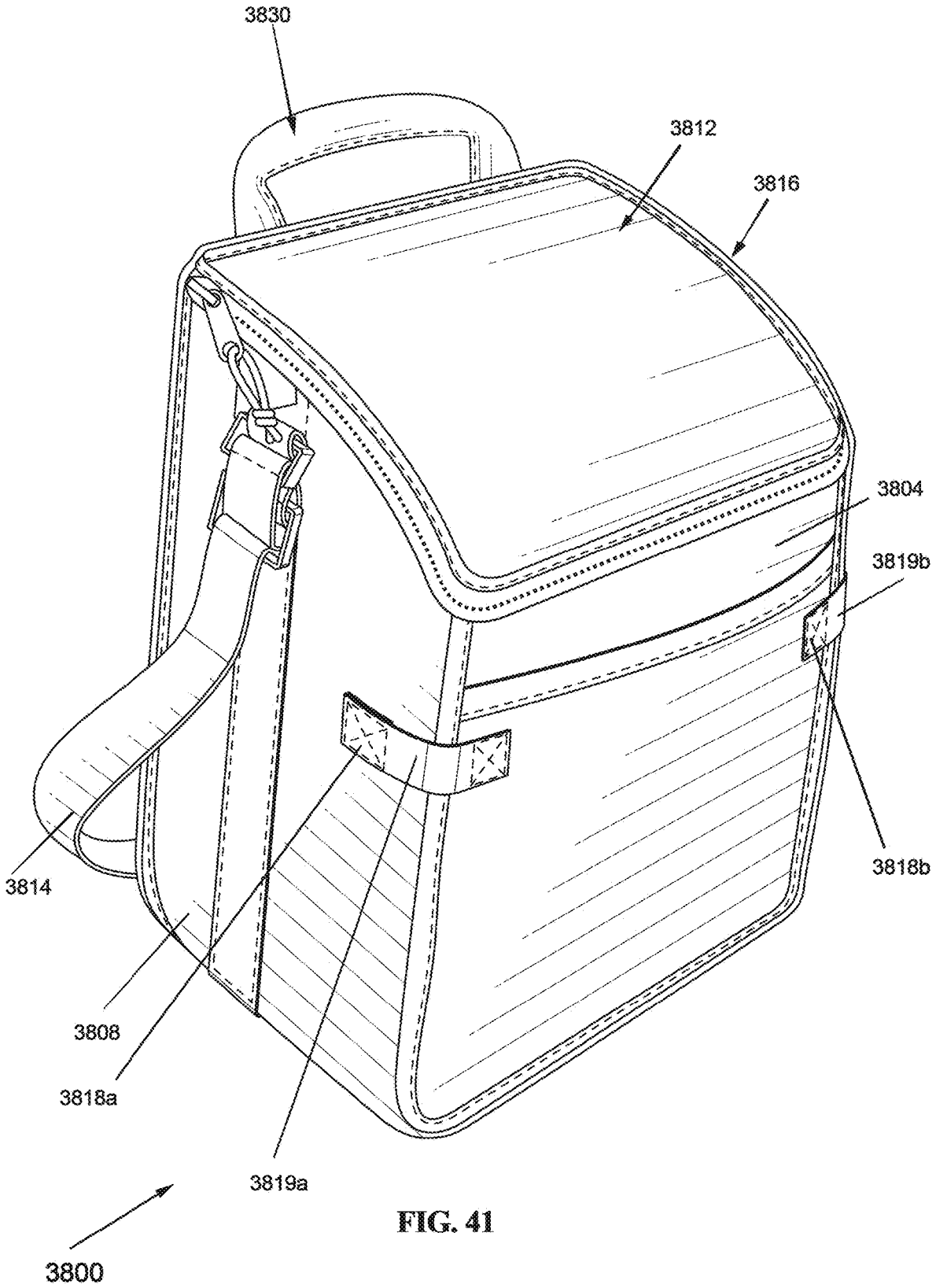
FIG. 41 is a perspective view of an alternative embodiment of the container of FIG. 38.
Figure 42:
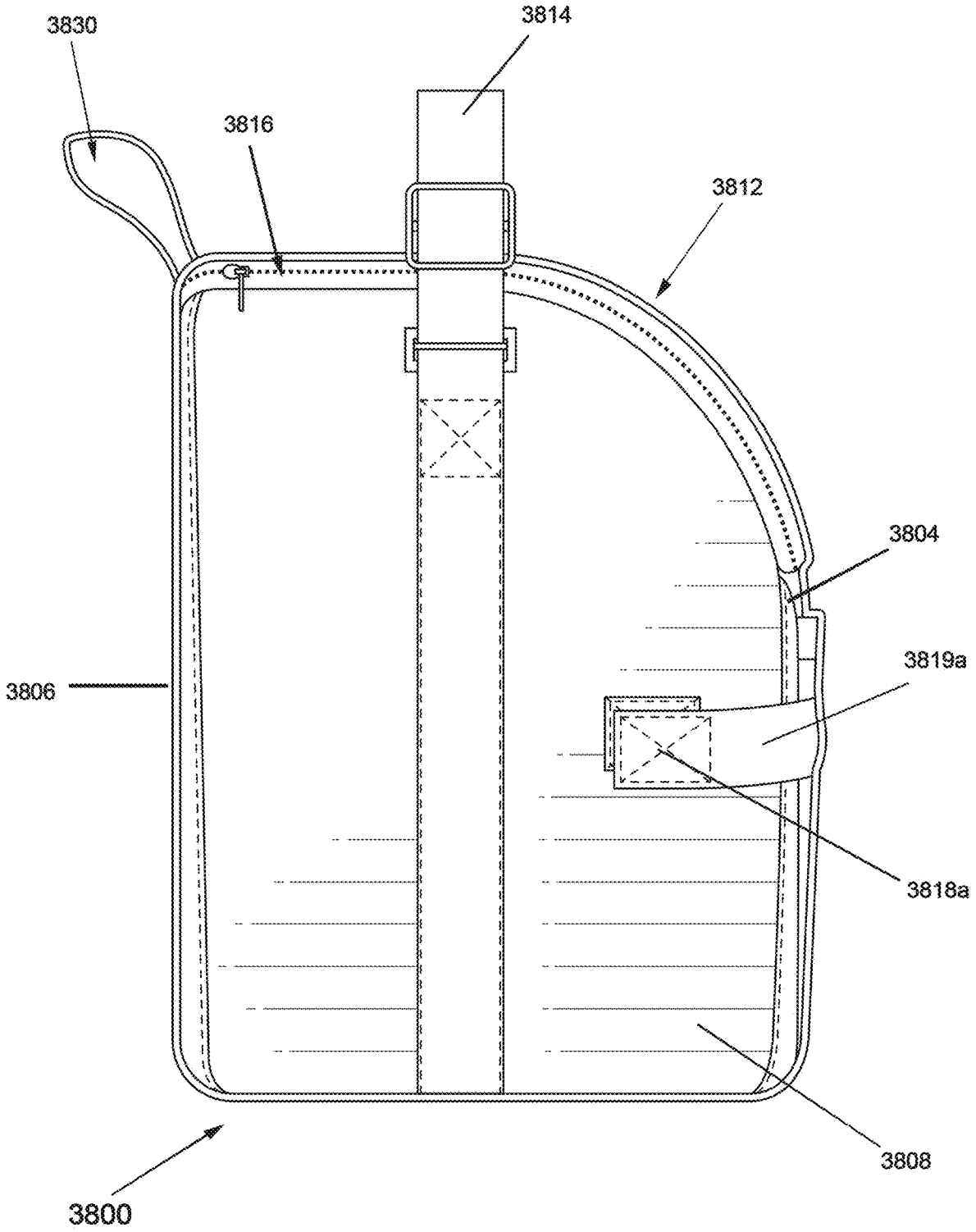
FIG. 42 is a side view of the container of FIG. 41.

As shown in FIGS. 41 and 42, in alternative embodiments, the front wall 3804 and the rear wall 3806 may be of different heights. In such embodiments, the lid 3812 may be curved to allow the container 3800 to be sealed.

As with container 1100 (discussed above), in an embodiment, the container 3800 is insulated so as to maintain the temperature of the items stored or transported within the container 3800.

Insulated Tote Container

Figure 43:
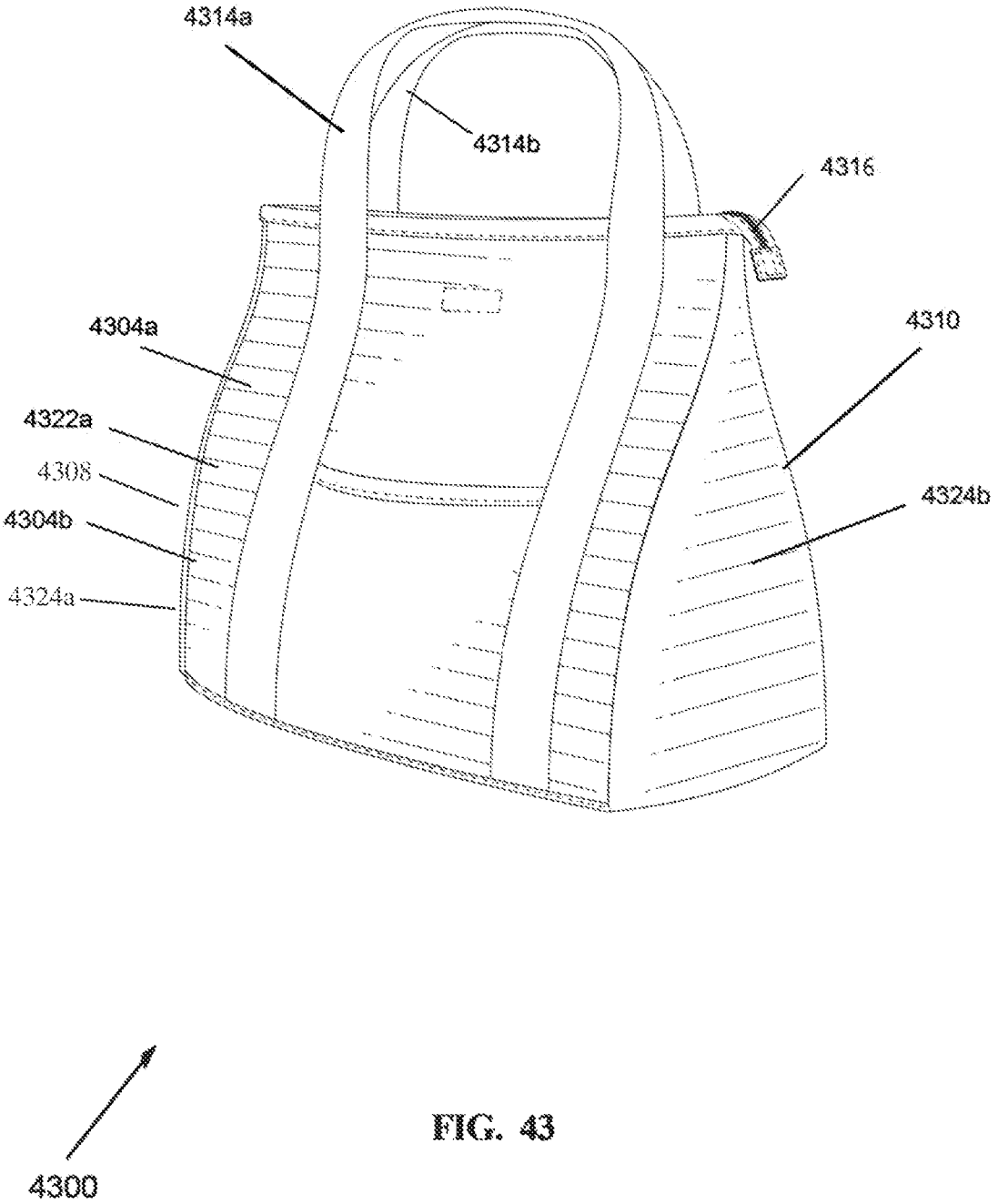
FIG. 43 is a perspective view of a sixth embodiment of a delivery container.
Figure 44:
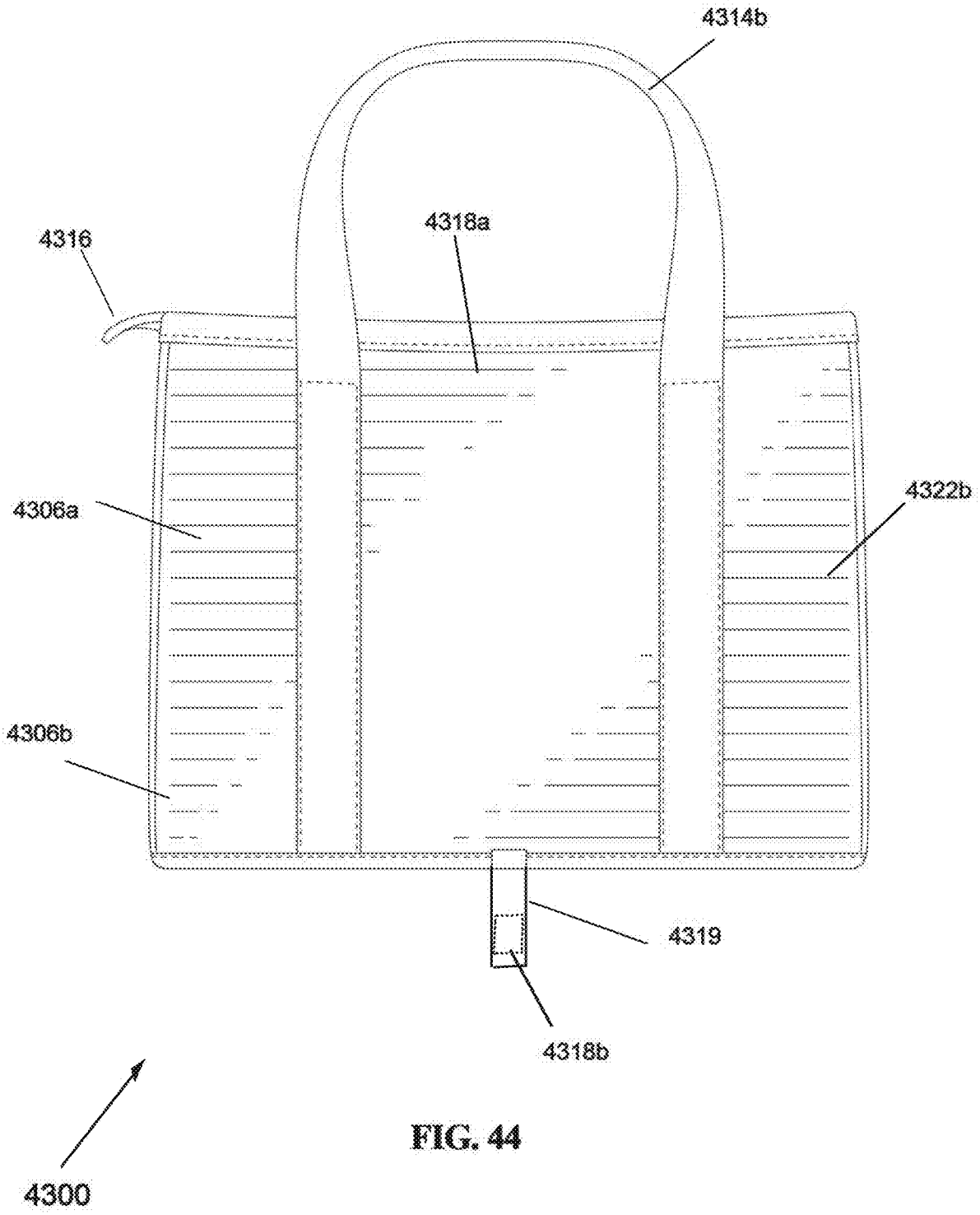
FIG. 44 is a rear view of the container of FIG. 43.
Figure 45:
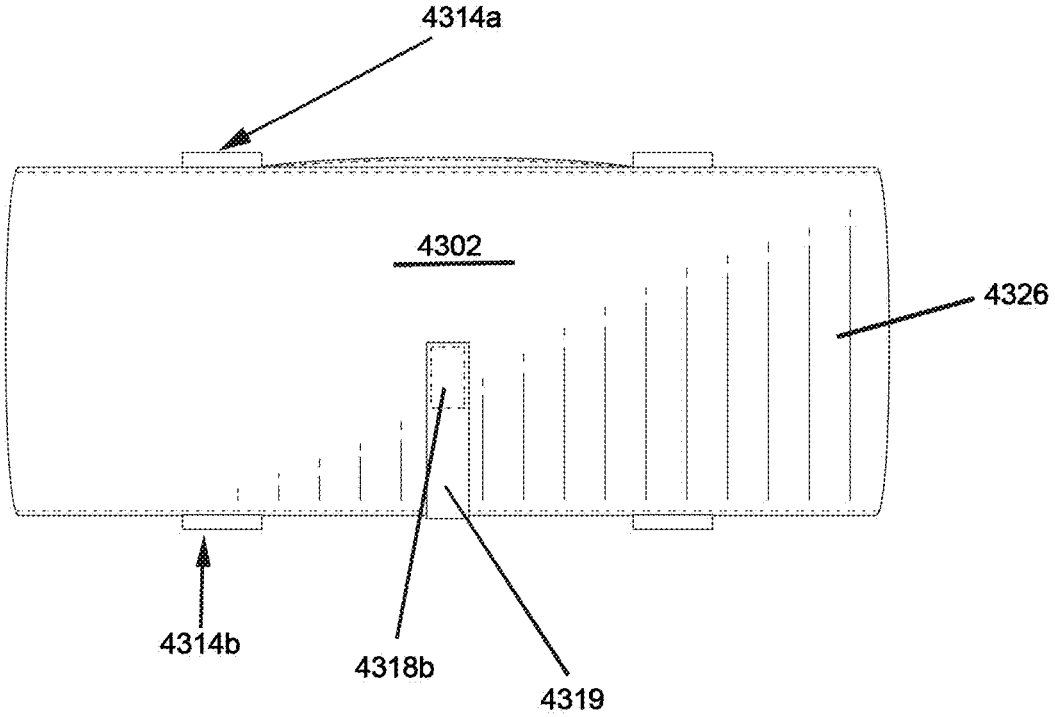
FIG. 45 is a bottom view of the container of FIG. 43.

FIGS. 43 through 45 illustrate a sixth embodiment of a delivery container 4300 that is generally similar in structure to delivery container 100 but with several notable distinctions. As shown, the container 4300 generally comprises a rectangular structure having a base panel 4302, a front wall 4304*a*, 4304*b*, a rear wall 4306*a*, 4306*b*, and opposite side walls 4308, 4310, which together define a cavity which receives items to be transported or stored in the container 4300. The upper portion of the front wall 4304*a* is separated from the lower portion of the front wall 4304*b*, just as the upper portion of the rear wall 4306*a* is separated from the lower portion of the rear wall 4306*b*. An attachment mechanism such as a zipper 4316 detachably connects the upper portion of the front wall 4304*a* and the upper portion of the rear wall 4306*a* together so as to seal the cavity of the container 4300 (thereby restraining any items placed therein within the container 4300).

As shown, in embodiments, the container 4300 is collapsible to permit the container 4300 to be easily transported or stored while empty. As shown, vertical creases 4324*a*, 4324*b* extend along the side walls 4308, 4310 from proximate the base panel 4302 to the junction between the upper portion of the front wall 4304*a* and the upper portion of the rear wall 4306*a*. Horizontal seams 4322*a*, 4322*b* extend the width of the front wall 4304*a*, 4304*b* and the rear wall 4306*a*, 4306*b*, respectively. The base panel 4302 also includes one or more creases 4326 to facilitate folding the base panel 4302. To collapse the container 4300, the base panel 4302 then folds into the container 4300 along the creases 4326, while the side walls 4308, 4310 fold into the container 4300 along the creases 4324*a*, 4324*b* such that the front wall 4304*a*, 4304*b* moves towards the rear wall 4306*a*, 4306*b*. The front wall 4304*a*, 4304*b* and the rear wall 4306*a*, 4306*b* fold along the respective creases 4322*a*, 4322*b* such that the upper portion of the front wall 4304*a* moves toward the lower portion of the front wall 4304*b*, or, in an alternative embodiment, such that the upper portion of the rear wall 4306*a* moves toward the lower portion of the rear wall 4306*b*.

The container 4300 is secured in the collapsed configuration using one or more corresponding hook-and-loop fasteners or the like 4318*a*, 4318*b*, which are attached to the upper portion of the rear wall 4306*a* and the lower portion of the rear wall 4306*b*, respectively, by a strap 4319.

A pair of handles 4314*a*, 4314*b* are attached to the front wall 4304*a*, 4303*b*, the rear wall 4306*a*, 4306*b* and, optionally, the base panel 4302. In use, the handles 4314*a*, 4314*b* extend above the container 4300 and may be used to carry the container 4300.

As with container 1100 (discussed above), in an embodiment, the container 4300 is insulated so as to maintain the temperature of the items stored or transported within the container 4300.

Insulated Erected Container

Figure 46:
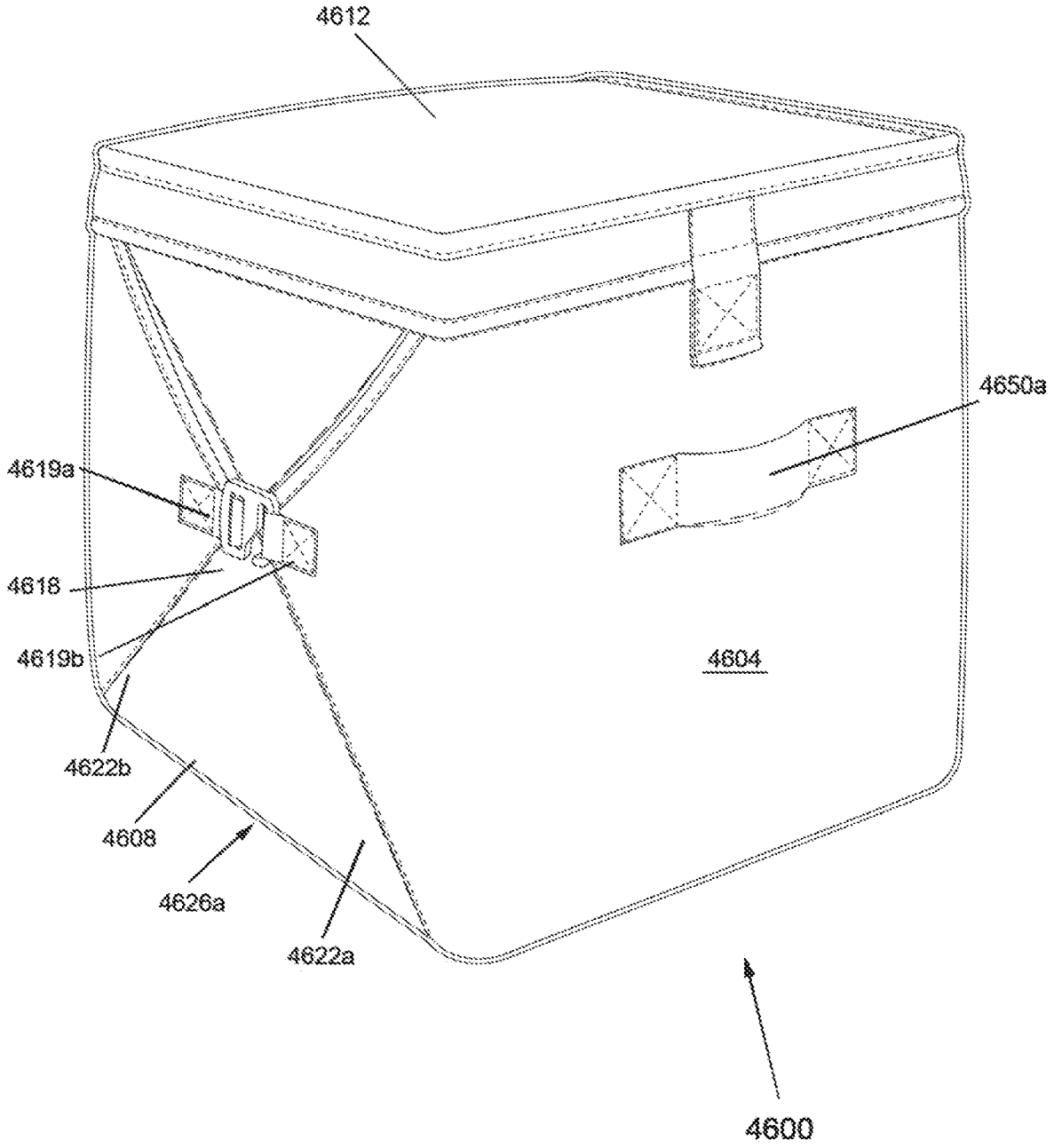
FIG. 46 is a perspective view of a seventh embodiment of a delivery container.
Figure 47:
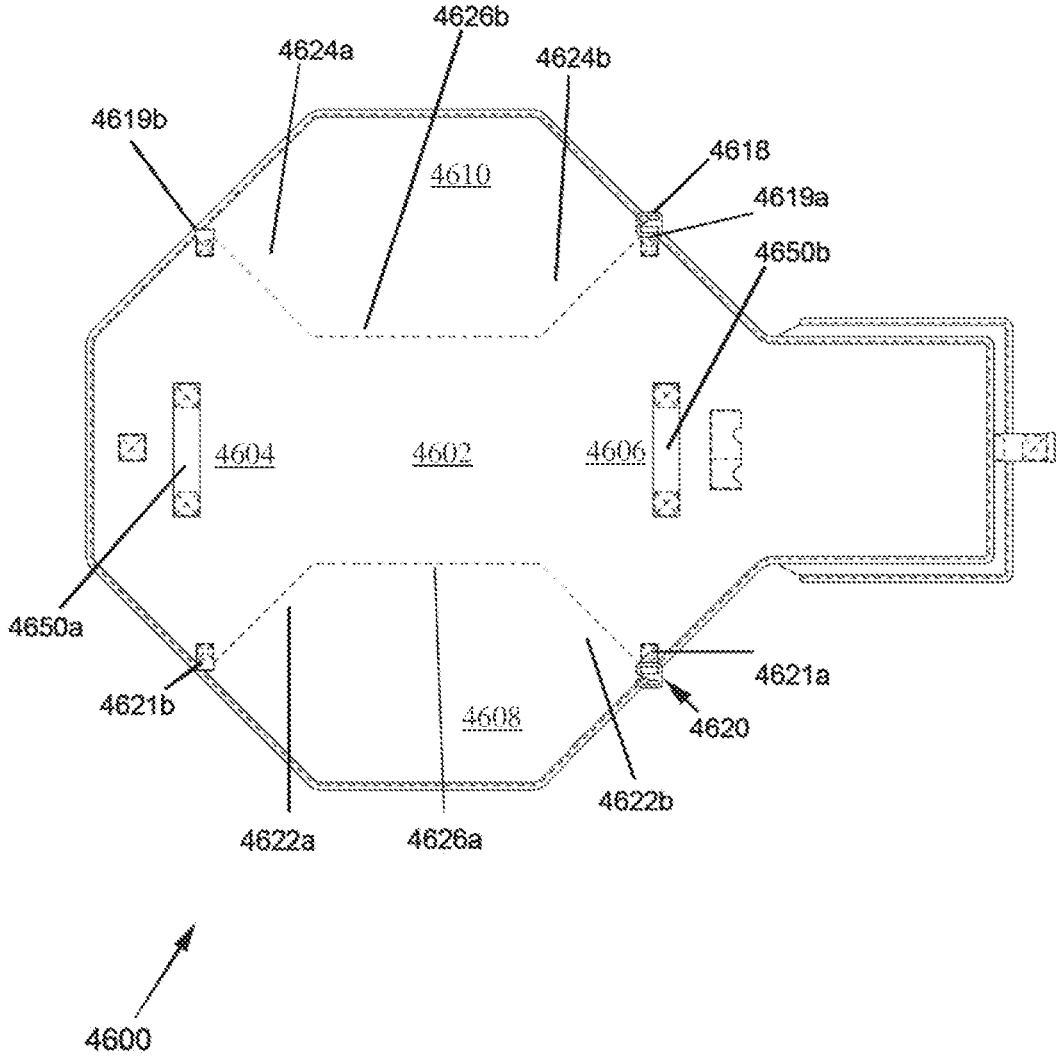
FIG. 47 is a bottom view of the container of FIG. 46 with the container fully collapsed.

FIGS. 46 and 47 illustrate a seventh embodiment of a delivery container 4600 that is generally similar in structure to delivery container 100 but with several notable distinctions. As shown, the container 4600 generally comprises a rectangular structure having a base panel 4602, a front wall 4604, a rear wall 4606, opposite side walls 4608, 4610, and a lid 4612, which together define a cavity which receives items to be transported or stored in the container 4600. The container 4600 is secured in the erected configuration using clips 4618, 4620, which are attached to the side walls 4608, 4610 by straps 4619*a*, 4619*b*, 4621*a*, and 4621*b*. In alternative embodiments, other fasteners are used, such as hook-and-loop fasteners.

As shown, in embodiments, the container 4600 is collapsible to permit the container 4600 to be easily transported or stored while empty. As shown, diagonal creases 4622*a*, 4622*b*, 4624*a*, 4624*b* extend along the side walls 4608, 4610 from proximate the base panel 4602 to the straps 4619*a*, 4619*b*, 4621*a*, and 4621*b*. Horizontal seams 4626*a*, 4626*b* extend the width of the side walls 4608, 4610 along the base panel 4602. To erect the container 4600, the side walls 4608, 4610 are folded along the diagonal creases 4622*a*, 4622*b*, 4624*a*, 4624*b* and the horizontal seams 4626*a*, 4626*b* such that the respective clips 4618, 4620 may be fastened.

Hand grips 4650*a*, 4650*b* are attached to the front wall 4604 and the rear wall 4606 and may be used to carry the container 4600. In alternative embodiments, other means of carrying the container 4600 may be employed, such as by hand grips attached to the opposing side walls 4608, 4610 or by one or more straps secured to one or more of the walls of the container 4600 extending over the lid 4612 of the container 4600.

As with container 1100 (discussed above), in an embodiment, the container 4600 is insulated so as to maintain the temperature of the items stored or transported within the container 4600.

Insulated Secure Container

FIGS. 50A and 51A illustrate an eighth embodiment of a delivery container 5000 that is generally similar in structure to delivery container 100 but with several notable distinctions. As shown, the container 5000 generally comprises a rectangular structure having a base panel 5002, a front wall 5004, a rear wall 5006, opposite side walls 5008, 5010, and a lid 5012, which together define a cavity which receives items to be transported or stored in the container 5000.

In other embodiments (not shown), the container 5000 may take other shapes. By way of example and not of limitation, in other embodiments, the container 5000 may have a greater or lesser number of walls (e.g., being cylindrical in shape and having only a single side wall, or being polyhedral and having additional walls).

As shown, the lid 5012 is movably attached to the rear wall 5006 such that the lid 5012 may be folded away from the side walls 5008, 5010 and the front wall 5004 to permit access to the cavity within the container. In the embodiment shown, the lid 5012 may be folded flush against the rear wall 5006 such that the top surface of the lid 5012 is proximate the exterior surface of the rear wall 5006. In this manner, when opened, the lid 5012 does not block access to the cavity within the container. Advantageously, this structure ensures that the distance that must be traveled by air outside the container 5000 in order to come into contact with the interior of the container 5000 (particularly the interior of the rear wall 5006) is minimized when the lid 5012 is opened. As a result, the time required to cool the interior of the container (e.g., to freeze gel packs or other freezable medium contained in one or more of the walls of the container, as discussed below) is substantially reduced as opposed to alternative designs, wherein the lid blocks at least a portion of the opening while in an open position. In alternative embodiments, the lid 5012 may be attached to a different one of the walls 5004, 5006, 5008, 5010 or may be removably attached to multiple of the walls 5004, 5006, 5008, 5010.

In an embodiment, a flap or lip 5022 extends from the lid 5012 towards the base panel 5002 such that the flap 5022 overlaps the portion of the side walls 5008, 5010 and the front wall 5004 proximate the lid 5012. As shown, the flap 5022 comprises a front lip 5022*a* that overlaps the front wall 5004 and a pair of side lips 5022*b*, 5022*c* that each overlap a respective one of the side walls 5008, 5010. In embodiments where the lid 5012 is not attached to the rear wall 5006 along the entirety of the top edge of the rear wall 5006, the flap may further comprise one or more rear lips (not shown) that each overlap at least a portion of the rear wall 5006 where the lid 5012 is not connected to the rear wall 5006. In an embodiment, as shown in FIGS. 50*a* and 51*a*, a fastener 5062*a*, 5062*b* comprise one or more elements may be used to removably attach the lid 5012 to one or more of the walls 5004, 5008, 5010 so as to prevent the lid 5012 from being inadvertently lifted while the container 5000 is in use (e.g., while the container 5000 is being used to store or transport items). In embodiments, each fastener 5062*a*, 5062*b* may comprise pairs of magnets, a hook-and-loop fastener, a pair of clips, cooperative buttons, interlocking elements, a string tied to a corresponding projection, or the like. One portion of the fastener 5062*a* is attached to the lid 5012, while a second portion of the fastener 5062*b* is attached to one of the walls 5004, 5006, 5008. As shown in FIGS. 50*a* and 51*a*, said fastener may be pairs of corresponding magnets 5062*a*, 5062*b* positioned on the side lips 5022*b*, 5022*c* of the lid 5012 and on corresponding side walls 5008, 5010 proximate the opening so as to allow the lid 5012 to be detachably secured to the side walls 5008, 5010. In the embodiment shown, the magnets 5062*a*, 5062*b* pull the side walls 5008, 5010 flush against the flap 5022 when the lid 5012 is closed, thereby forming a seal that better resists the flow of air from outside the container 5000 to the cavity of the container 5000. This design improves the insulating properties of the container 5000, allowing items kept in the container 5000 to maintain a desired temperature for a greater duration of time regardless of the temperature outside the container 5000.

Figure 52:
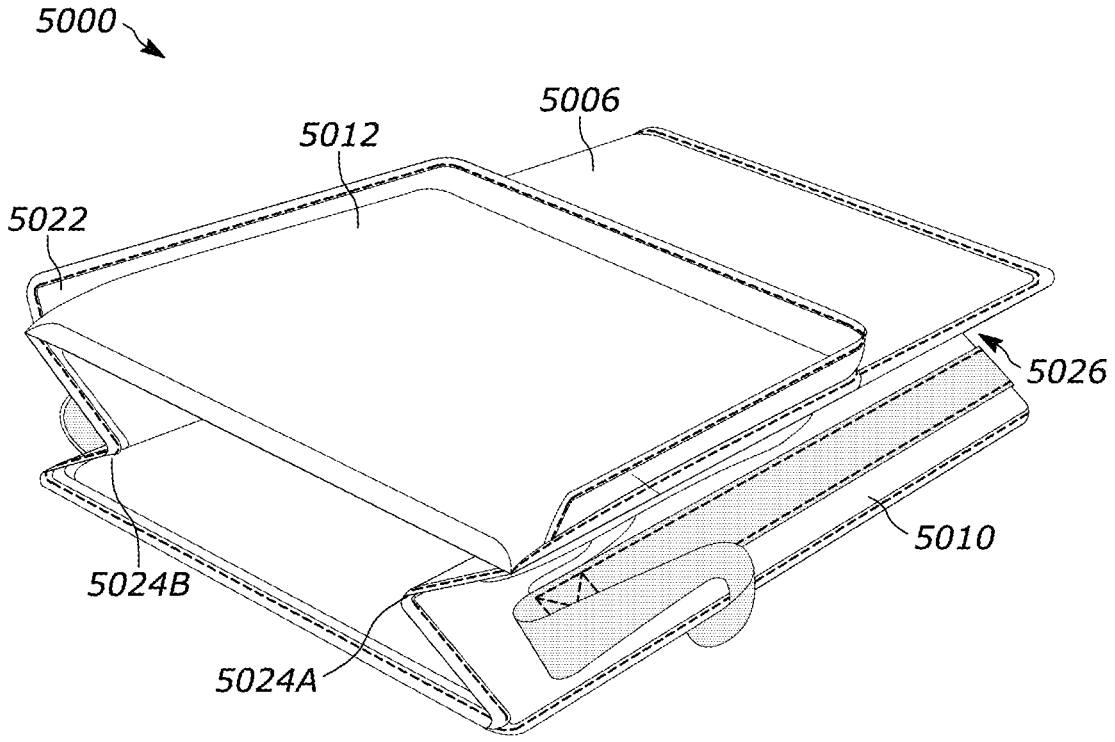
FIG. 52 is a perspective view of the container of FIG. 50*a* with the container completely folded.
Figure 53:
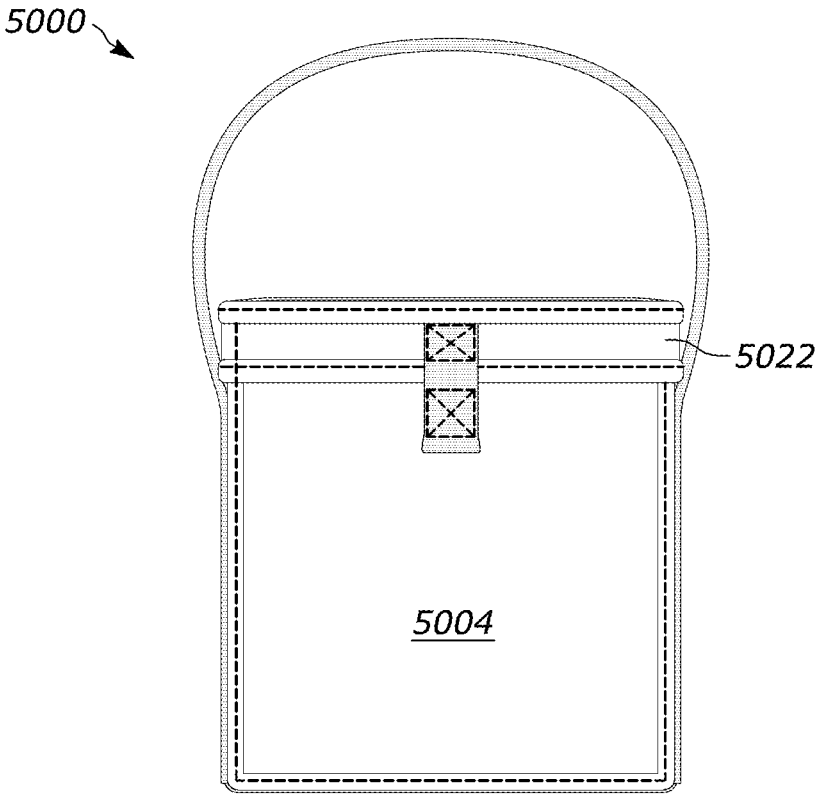
FIG. 53 is a front view of the container of FIG. 50*a*.
Figure 54:
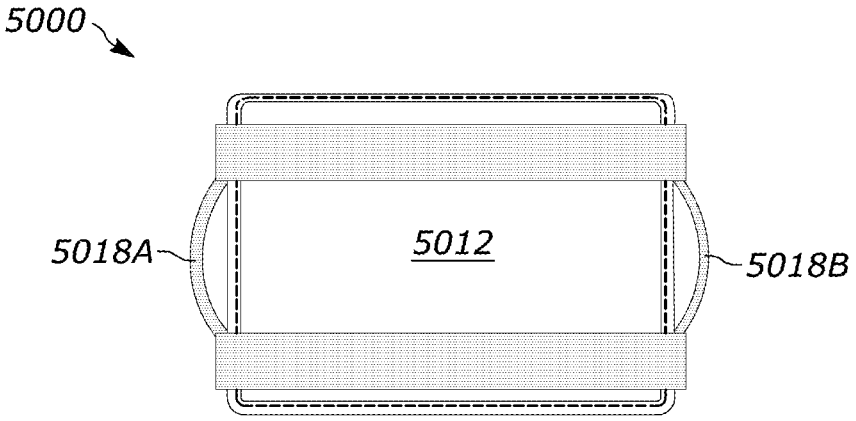
FIG. 54 is a top view of the container of FIG. 50*a*.
Figure 55:
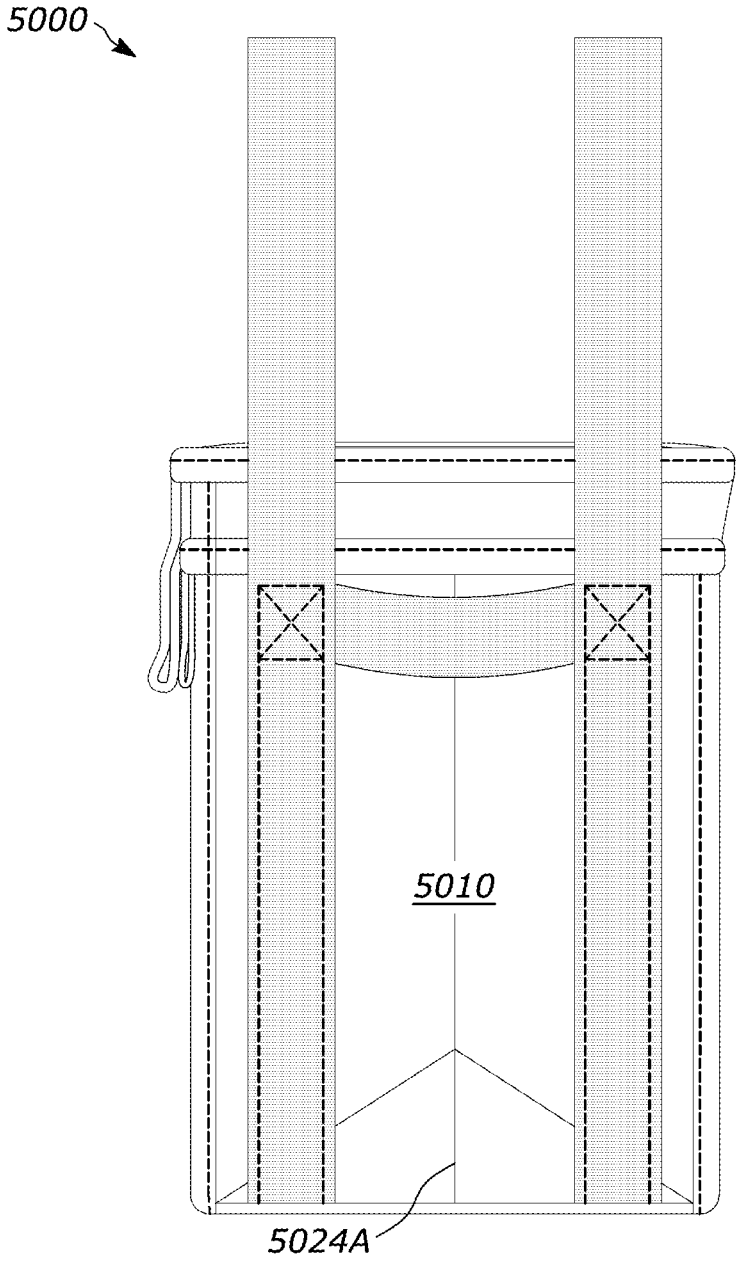
FIG. 55 is a side view of the container of FIG. 50*a*.
Figure 56:
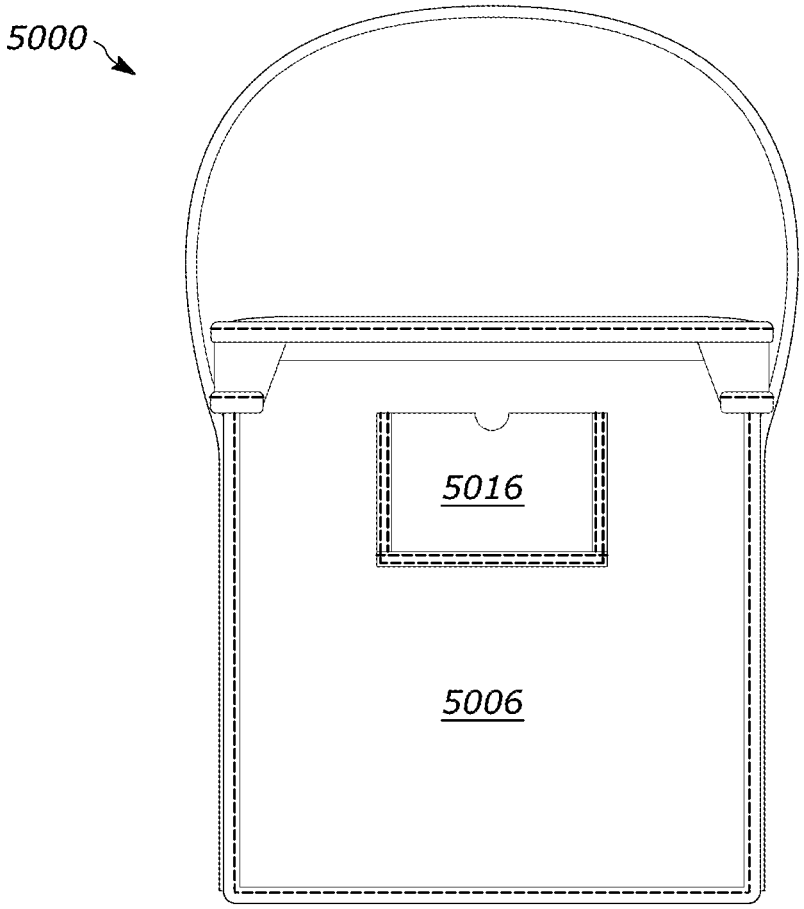
FIG. 56 is a rear view of the container of FIG. 50*a*.
Figure 57:
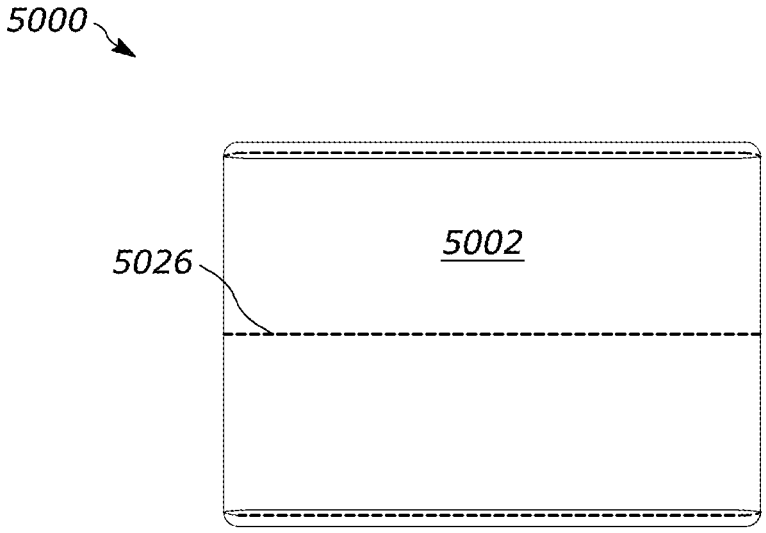
FIG. 57 is a bottom view of the container of FIG. 50*a*.
Figures 58A, 58B, 58C, 58D, 58E, 58F, 58G:
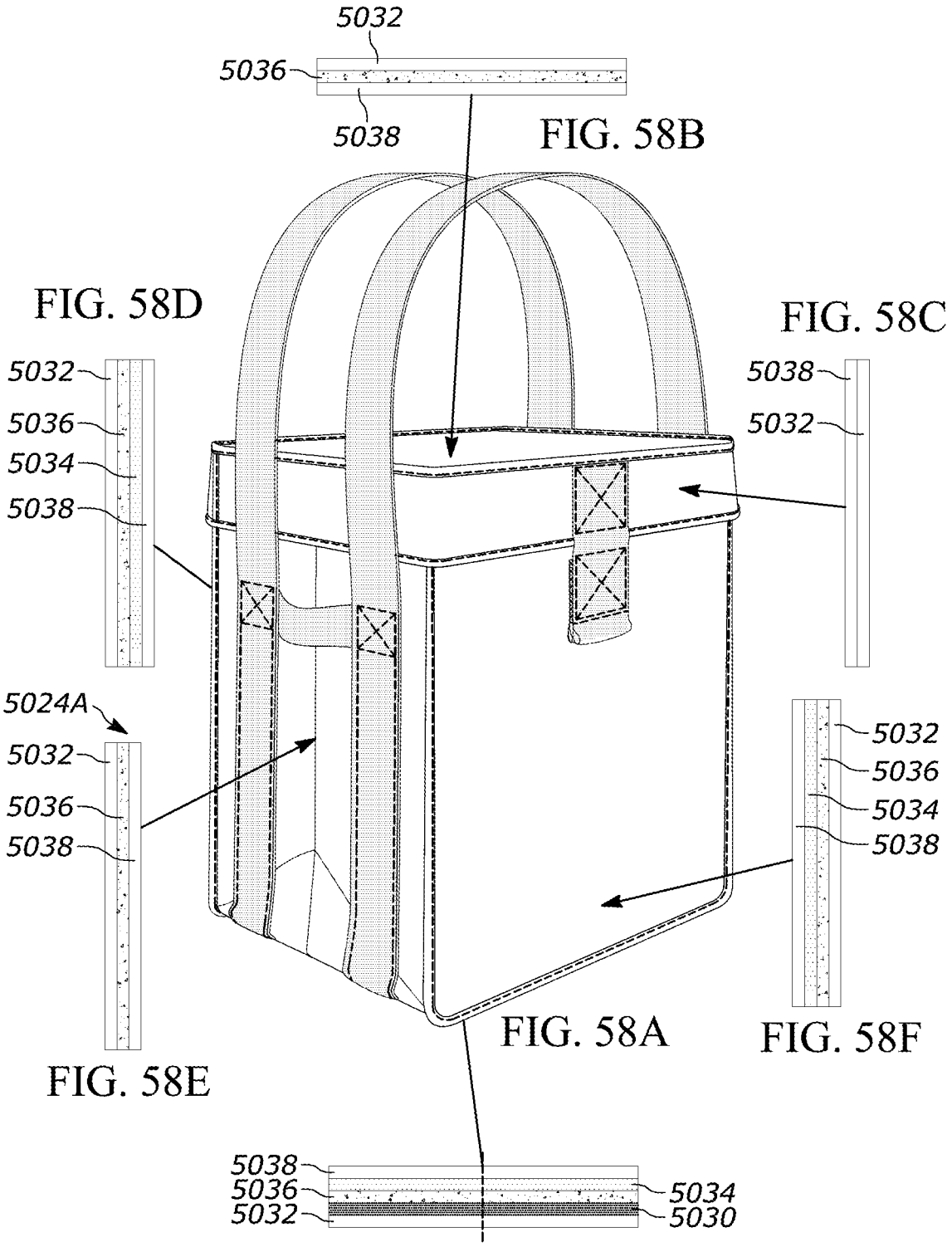
FIG. 58*a* is a perspective view of an alternative embodiment of the container of FIG. 50*a*.
FIG. 58*b* is a cross-sectional view of the lid of FIG. 58*a*.
FIG. 58*c* is a cross-sectional view of the flap of FIG. 58*a*.
FIG. 58*d* is a cross-sectional view of the rear wall of FIG. 58*a*.
FIG. 58*e* is a cross-sectional view of the side walls of FIG. 58*a*.
FIG. 58*f* is a cross-sectional view of the front wall of FIG. 58*a*.
FIG. 58*g* is a cross-sectional view of the base panel of FIG. 58*a*.
Figure 59:
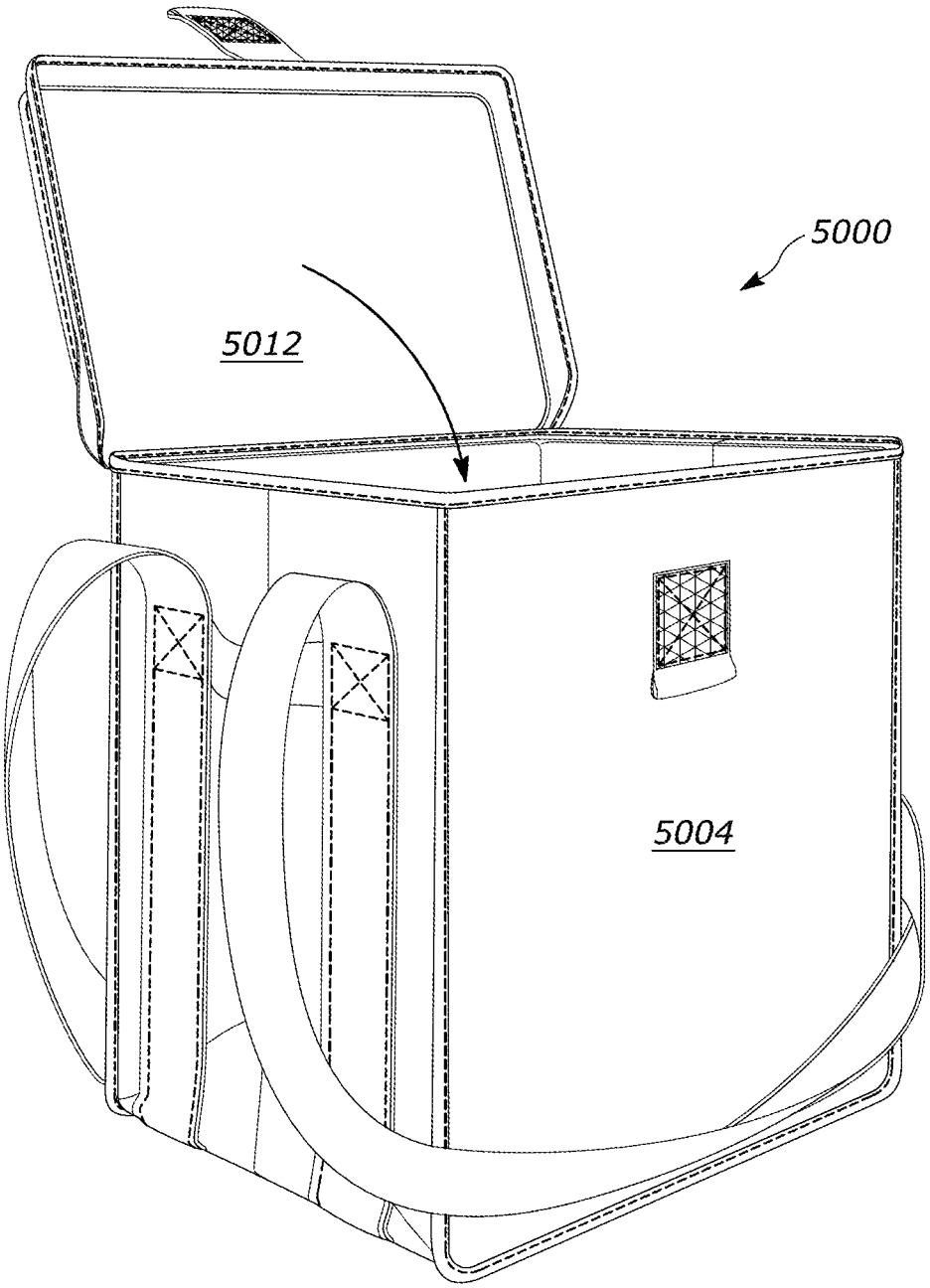
FIG. 59 is a perspective view of the container of FIG. 58*a* with the lid open.
Figures 60A, 60B, 60C, 60D, 60E, 60F, 60G:
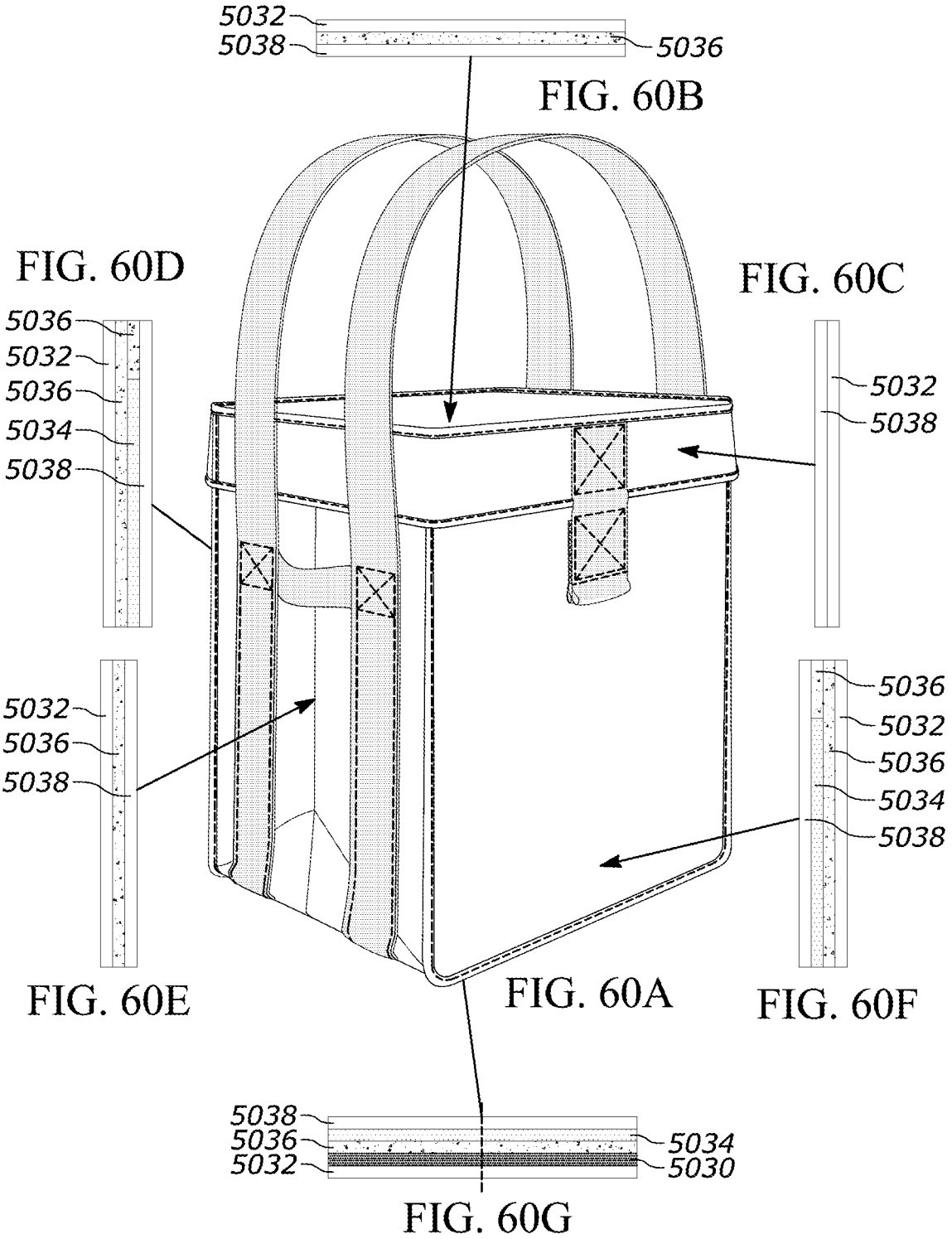
FIG. 60*a* is a perspective view of an alternative embodiment of the container of FIG. 50*a*.
FIG. 60*b* is a cross-sectional view of the lid of FIG. 60*a*.
FIG. 60*c* is a cross-sectional view of the flap of FIG. 60*a*.
FIG. 60*d* is a cross-sectional view of the rear wall of FIG. 60*a*.
FIG. 60*e* is a cross-sectional view of the side walls of FIG. 60*a*.
FIG. 60*f* is a cross-sectional view of the front wall of FIG. 60*a*.
FIG. 60*g* is a cross-sectional view of the base panel of FIG. 60*a*.
Figures 61A, 61B, 61C, 61D, 61E, 61F, 61G:
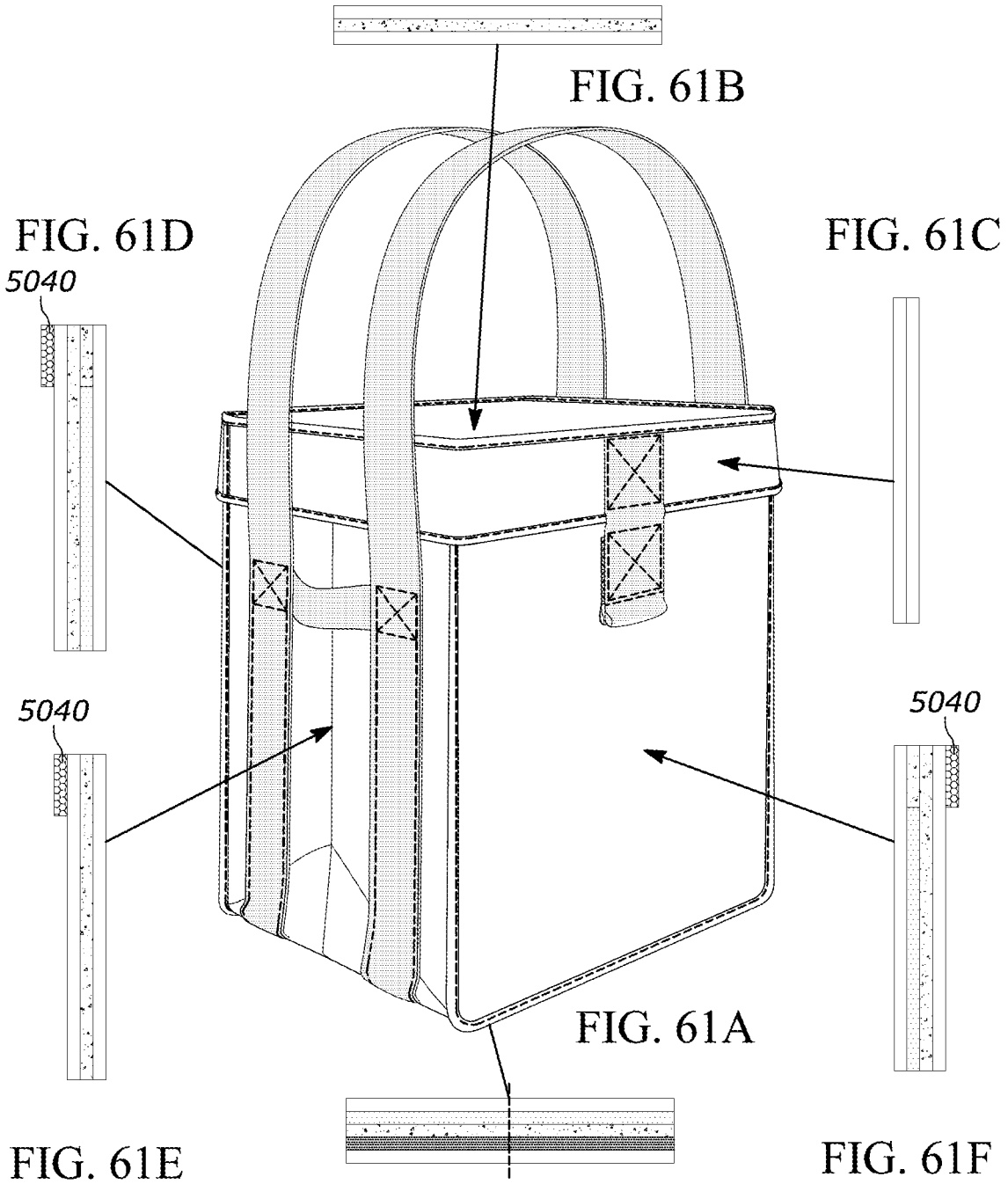
FIG. 61*a* is a perspective view of an alternative embodiment of the container of FIG. 60*a*.
FIG. 61*b* is a cross-sectional view of the lid of FIG. 61*a*.
FIG. 61*c* is a cross-sectional view of the flap of FIG. 61*a*.
FIG. 61*d* is a cross-sectional view of the rear wall of FIG. 61*a*.
FIG. 61*e* is a cross-sectional view of the side walls of FIG. 61*a*.
FIG. 61*f* is a cross-sectional view of the front wall of FIG. 61*a*.
FIG. 61*g* is a cross-sectional view of the base panel of FIG. 61*a*.
Figure 62:
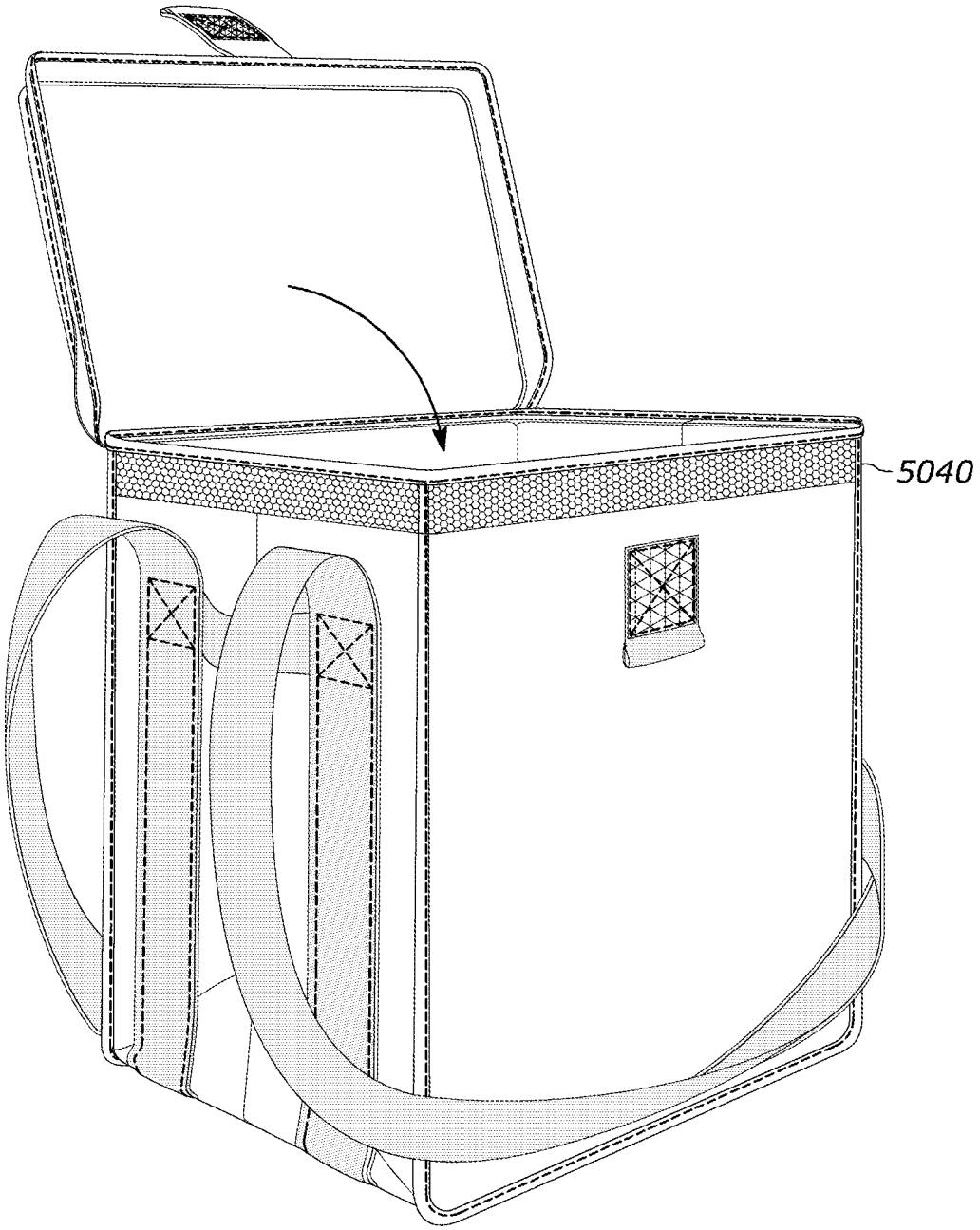
FIG. 62 is a perspective view of the container of FIG. 61*a* with the lid open.
Figures 63A, 63B, 63C, 63D, 63E, 63F, 63G:
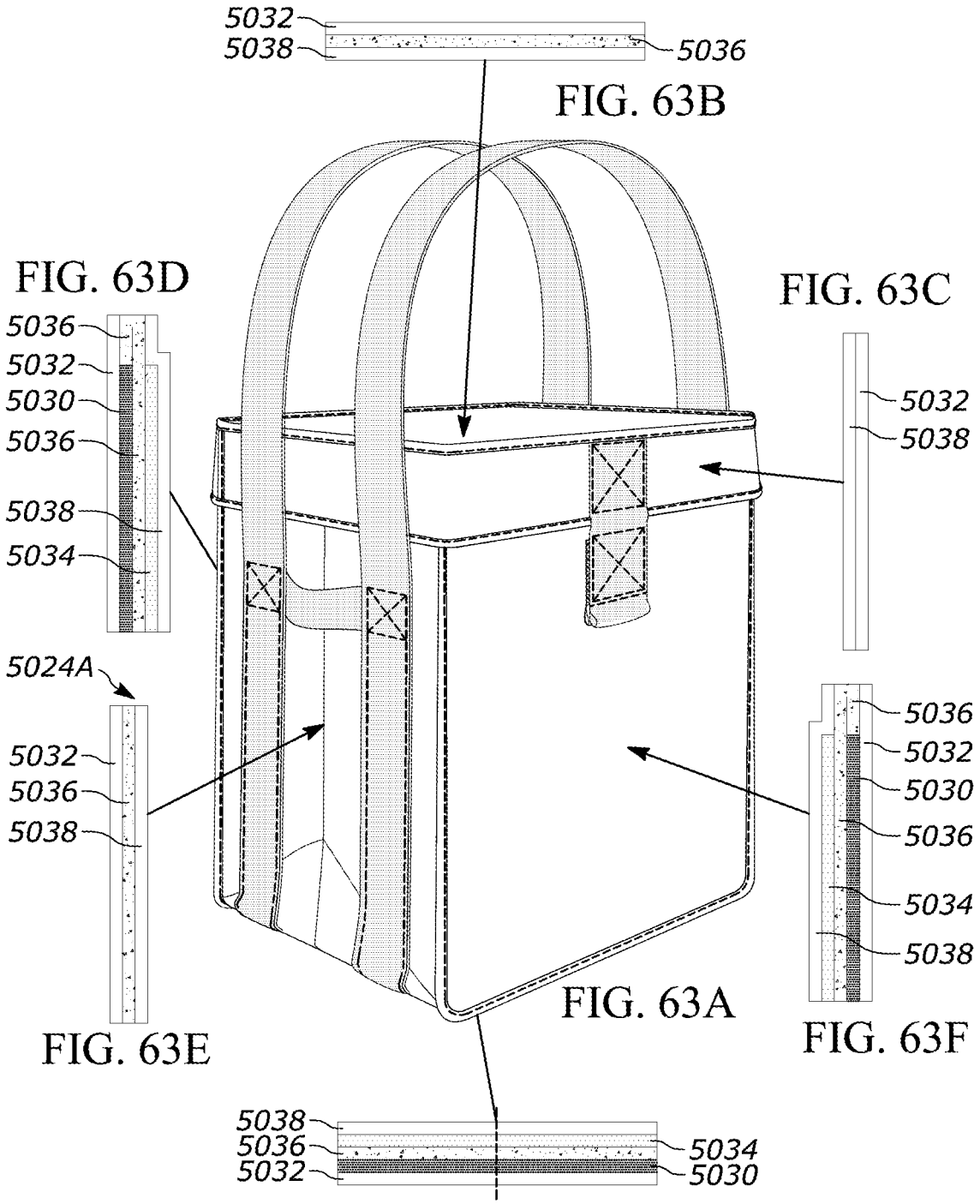
FIG. 63*a* is a perspective view of an alternative embodiment of the container of FIG. 50*a*.
FIG. 63*b* is a cross-sectional view of the lid of FIG. 63*a*.
FIG. 63*c* is a cross-sectional view of the flap of FIG. 63*a*.
FIG. 63*d* is a cross-sectional view of the rear wall of FIG. 63*a*.
FIG. 63*e* is a cross-sectional view of the side walls of FIG. 63*a*.
FIG. 63*f* is a cross-sectional view of the front wall of FIG. 63*a*.
FIG. 63*g* is a cross-sectional view of the base panel of FIG. 63*a*.
Figures 64A, 64B, 64C, 64D, 64E, 64F, 64G:
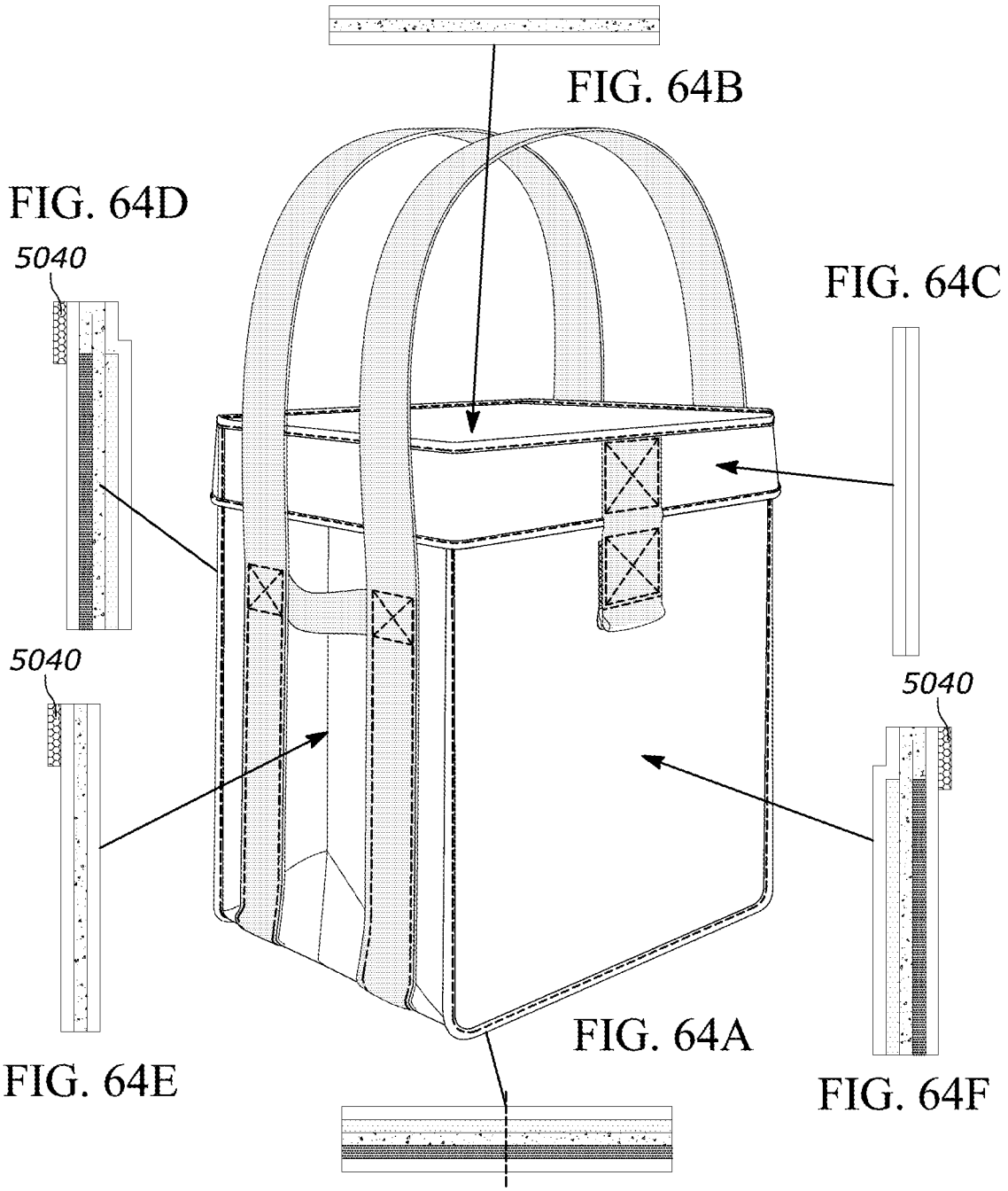
FIG. 64*a* is a perspective view of an alternative embodiment of the container of FIG. 63*a*.
FIG. 64*b* is a cross-sectional view of the lid of FIG. 64*a*.
FIG. 64*c* is a cross-sectional view of the flap of FIG. 64*a*.
FIG. 64*d* is a cross-sectional view of the rear wall of FIG. 64*a*.
FIG. 64*e* is a cross-sectional view of the side walls of FIG. 64*a*.
FIG. 64*f* is a cross-sectional view of the front wall of FIG. 64*a*.
FIG. 64*g* is a cross-sectional view of the base panel of FIG. 64*a*.
Figure 65G:
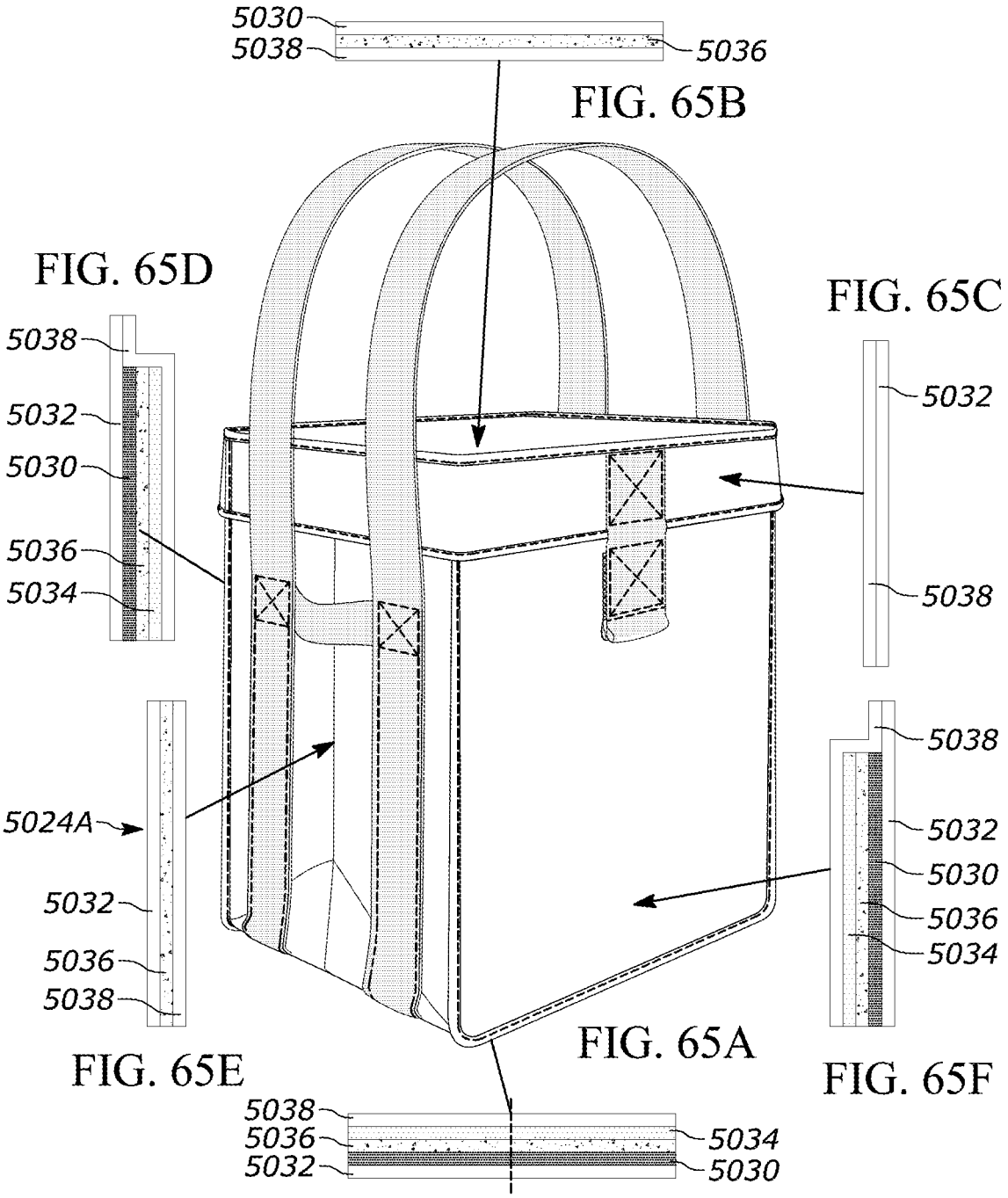
FIG. 65*g* is a cross-sectional view of the base panel of FIG. 65*a*.
Figures 6F, 66A, 66B, 66C, 66D, 66E, 66G:
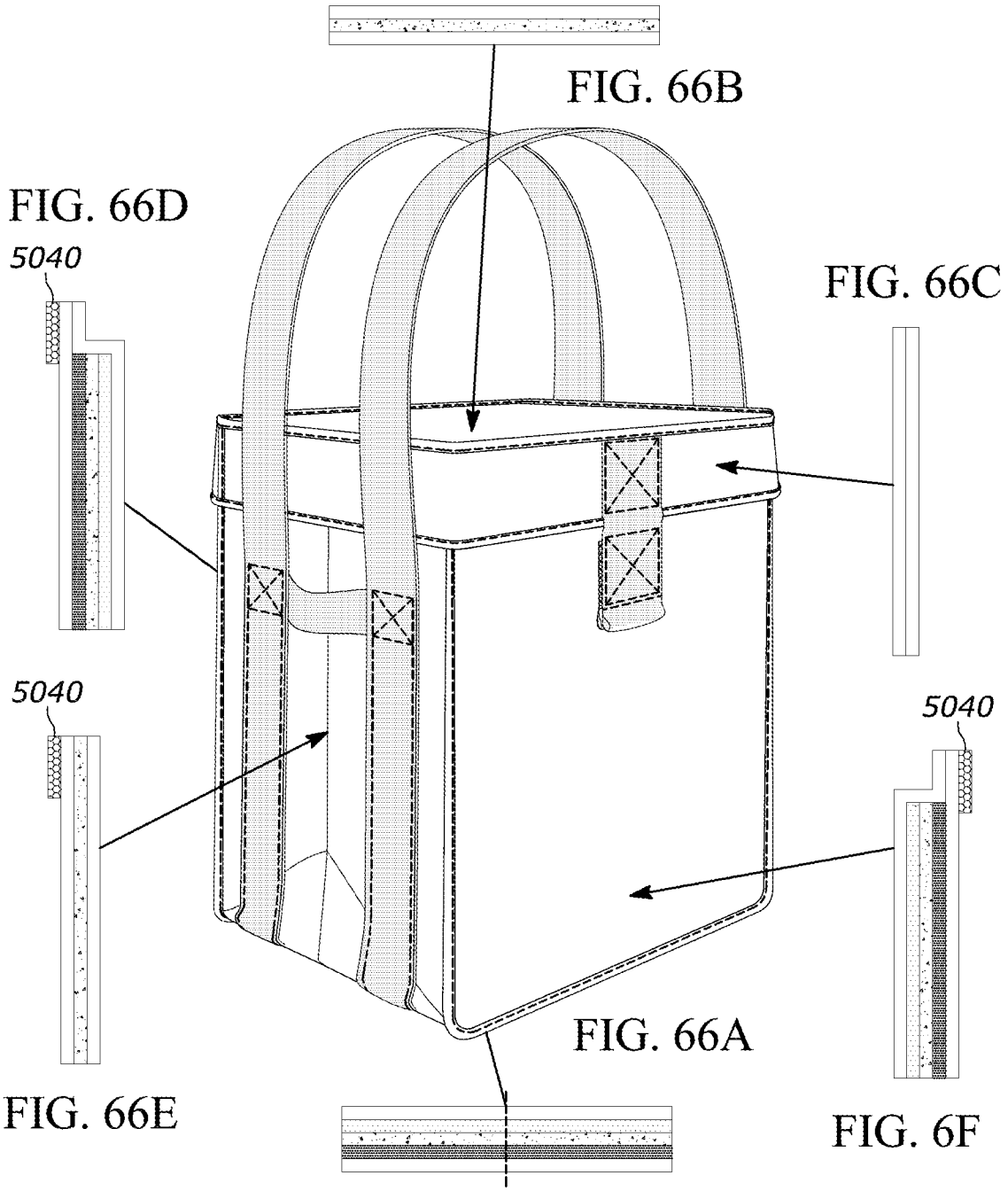
FIG. 66*a* is a perspective view of an alternative embodiment of the container of FIG. 65*a*.
FIG. 66*b* is a cross-sectional view of the lid of FIG. 66*a*.
FIG. 66*c* is a cross-sectional view of the flap of FIG. 66*a*.
FIG. 66*d* is a cross-sectional view of the rear wall of FIG. 66*a*.
FIG. 66*e* is a cross-sectional view of the side walls of FIG. 66*a*.
FIG. 66*g* is a cross-sectional view of the base panel of FIG. 66*a*.

As shown in FIGS. 52, 71, and 72, in embodiments the container 5000 is collapsible to permit the container 5000 to be easily transported or stored while empty. As shown, vertical creases 5024*a*, 5024*b* extend along the side walls 5008, 5010 from proximate the base panel 5002 to proximate the front wall 5004 to facilitate folding of the side walls 5008, 5010 when the container 5000 is collapsed. The base panel 5002 also includes one or more creases 5026 to facilitate folding the base panel 5002. To collapse the container 5000, the base panel 5002 folds into the container 5000 along the creases 5026 while the side walls 5008, 5010 fold into the container 5000 along creases 5024*a*, 5024*b* such that the front wall 5004 moves towards the rear wall 5006. In an embodiment, once the container 5000 is collapsed, the lid 5012, attached to the rear wall 5006, folds so that the top of the lid 5012 is nearer to the rear wall 5006 of the container 5000, thereby allowing airflow through the opening of the container 5000 into the cavity when the container 5000 is collapsed.

In an embodiment, at least a portion of the container 5000 is insulated so as to maintain the temperature of the items stored or transported within the container. In the embodiment shown, the entirety of the container 5000 comprises an exterior layer 5032 and an interior layer 5038. As shown in cross-sectional FIG. 50B (not to scale), the flap 5022 comprises one or more magnets 5062*b* located between the interior layer 5038 and the exterior layer 5032. In the embodiment shown, the interior layer 5038 of the flap 5022 comprises the same material as the exterior layer 5032. In an alternative embodiment (not shown), the lid 5012 further comprises a layer of insulation and/or a support member or stiffener located between the interior layer 5038 and the exterior layer 5032 on at least a portion of the top surface of the lid 5012, the flap 5022, or both. As shown in cross-sectional FIG. 50C (not to scale), the side walls 5008, 5010 each comprise an interior layer 5038, a layer of insulation 5036, and an exterior layer 5032. One or more magnets 5062*a* are located proximate the opening of the container 5000 between the exterior layer 5032 and the layer of insulation 5036.

As shown in cross-sectional FIG. 51C (not to scale), when the lid 5012 is in the closed position, the magnets 5062*a*, 5062*b* are proximate one another and press the exterior layer 5032 of the sidewalls 5008, 5010 against the interior layer 5038 of the flap 5022, thereby decreasing the rate at which air outside the container 5000 may enter the cavity. As shown in cross-sectional view 51*d* (not to scale), the front wall 5004 comprises an interior layer 5038, a freezable medium 5034 such as a gel pack, a layer of insulation 5036, a stiffener or support member 5030, and an exterior layer 5032. The rear wall 5006 may comprise substantially the same layers as the front wall 5004.

In the embodiment shown, a loop 5072 formed from a strap 5001 is connected to the exterior surface of the front wall 5004 proximate the opening of the container 5000. A corresponding loop 5070 extends from a second strap 5003 connected to the front lip 5022*a* of the flap 5022 and is located such that when the lid 5012 is in the closed position, the loops 5070, 5072 are located proximate one another. A connector (such as a hook-and-loop connector) may be located on the interior surface of the lid strap 5003 and on the exterior surface of the front wall strap 5001. As discussed in greater detail below, a security element (such as a zip-tie or cable tie) may be used to securely connect the loops 5070, 5072 together, thereby securing the lid 5012 in the closed position. In an embodiment, the security element cannot be removed (and thus the container 5000 cannot be opened and the contents of the container 5000 cannot be accessed) without cutting or otherwise damaging the security element, thereby allowing a user of the container to readily determine whether the container 5000 has been opened or the contents of the container 5000 tampered with since the security element was put in place.

In an embodiment, as shown in FIGS. 58A-G, an inner middle layer 5034 comprises a material for maintaining the temperature of the cavity of the container 5000 and any items located therein (e.g., by either cooling or heating). In an embodiment, the inner middle layer 5034 comprises a gel pack comprising an outer wrapper or envelope of flexible or pliable material such as plastic film which is filled with and surrounds an insulating, nontoxic gel material, which may be any such material known to those of skill in the art, such as silica gel. The amount of fill of the gel material is such that the gel pack is substantially flattened in shape. As will be clear to one of skill in the art from the present disclosure, in alternative embodiments, the structure of the walls 5004, 5006, 5008, 5010 may be varied to either include additional layers (such as by including additional layers of insulation) or omit layers (such as by omitting the outer middle layer 5030 to provide a soft-sided container).

In an embodiment, the exterior layer 5032 comprises a protective, relatively strong and durable synthetic or natural material such as a fabric, canvas, nylon, coated polyester, or the like. In an embodiment, the exterior layer 5032 includes a reflective coating such as an aluminizing material or coating to better reflect and disperse radiation (such as light and heat) away from the container 5000. In an embodiment, the interior layer 5038 comprises a waterproof material, such as polyethylene vinyl acetate (PEVA), or a plastic foil material. In an embodiment, the layer of insulation 5036 comprises flexible insulation, such as cotton insulation, an insulating foam, or a high-density polyethylene (HDPE) foam. In an embodiment, the layer of insulation 5036 in the walls 5004, 5006, 5008, 5010 comprises a layer of insulation that is 2 centimeters thick.

In an embodiment, as shown in FIG. 58A-G, an inner middle layer 5034 comprises a material for maintaining the temperature of the cavity of the container 5000 and any items located therein (e.g., by either cooling or heating). In an embodiment, the inner middle layer 5034 comprises a gel pack comprising an outer wrapper or envelope of flexible or pliable material such as plastic film which is filled with and surrounds an insulating, nontoxic gel material, which may be any such material known to those of skill in the art, such as silica gel. The amount of fill of the gel material is such that the gel pack is substantially flattened in shape. As will be clear to one of skill in the art from the present disclosure, in alternative embodiments, the structure of the walls 5004, 5006, 5008, 5010 may be varied to either include additional layers (such as by including additional layers of insulation) or omit layers (such as by omitting the outer middle layer 5030 to provide a soft-sided container).

In an embodiment, as shown in FIGS. 60A-G and 61A-G, the middle layer 5036 comprises an additional layer of flexible insulation, nearer to the opening of the cavity of the container 5000 than the inner layer 5034 comprising a material for maintaining the temperature of the cavity of the container 5000. In some embodiments, as shown in FIGS. 61A-G, 62, 64A-G, and 66A-G, one or more of the walls 5004, 5006, 5008, 5010 of the container 5000 comprises an additional band of fabric 5040, made of mesh webbing or the like, extending along the top of each wall along the opening of the container 5000, thereby providing additional support along the opening of the cavity when the container 5000 is in use.

In an embodiment, as shown in FIGS. 63A-G and 64A-G, the middle layer 5036 comprises an additional layer of flexible insulation, nearer to the opening of the cavity of the container 5000 than an outer middle layer 5030 comprising a rigid or semirigid material, such as polyethylene (PE) board or PE-coated paperboard, to provide support for the container 5000 when in use.

In an embodiment, as shown in FIGS. 65A-G and 66A-G, each of the outer middle layer 5030, middle layer 5036, and inner middle layer 5034 does not extend to the opening of the container 5000.

In some embodiments, a tamper-resistant clasp, as shown in FIGS. 50A through 66 and 69A through 70C, comprising a mechanism such as a pair of loops or the like 5070 and 5072 where a securing mechanism such as a zip-tie, bolt, lock, or the like may be inserted into the loops as shown in FIGS. 70*b* and 70*c* and secured so as to prevent unauthorized access to the contents and notification to the user that the contents have not been tampered with.

In some embodiments, a pair of handles 5014*a*, 5014*b* are attached optionally to the opposing side walls 5008, 5010. In use, the handles 5014*a*, 5014*b* extend above the lid 5012 of the container 5000 and may be used to carry the container 5000. In addition, or alternatively, hand grips 5018*a* and 5018*b* are attached to the opposing side walls 5008, 5010 and may be used to carry the container 5000. A hand grip may also be attached to the front wall 5004 of the container 5000 for carrying the container 5000 in a collapsed configuration.

An ID card holder 5016 is optionally located on the container 5000, for example to allow for identification of the owner of the container 5000 or the contents of the container 5000. The ID card holder 5016 may comprise a clear material, such as a clear plastic, to permit writing on an object placed in the ID card holder 5016 to be clearly visible.

In an embodiment of the container 5000, as shown in FIGS. 67A-D, which comprises a different lid configuration, side flaps 6714*a*, 6714*b* extend from the opposing side walls 5008, 5010 so that they may be folded into the cavity to double the material nearest the opening of the cavity of the container 5000. Additional front and back lids 6712*a*, 6712*b* extend from the front wall 5004 and the rear wall 5006 such that when they are folded over the cavity of the container 5000, they rest on the doubled material created from the side flaps 6714*a*, 6714*b* such that they form a lid to the container 5000 and do not collapse into the cavity, as shown in FIGS. 67C and 67D. The front and back lids 6712*a*, 6712*b* each contain a latching mechanism 6716*a*, 6716*b*, such as a hook-and-loop fastener, on the interior and exterior of the lid, respectively, so as to prevent the lids 6712*a*, 6712*b* from being inadvertently lifted while the container 5000 is in use.

In an embodiment of the container 5000, as shown in FIGS. 68A-D, which comprises a different lid configuration, soft-sided gussets 6814*a*, 6814*b* extend from the opposing side walls 5008, 5010, and front and back lids 6812*a*, 6812*b* extend from the front wall 5004 and the rear wall 5006 such that when the front and back lids 6812*a*, 6812*b* are folded over the cavity, the soft-sided gussets 6814*a*, 6814*b* collapse into the cavity of the container 5000 and provide support to the front and back lids, as is shown in FIGS. 68B through 68D. Alternatively, when the front and back lids 6812*a*, 6812*b* are not folded over the cavity, the soft-sided gussets 6814*a*, 6814*b* provide tension against the front and back lids 6812*a*, 6812*b*, thereby freeing the opening of the cavity of the container 5000 while it is being filled.

It is understood that the preceding is merely a detailed description of some examples and embodiments of the present invention and that numerous changes to the disclosed embodiments may be made in accordance with the disclosure made herein without departing from the spirit or scope of the invention. The preceding description, therefore, is not meant to limit the scope of the invention but to provide sufficient disclosure to allow one of ordinary skill in the art to practice the invention without undue burden. It is further understood that the scope of the present invention fully encompasses other embodiments that may become obvious to those skilled in the art and that the scope of the present invention is accordingly limited by nothing other than the appended claims.

What is claimed is:

1. A collapsible container comprising:

a plurality of panels cooperatively assembled to define an interior cavity accessible via an opening, the plurality of panels comprising at least a base panel, a front panel opposing a rear panel, and a pair of opposing side panels;

a lid movably connected to the rear panel and configured to move between an open position proximate the rear panel and a closed position whereby the opening is obstructed, the lid further comprising a front lip and a pair of opposing side lips each extending from the lid;

wherein the container is configured to fold into a collapsed configuration by placing said lid in the open position, folding the pair of side panels into the interior cavity, and folding the base panel towards the opening;

wherein the plurality of panels each comprise an interior layer proximate the cavity, an exterior layer, and a layer of insulation therebetween; and wherein at least one of said plurality of panels further comprises a freezable gel between said interior layer and said layer of insulation and a stiffener between said freezable gel and said exterior layer.

2. The collapsible container of claim 1, wherein each of said side lips comprises at least one first closure mechanism and each of said side panels comprises at least one second closure mechanism and wherein said at least one first closure mechanism and said at least one second closure mechanism cooperatively hold said side lips proximate said side panels when the lid is in the closed position.

3. The collapsible container of claim 2, wherein said first closure mechanism is a lid magnet and said second closure mechanism is a side magnet and wherein each of said at least one side magnets is located between the exterior layer and the interior layer.

4. The collapsible container of claim 2, wherein said first closure mechanism is a lid magnet and said second closure mechanism is a side magnet and wherein each of said at least one side magnets is located proximate the exterior layer.

5. The collapsible container of claim 2, wherein said first closure mechanism and said second closure mechanism together comprise a hook and loop fastener and wherein each of said at least one first closure mechanisms is located on an interior surface of said side lips and each of said at least one second closure mechanisms is located on an exterior surface of said side opposing side panels.

6. The collapsible container of claim 1, wherein said front lip further comprises a first strap comprising a first loop and said front panel further comprises a second strap comprising a second loop, wherein when the lid is in the closed position, said first loop is proximate said second loop.

7. The collapsible container of claim 6, wherein said first strap further comprises a first portion of a hook-and-loop fastener and said second strap further comprises a second portion of said hook-and-loop fastener.

8. The collapsible container of claim 6, wherein the first loop is connected to the second loop by a third loop such the lid cannot be moved to the open position.

9. The collapsible container of claim 6, wherein a first magnet is located proximate said first strap and a second magnet is located proximate said second strap.

10. The collapsible container of claim 1, wherein said gel comprises one or more discrete gel packs.

11. The collapsible container of claim 1, wherein said exterior layer of said plurality of panels is reflective and an exterior surface of said lid is reflective.

12. The collapsible container of claim 1, wherein a carrying strap is attached to said base panel and said pair of opposing side panels and each of a pair of handle straps is attached to a respective one of said pair of opposing side panels.

13. The collapsible container of claim 1, wherein each of said opposing side panels comprises a rear angled crease extending from proximate said rear panel and said base panel to a vertical crease, and a front angled crease extending from proximate said front panel said base panel to said vertical crease, wherein said base panel comprises a horizontal crease extending between said opposing side panels, and wherein the container is configured to fold into said collapsed configuration by folding each of said opposing side panels along said respective rear angled crease, said respective vertical crease, and said respective front angled crease and folding said base panel along said horizontal crease.

14. The collapsible container of claim 1, wherein said lid is removably secured to said front wall via an attachment means.

15. The collapsible container of claim 14, wherein said attachment means is one of a hook-and-loop fastener, a zipper, a buckle-and-clasp closure, an elastic band, and a pair of magnets.

16. A collapsible container comprising:

a plurality of panels cooperatively assembled to define an interior cavity accessible via an opening, the plurality of panels comprising at least a base panel, a front panel opposing a rear panel, and a pair of opposing side panels;

a lid movably connected to the rear panel and configured to move between an open position proximate the rear panel and a closed position whereby the opening is obstructed, the lid further comprising a front lip and a pair of opposing side lips each extending from the lid;

wherein the container is configured to fold into a collapsed configuration by placing said lid in the open position, folding the pair of side panels into the interior cavity, and folding the base panel towards the opening;

wherein the plurality of panels each comprise an interior layer proximate the cavity, an exterior layer, and a layer of insulation therebetween; and wherein said base panel, said front panel, and said rear panel each further comprises a freezable gel between said interior layer and said layer of insulation and said base panel further comprises a stiffener between said layer of insulation and said exterior layer.

17. A method of using a collapsible container comprising a plurality of panels cooperatively assembled to define an interior cavity accessible via an opening and a lid movably connected to at least a portion of said plurality of panels and configured to move between an open position and a closed position whereby the opening is obstructed, the plurality of panels comprising at least a base panel, a front panel opposing a rear panel, and a pair of opposing side panels, wherein at least one of said plurality of panels further comprises an interior layer proximate the cavity, a freezable gel proximate the interior layer, an exterior layer, a layer of insulation between said exterior layer and said freezable gel, and a stiffener between said freezable gel and said exterior layer, the method comprising the steps of:

moving said lid to the open position such that the lid is proximate the rear wall;

folding each of said opposing side panels into the cavity; and folding at least a portion of said base panel into the cavity.

18. A collapsible container comprising:

a plurality of panels cooperatively assembled to define an interior cavity accessible via an opening, the plurality of panels comprising at least a base panel, a front panel opposing a rear panel, and a pair of opposing side panels, wherein the plurality of panels each comprise an interior layer proximate the cavity, an exterior layer, and a layer of insulation therebetween;

a top panel surrounding the opening, the top panel comprising a front lid movably connected to the front panel, a rear lid movably connected to the rear panel, and a pair of side lids each movably connected to a respective one of said pair of opposing side panels;

wherein the top panel is configured to move between an open position in which the opening is accessible and a closed position in which the opening is obstructed; and wherein each of said pair of side lids comprises a first panel movably connected to said front lid, a second panel movably connected to said first panel and a respective one of said pair of opposing side panels, a third panel movably connected to said side panel and the respective one of said pair of opposing side panels, and a fourth panel movably connected to said third panel and said rear lid.

19. The collapsible container of claim 18, wherein each of said first panel, said second panel, said third panel, and said fourth panel are separated from each other by fold lines.

20. The collapsible container of claim 19, wherein said top panel is movable from said open position to said closed position by moving said pair of side lids, said front lid, and said rear lid inward such that said front lid and said rear lid overlap said pair of side lids.

21. The collapsible container of claim 18, wherein said front lid comprises a first strap with a first loop and said rear lid comprises a second strap with a second loop wherein when said top panel is in the closed position, said first loop is proximate said second loop.

22. The collapsible container of claim 21, wherein the first loop is connected to the second loop by a third loop such the top panel cannot be moved to the open position.

23. The collapsible container of claim 18, wherein at least one of said plurality of panels further comprises a freezable gel between said interior layer and said layer of insulation.

24. A collapsible container comprising:

a base panel with one or more horizontal creases;

a front wall extending from the base panel;

a rear wall extending from the base panel opposite the front wall;

a pair of opposing side walls extending from the base panel between the front wall and the rear wall, each of the pair of opposing side walls comprising a vertical crease that is orthogonal to the base panel;

wherein the base panel, the front wall, the rear wall, and the pair of opposite side walls define a cavity therebetween;

wherein the container is configured to fold into a collapsed configuration by folding the base panel and each of the side walls into the cavity along the one or more horizontal creases and the pair of vertical creases;

wherein the base panel, the front wall, the rear wall, and the pair of opposing side walls each comprise an interior layer proximate the cavity, an exterior layer, and a layer of insulation therebetween; and wherein a freezable gel is between said interior layer and said layer of insulation and a stiffener is between said freezable gel and said exterior layer.

25. The collapsible container of claim 24, further comprising:

an interior flap with a first end connected to the base opposite a second end; and a pull-tab connected to the second end of the interior flap;

wherein the interior flap contains at least one gel pack;

wherein the interior flap is sized to extend proximate the base panel between the front wall and the rear wall and between the pair of side walls; and wherein the interior flap is configured to fold proximate one of the group comprising the front wall, the rear wall, and the pair of side walls when the container is in the collapsed configuration.

26. The collapsible container of claim 24, further comprising a removable liner, the removable liner comprising:

a liner base panel;

a liner front wall extending from the liner base panel;

a liner rear wall extending from the liner base panel opposite the liner front wall; and a pair of opposing liner side walls extending from the liner base panel between the liner front wall and the liner rear wall;

wherein the removable liner is sized to fit within the cavity with the liner base panel proximate the base panel, the liner front wall proximate the front wall, the liner rear wall proximate the rear wall, and each of the pair of opposing liner side walls proximate respective ones of the pair of opposing side walls; and wherein the removable liner is removed from the container when the container is in the collapsed configuration.

27. The collapsible container of claim 26, further comprising a front pocket attached to the front wall and configured to hold the removable liner when the container is in the collapsed configuration.

28. The collapsible container of claim 24, further comprising a lid movably connected to the rear wall and a clasp for removably securing the lid to the front wall.

29. The collapsible container of claim 24, further comprising a lid comprising a first flap connected to the rear wall and a second flap connected to the front wall, wherein an attachment means is configured to removably connect the first flap to the second flap.

30. The collapsible container of claim 29, wherein an upper portion of each of the pair of side walls proximate the lid further comprises a rear portion proximate the rear wall and attached to the first flap and a front portion proximate the front wall and attached to the second flap, wherein the attachment means is configured to removably secure the rear portion to the front portion.

31. The collapsible container of claim 29, wherein the attachment means comprises a zipper.

32. A method of collapsing a container comprising a base panel with one or more horizontal creases and a peripheral wall comprising a pair of opposing side walls; each with one or more vertical creases, the peripheral wall extending from the base panel to form a cavity, wherein the peripheral wall comprises a plurality of panels, the plurality of panels each comprising an interior layer proximate the cavity, an exterior layer, and a layer of insulation therebetween, and wherein at least one of said plurality of panels further comprises a freezable gel between said interior layer and said layer of insulation and a stiffener between said freezable gel and said exterior layer, the method comprising the steps of:

folding the base panel into the cavity along the one or more horizontal creases; and folding the pair of opposing side walls into the cavity along the one or more vertical creases.

33. The method of claim 32, wherein the container further comprises an interior flap attached to the base panel, the method beginning with the step of folding the interior flap proximate the peripheral wall.

34. The method of claim 32, wherein the container further comprises an insert sized to fit within the cavity and a pocket attached to the peripheral wall, the method beginning with the step of removing the insert from the cavity and further comprising the steps of:

folding the insert such that the insert is in a collapsed configuration; and placing the insert in the pocket.

* * * * *